US007024142B2

(12) United States Patent
Sakai et al.

(10) Patent No.: US 7,024,142 B2
(45) Date of Patent: Apr. 4, 2006

(54) DEVELOPING APPARATUS, DEVELOPING METHOD, IMAGE FORMING APPARATUS, IMAGE FORMING METHOD AND CARTRIDGE THEREOF

(75) Inventors: Katsuo Sakai, Kanagawa-ken (JP); Masanori Horike, Kanagawa-ken (JP); Yohichiro Miyaguchi, Kanagwa-ken (JP); Nobuaki Kondoh, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/094,766

(22) Filed: Mar. 31, 2005

(65) Prior Publication Data

US 2005/0175377 A1 Aug. 11, 2005

Related U.S. Application Data

(63) Continuation of application No. 10/394,025, filed on Mar. 24, 2003, now Pat. No. 6,901,231.

(30) Foreign Application Priority Data

Mar. 25, 2002 (JP) ..... 2002-082248
Dec. 18, 2002 (JP) ..... 2002-366174

(51) Int. Cl.
*G03G 15/08* (2006.01)

(52) U.S. Cl. ..... 399/266; 399/55; 399/285; 399/291

(58) Field of Classification Search ..... 399/53, 399/55, 234, 235, 265, 266, 285, 288, 290, 399/291; 347/55; 430/120
See application file for complete search history.

(56) References Cited

U.S. PATENT DOCUMENTS

| | | | | |
|---|---|---|---|---|
| 4,598,991 | A | 7/1986 | Hosoya et al. | 399/266 |
| 5,121,170 | A | 6/1992 | Bannai et al. | 399/303 |
| 5,204,716 | A | 4/1993 | Kasahara et al. | 355/24 |
| 5,210,551 | A | 5/1993 | Inoue et al. | 347/141 |
| 5,317,438 | A | 5/1994 | Suzuki et al. | 349/192 |

(Continued)

FOREIGN PATENT DOCUMENTS

JP 59-189371 10/1984

(Continued)

OTHER PUBLICATIONS

U.S. Appl. No. 10/751,453, Jan. 6, 2004, Miyaguchi et al.

(Continued)

*Primary Examiner*—Sophia S. Chen
(74) *Attorney, Agent, or Firm*—Oblon, Spivak, McClelland, Maier & Neustadt, P.C.

(57) ABSTRACT

A developing device including a latent image supporter. Powder is adhered on the latent image supporter to develop a latent image on the latent image supporter and a transporting member is arranged opposite to the latent image supporter. A plurality of electrodes are formed in the transporting member for generating a traveling-wave electric field to move the powder, and n-phase voltages are applied to the electrodes of the transporting member to form an electric field in a first direction so that the powder moves towards the latent image supporter at an image portion of the latent image and in a second direction so that the powder moves in a direction opposite to the latent image supporter at a non-image portion of the latent image.

8 Claims, 57 Drawing Sheets

U.S. PATENT DOCUMENTS

| | | | | |
|---|---|---|---|---|
| 5,387,963 | A | 2/1995 | Kajimoto et al. | 399/284 |
| 5,412,413 | A | 5/1995 | Sekiya et al. | 347/46 |
| 5,467,183 | A | 11/1995 | Snelling | 399/223 |
| 5,600,356 | A | 2/1997 | Sekiya et al. | 347/62 |
| 5,708,940 | A | 1/1998 | Hosaka et al. | 399/266 |
| 5,761,591 | A | 6/1998 | Yamaguchi | 399/289 |
| 5,955,228 | A | 9/1999 | Sakai et al. | 430/53 |
| 6,272,296 | B1 | 8/2001 | Gartstein | 399/55 |
| 6,367,914 | B1 | 4/2002 | Ohtaka et al. | 347/54 |
| 6,398,345 | B1 | 6/2002 | Sakai et al. | 347/55 |
| 6,597,884 | B1 | 7/2003 | Miyaguchi et al. | 399/266 |
| 6,708,014 | B1 | 3/2004 | Miyaguchi et al. | 399/266 |
| 6,816,694 | B1 | 11/2004 | Adachi et al. | 399/265 |
| 2003/0210928 | A1* | 11/2003 | Miyaguchi et al. | 399/252 |
| 2004/0037593 | A1* | 2/2004 | Sakuma et al. | 399/265 |
| 2004/0213608 | A1* | 10/2004 | Sakuma et al. | 399/388 |

FOREIGN PATENT DOCUMENTS

| | | |
|---|---|---|
| JP | 05-031146 | 2/1993 |
| JP | 06-161262 | 6/1994 |
| JP | 07-064390 | 3/1995 |
| JP | 9-197781 | 7/1997 |
| JP | 9-329947 | 12/1997 |
| JP | 2001-122436 | 5/2001 |
| JP | 2001-166556 | 6/2001 |
| JP | 2003-005524 | 1/2003 |

OTHER PUBLICATIONS

U.S. Appl. No. 11/094,766, Mar. 31, 2005, Sakai et al.

* cited by examiner

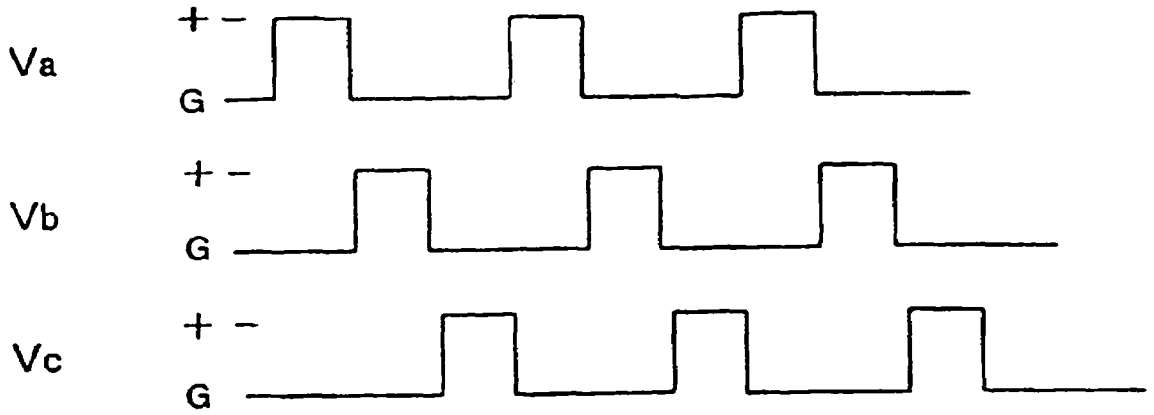
FIG. 7
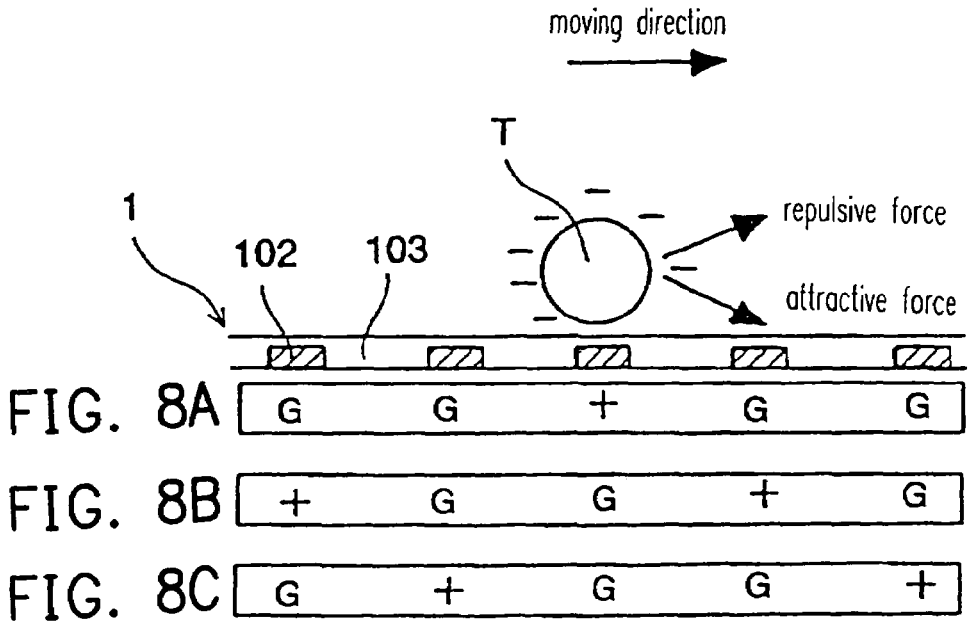

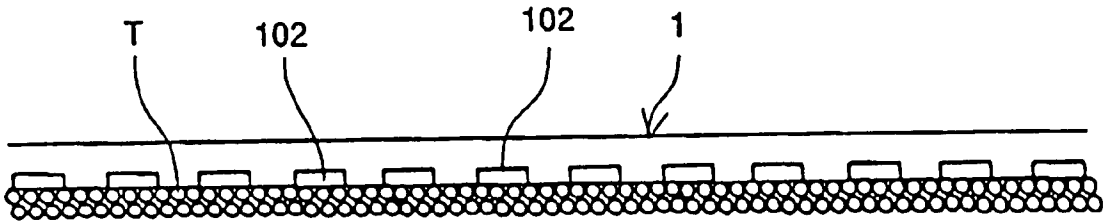
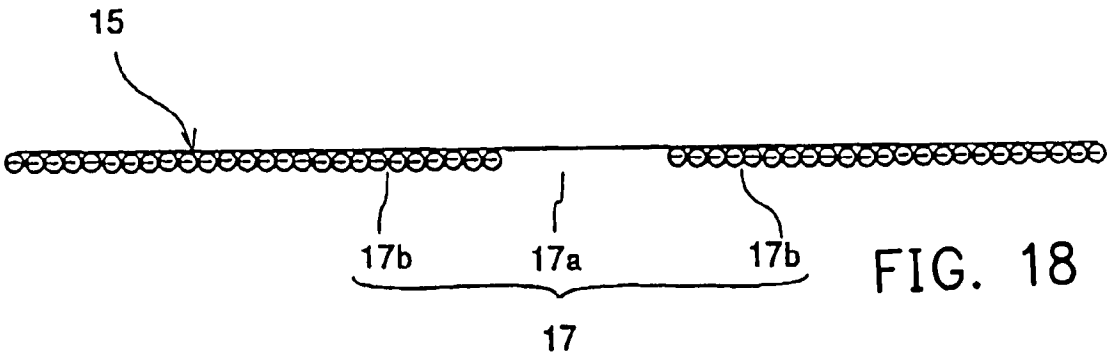
FIG. 18

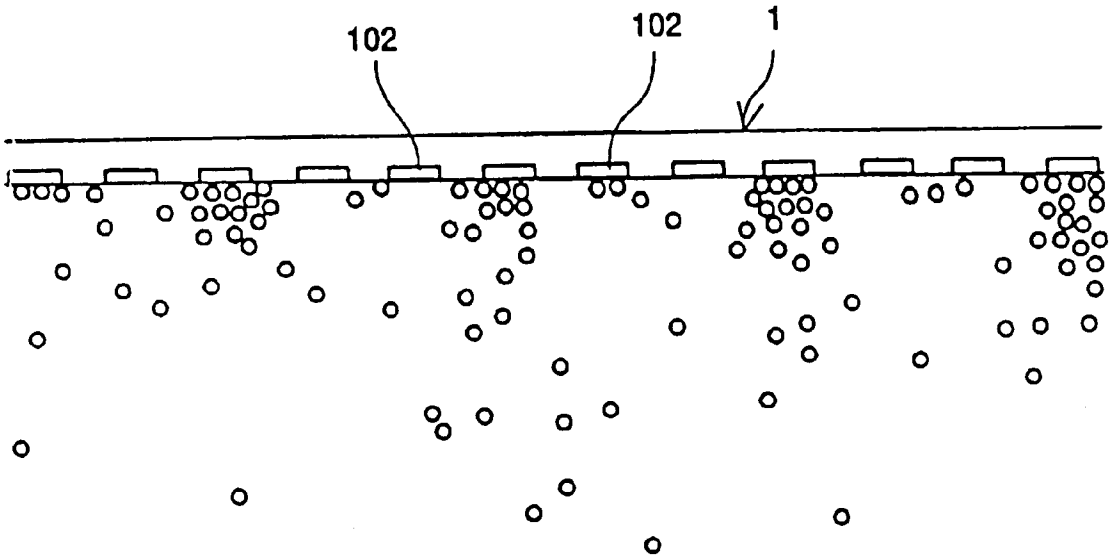
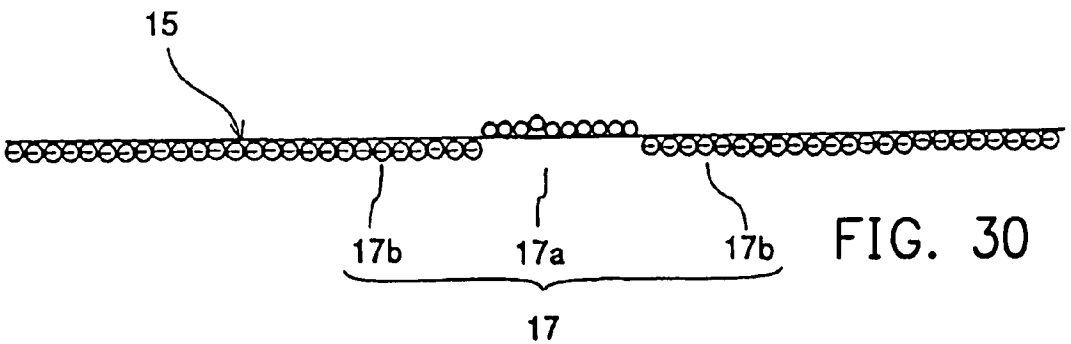
FIG. 30

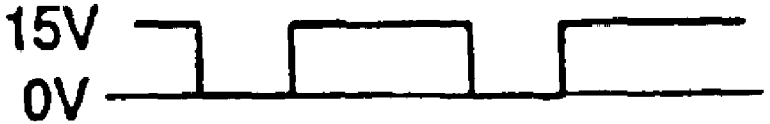
FIG. 32A IN
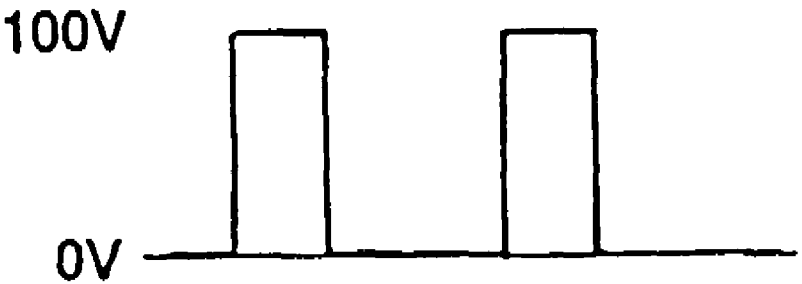
FIG. 32B m
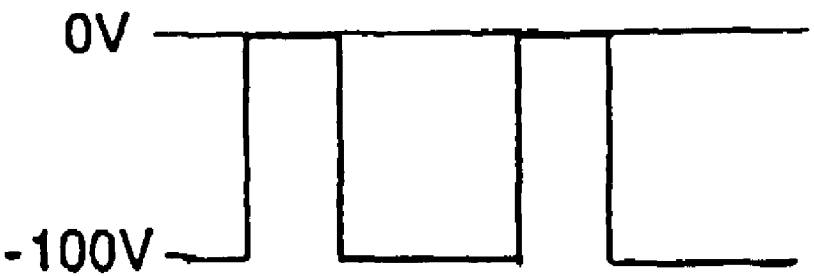
FIG. 32C OUT

FIG. 34C OUT

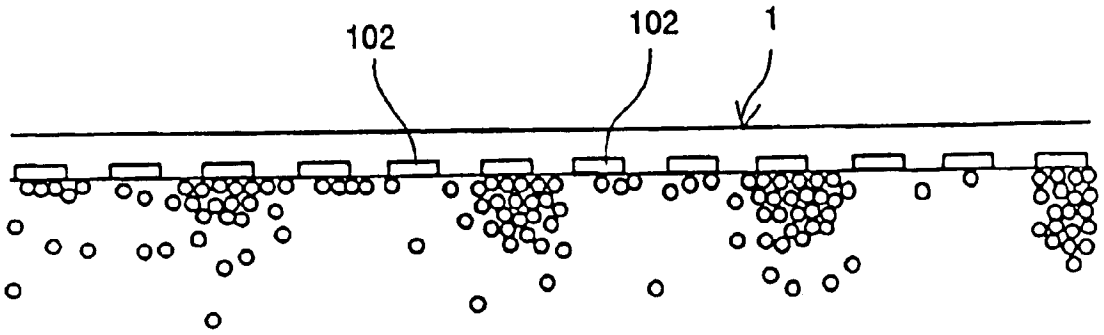
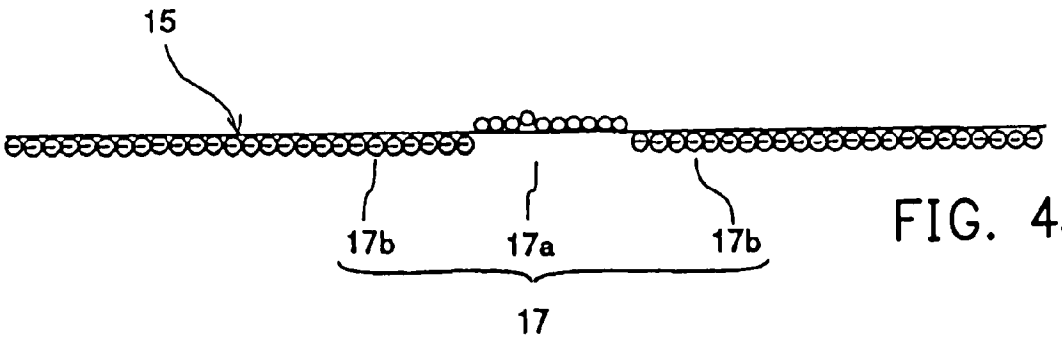
FIG. 43

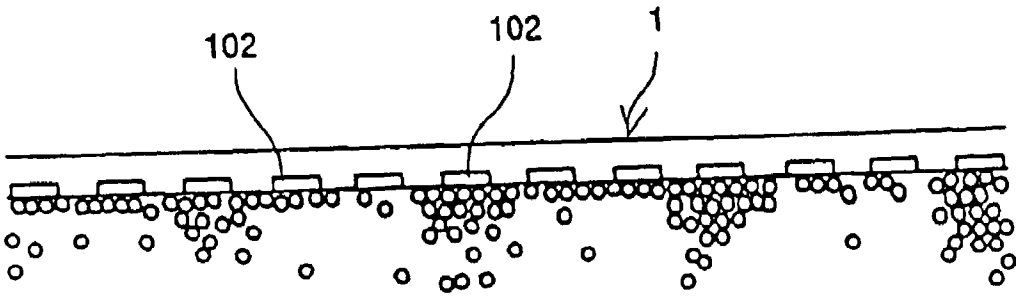
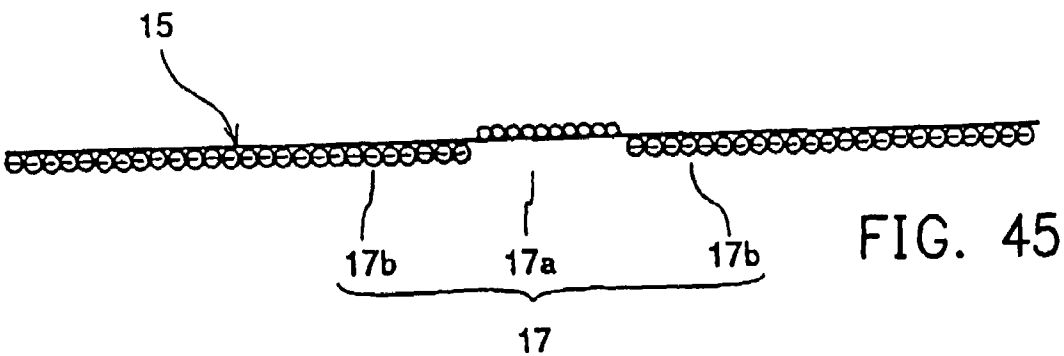
FIG. 45

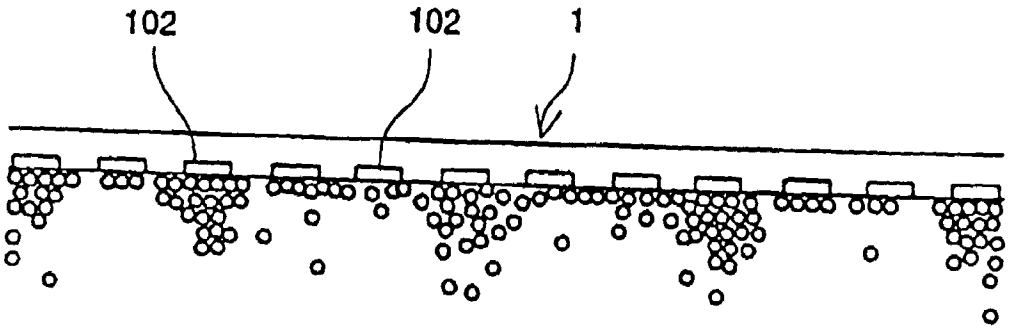
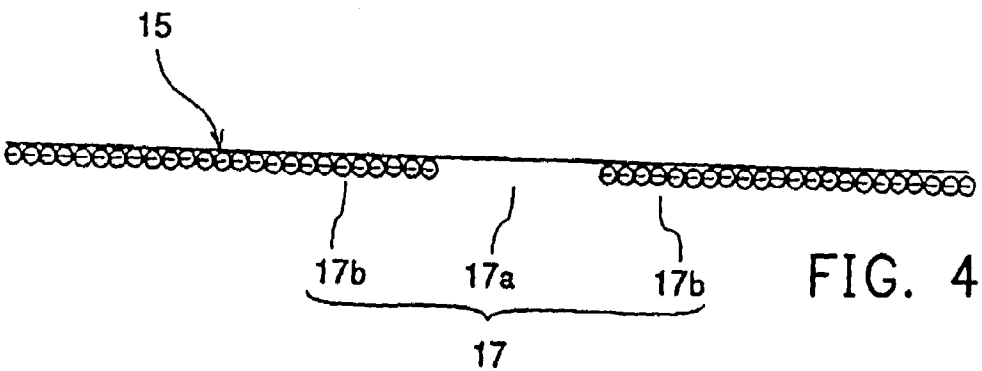
FIG. 46

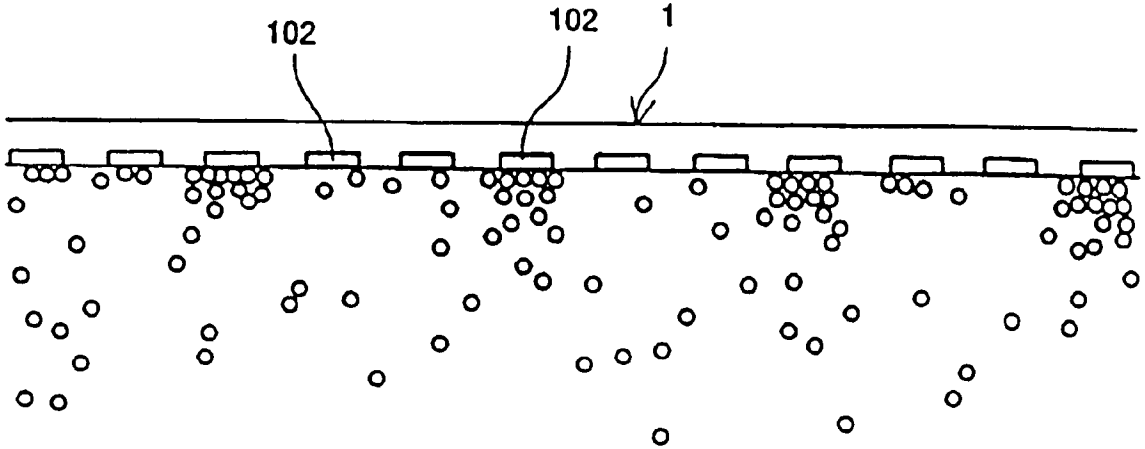
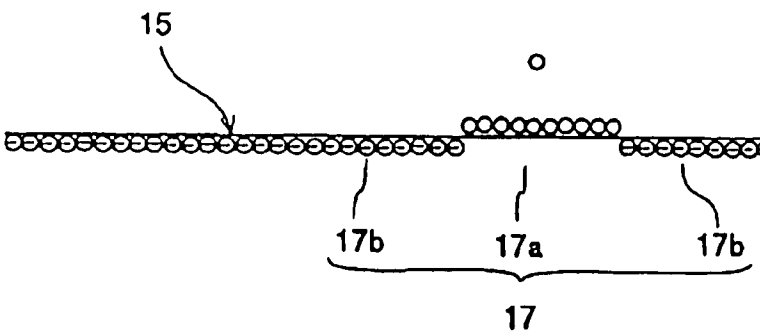
FIG. 50

DEVELOPING APPARATUS, DEVELOPING METHOD, IMAGE FORMING APPARATUS, IMAGE FORMING METHOD AND CARTRIDGE THEREOF

CROSS-REFERENCE TO RELATED APPLICATION

This application is a continuation of and claims priority under 35 U.S.C. § 120 to U.S. application Ser. No. 10/394,025, filed Mar. 24, 2003, now U.S. Pat. No. 6,901,231, the entire contents of which are incorporated herein by reference. This application claims the priority benefit of Japanese application serial nos. 2002-082248, filed on Mar. 25, 2002; and 2002-366174, filed on Dec. 18, 2002.

BACKGROUND OF THE INVENTION

1. Field of the Invention

This invention relates in general to a developing device, a developing method, an image forming device, an image forming method and a process cartridge.

2. Description of Related Art

An image forming device, such as a copying device, a printer or a facsimile, etc., uses an electrophotographic process to form a latent image on a latent image supporter. Powder, as a developer (here, referring to toner), is adhered onto the latent image, and then the latent image is developed and visualized as a toner image. The toner image is transferred onto a recording medium or onto an intermedium transfer medium and then onto a recording medium. In this way, an image is formed.

In such a image forming device described above, there is a developing device for developing the latent image. Conventionally, toner stirred within the developing device is supported on a surface of a developing roller (a developer supporter). By rotating the developing roller, the toner is transported to a position facing the surface of the latent image supporter and the latent image on the latent image supporter is developed. After the development is finished, toner without being transferred to the latent image supporter is recycled back to the developing device by the rotation of the developing roller. The toner is stirred and charged and then transported, so that the toner is supported on the developing roller again. This technology described above is well known.

In addition, in an image forming device as disclosed in Japanese Laid Open Publication No. 9-197781 and No. 9-329947, an overlapping voltage of a DC voltage and an AC voltage is applied to between the latent image supporter and the developing roller. It is also well know that a method of a jumping development, in which the toner is transferred to the latent image supporter from a developing roller in a non-contact manner, is used to develop the latent image.

Furthermore, in an image forming device as disclosed in Japanese Laid Open Publication No. 5-31146 and No. 5-31147, an electrostatic transporting substrate is used. The toner is transported to a position facing the latent image supporter, and then the toner vibrates, floats and becomes smoke, so that the toner is separated from a transporting surface by an attractive force created between the latent image supporter and the toner and then the toner is adhered onto the surface of the latent image supporter.

However, in the image forming device with the developing device where the aforementioned developing roller is used to provide the toner to the latent image supporter, toner will intrude to between the developing roller and a side plate of the developing device. The toner rubs to cause a toner adhesion problem, etc. Therefore, the image is adversely affected. In addition, the sealing member for sealing the periphery of the developing device will degrade with time. Due to stirring and charging the developer or the toner in the developing device, the toner is scattered and the background of the image is contaminated.

In addition, when the toner is charged by friction charging or corona discharging/charging, the saturated charged toner and non-saturated charged toner are mixed, so that the charge distribution is wide. When such toner is forced to transferred to the developing roller by using a magnetic brush or a transfer roller, etc., among the toner supported on the developing roller, toner with few charges will escape at a high developing speed (a line speed of about 100 cm/sec) of the developing roller. Therefore, the toner is scattered and the background of the image is easily contaminated.

Moreover, for a developing device to perform the so-called jumping development, because it has to exchange charged toner with a high voltage, a high voltage source is required, so that the device becomes large and its cost will increase.

In addition, the current problem in the image forming device using the powder (toner) is to satisfy the image quality, the cost issue and the environment problem. Regarding the image quality, when forming a color image, how to develop a single dot with a diameter of about 30 μm with a resolution of 1200 dpi is a problem, but it is preferable to develop without background contamination. In addition, regarding the cost issue, if considering a personal laser printer, not only the cost of the developing device or the developer, it is very important to reduce the total cost, including the maintenance and the final disposal cost. For the environment issue, in particular, it is very important to prevent the minute particles (toner) from being scattered within or out of the device.

SUMMARY OF THE INVENTION

According to the foregoing description, an object of this invention is to provide a developing device where an electrostatic transporting and hopping (ETH) phenomenon is used to obtain a high developing efficiency with a low voltage driving. The present invention also provides a process cartridge and an image forming device, both having the developing device.

Another object of the present invention is to provide a developing device and a developing method. The developing device and the developing method that can be driven with a low voltage and can obtain a high developing efficiency, and additionally, the developing device and the developing method are capable of preventing the powder scattering. The present invention also provides a process cartridge and an image forming device both having the developing device. The present invention also provides an image forming method using the developing method.

According to the objects mentioned above, the present invention provides a developing device, comprising: a transporting member arranged opposite to a latent image supporter and configured to develop a latent image on the latent image supporter with a powder while moving the powder. The transporting member comprises a plurality of electrodes configured to generate a traveling-wave electric field to move the powder, wherein n-phase voltages are applied to the plurality of electrodes of the transporting member to form an electric field such that the powder moves towards the latent image supporter at an image portion of the latent image and the powder moves in a direction opposite to the latent image supporter at a non-image portion of the latent image.

An average potential of the n-phase voltages applied to the plurality of electrodes of the transporting member can be set to a potential between a potential of the image portion of the latent image and a potential of the non-image portion of the latent image. In addition, the n-phase voltages applied to the electrodes of the transporting member have a waveform such that a pulse voltage and a DC bias voltage are overlapped. The developing device can also comprises means for outputting the DC bias voltage, wherein the means is able to vary the DC bias voltage.

Preferably, the n-phase voltages applied to the plurality of electrodes of the transporting member are pulse-shaped waveforms. The n-phase voltages applied to the plurality of electrodes of the transporting member have a pulse-shaped waveform, and wherein a potential of the pulse-shaped waveform that causes the powder to repulsively fly is a potential between a potential of the image portion of the latent image and a potential of the non-image portion of the latent image.

The present invention further provides a developing device, which develops a latent image on a latent image supporter with a powder while moving the powder. The developing device comprises a means for generating an electric field in a direction so that the powder moves in a direction opposite to the latent image supporter at a region after a developing region.

The present invention also provides a developing device, which develops a latent image on a latent image supporter with a powder while moving the powder. The developing device comprises a means for generating a first electric field such that the powder at an image portion of the latent image moves towards the latent image supporter and the powder at a non-image portion of the latent image move in a direction opposite to the latent image supporter, and for generating a second electric field such that the powder present at a region after a developing region moves in a direction opposite to the latent image supporter.

A strength of the electric field formed at the region after the developing region is set within a range so that the powder adhered on the latent image supporter is not separated from a surface of the latent image supporter.

Preferably, the means for generating an electric field comprises a transporting member, wherein the transporting member comprises a plurality of electrodes for generating a traveling-wave electric field to transport the powder, and wherein n-phase voltages are applied to each of the plurality of electrodes of the transporting member.

In this case, the n-phase voltages are applied to the transfer member such that in the developing region an electric field in a direction where the powder moves towards the latent image supporter is formed at the image portion of the latent image but moves in a direction opposite to the latent image supporter at the non-image portion of the latent image, and an electric field in a direction where the powder moves in a direction opposite to the latent image supporter is formed in the region after the developing region.

In addition, when the powder is negatively charged, at the developing region, an average potential of the n-phase voltages applied to the transporting member is set to a potential between a potential of the image portion of the latent image and a potential of the non-image portion of the latent image, and wherein at the region after the developing region, an average potential of the n-phase voltages applied to the transporting member is set to a potential higher than the potentials of the image portion and the non-image portion. When the powder is positively charged, at the developing region, an average potential of the n-phase voltages applied to the transporting member is set to a potential between a potential of the image portion of the latent image and a potential of the non-image portion of the latent image, and wherein at the region after the developing region, an average potential of the n-phase voltages applied to the transporting member is set to a potential lower than the potentials of the image portion and the non-image portion.

Different bias voltages can be further applied to the transporting member depending on a gap between the latent image supporter and the transporting member. The n-phase voltages applied to the transporting member are changed depending on a gap between the latent image supporter and the transporting member. In addition, a gap between the latent image supporter and the transporting member at the developing region is substantially the same as a gap between the latent image supporter and the transporting member at the region after the developing region. The transporting member comprises a bent portion. The bent portion of the transporting member is formed at the region after the developing region. The gap between the latent image supporter and the portion of the transporting member at the region after the developing region is getting wider in a direction opposite to the developing region.

In addition, when the powder is negatively charged, a the voltages applied to the electrodes are from 0V to −V 1 at the developing region, and from 0V to +V2 at the region after the developing region. When the powder is positively charged, the voltages applied to the electrodes are from 0V to +V3, and from 0V to −V4 at the region after the developing region. In this case, the developing device can further comprise a circuit for generating the n-phase applied to the electrode of the transporting member, wherein the circuit comprises a clamper circuit.

In addition, when the powder is negatively charged, the voltages applied to the electrodes are from −V5 to −V6 (V5>V6) at the developing region, and from +V7 to +V8 (V8>V7) at the region after the developing region. When the powder is positively charged, the voltages applied to the electrodes are from +V9 to +V10 (V10>V9) at the developing region, and from −V11 to −V12 (V11>V12) at the region after the developing region. In this case, the developing device can further comprises a circuit for generating the n-phase voltages applied to the electrode of the transporting member, wherein the circuit comprises a clamper circuit, and wherein the clamper circuit comprises a means for generating a DC bias voltage.

The present invention further provides a developing method, in which a latent image on a latent image supporter is developed with a powder to form a visual image thereon. The method comprises developing the latent image with the powder at a developing region; and forming an electric field in a direction such that the powder moves in a direction opposite to the latent image supporter at a region after a developing region.

The present invention further provides a process cartridge, which is detachable from a main body of an image forming device. The process cartridge comprises a housing; and any one of the developing devices described above.

The present invention further provides an image forming device, comprising: a latent image supporter configured to bear a latent image thereon; and a developing device configured to develop the latent image with a powder to form a visual image on the latent image supporter, wherein the developing device is any one of the developing devices described above. Alternatively, the image forming device can comprises a latent image supporter configured to bear a latent image thereon; and a process cartridge configured to develop the latent image with a powder to form a visual image on the latent image supporter, wherein the process cartridge is the process cartridge according to claim 52.

The present invention further provides an image forming method comprising steps of forming a latent image on a latent image supporter; developing the latent image with a powder at a developing region; and forming an electric field in a direction such that the powder moves in a direction opposite to the latent image supporter at a region after the developing region.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIG. 7 shows an example of driving waveforms provided to the transporting substrate;

FIGS. 8A to 8C are diagrams to explain the transporting and hipping of a powder;

FIG. 18 is a diagram showing a toner distribution right before the driving wave forms of the hopping voltage pattern are applied to start the development;

FIG. 30 shows a toner distribution after 1000 μsec from FIG. 26;

FIGS. 32A to 32C show driving waveforms for the waveform amplifier;

FIG. 43 is an exemplary wave amplifier for generating the driving waveforms of the recycling and transporting voltage pattern;

FIG. 45 shows a toner distribution that 1000 μsec has lapsed after the driving waveform where the recycling and transporting voltage pattern adds with a bias voltage of +100V is applied;

FIG. 46 shows a toner distribution that 1000 μsec has lapsed after the driving waveform where the recycling and transporting voltage pattern adds with a bias voltage of +150V is applied;

FIG. 50 shows a toner distribution that 1000 μsec has lapsed after the driving waveforms of the recycling and transporting voltage pattern is applied according to the developing device of the fourth embodiment of the present invention;

DESCRIPTION OF THE PREFERRED EMBODIMENT

Figure 1:
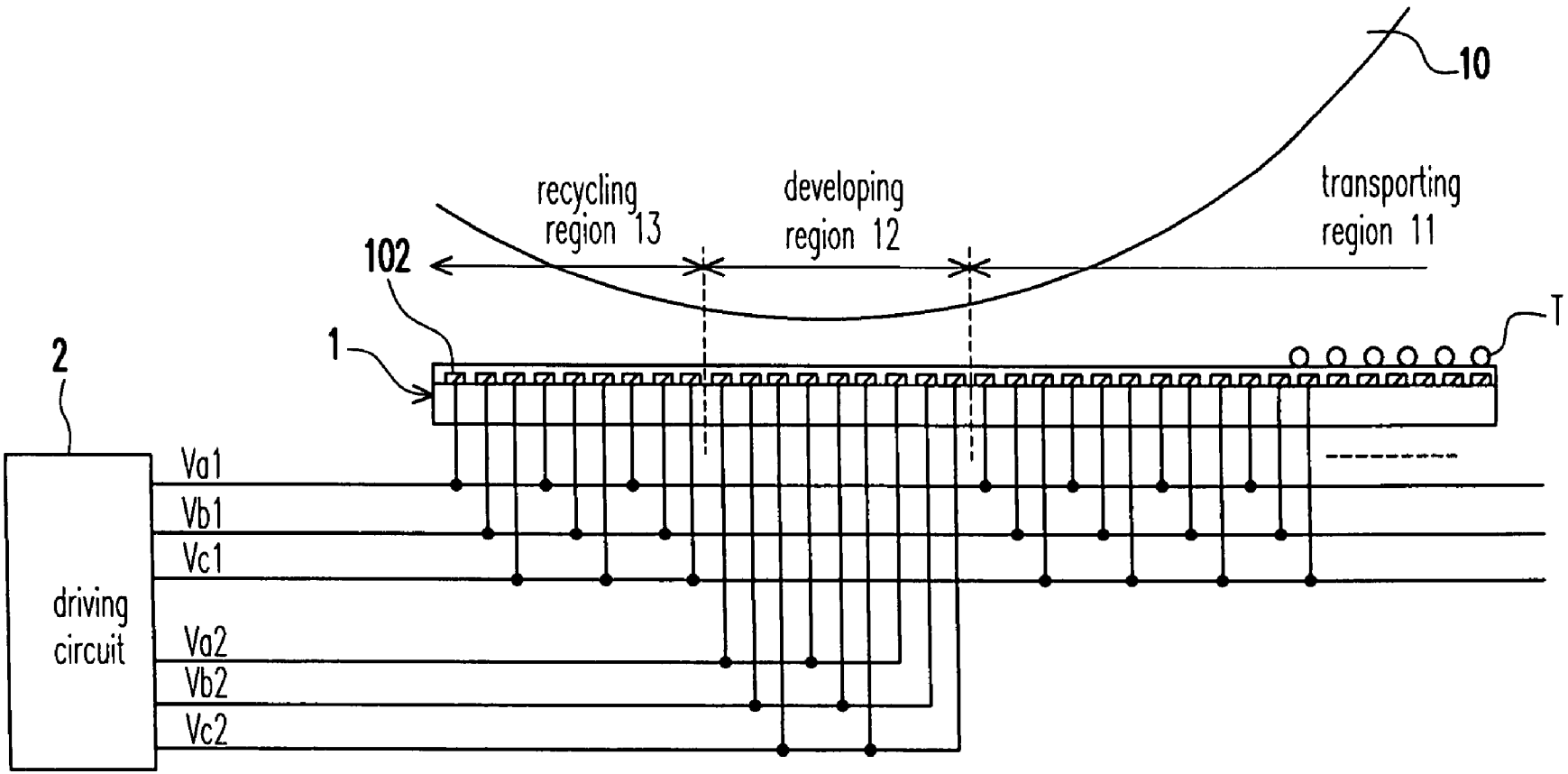
FIG. 1 schematically shows a developing apparatus according to the first embodiment of the present invention.

Embodiments of the present invention are described in detail accompanying with attached drawings. FIG. 1 schematically shows a developing apparatus according to the first embodiment of the present invention.

The developing apparatus comprises a transporting substrate 1, used as a transporting member. The transporting substrate 1 comprises a plurality of electrodes 102 for generating an electric field for transporting, hopping and recycling powder-shaped toner T. Different driving waveforms Va1 to Vc1 and Va2 to Vc2 with n phases (three phases, for example) for generating a required electric field from a driving circuit 2 are applied to each of the electrodes 102 of the transporting substrate 1.

Regarding a relationship between a photosensor drum (a latent image supporter) 10 and regions of the electrodes 102 where the driving waveforms Va1 to Vc1 and Va2 to Vc2 are applied thereon, the transporting substrate 1 is divided into three regions: a transporting region 11 where the toner T is transported to in the vicinity of the photosensor drum 10, a developing region 12 where the toner T is adhered to a latent image on the photosensor drum 10 to form a toner image, and a recycling region 13 that is located after the developing region 12 to recycle the toner T back to the transporting substrate 1 side.

At the transporting region 11 of the transporting substrate 1, the developing apparatus (1) transports the toner T to in the vicinity of the photosensor drum 10. At the developing region 12, the developing device (1) forms an electric field in a direction where the toner T moves to the photosensor drum 10 at the image portion of the latent image that is on the photosensor drum 10 and move in a direction opposite to the photosensor drum 10 at the non-image portion. The developing device (1) also forms an electric field so that the toner T is adhered on the latent image to develop the latent image. At the recycling region 13, the developing device (1) forms an electric field in a direction where the toner T moves in a direction opposite to the photosensor drum 10 either at the image portion or at the non-image portion.

In this way, the toner T is adhered to a latent image on the photosensor drum 10 and then visualized at the developing region 12. The toner without contribution to the development is recycled back to the transporting substrate 1 at the recycling region 13 that is located at a downstream side of the rotational direction of the photosensor drum 10, and therefore, an occurrence of scattering toner can be avoided and the floating toner can be exactly recycled.

Figure 2:
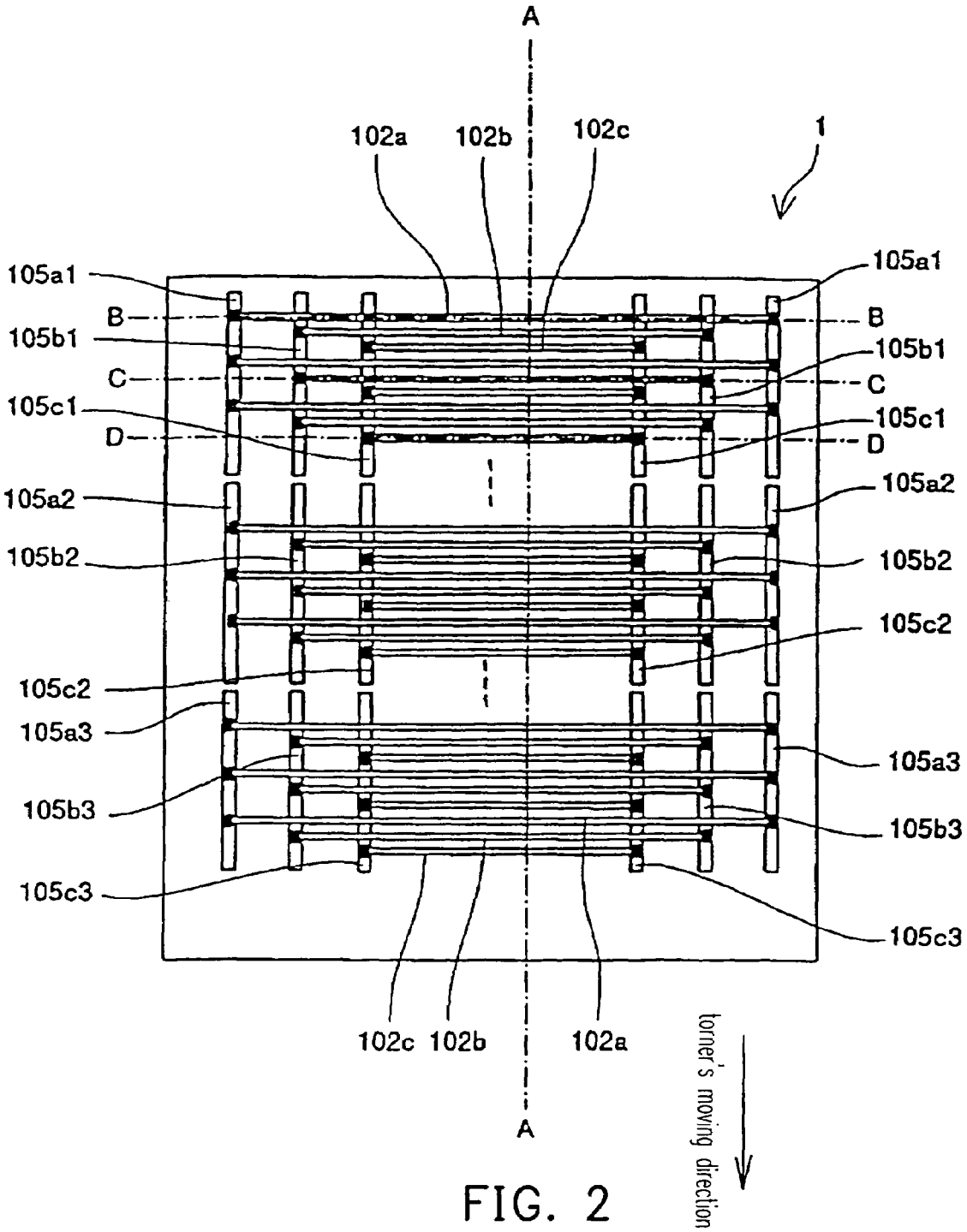
FIG. 2 is a top view of the transporting substrate.
Figure 3:
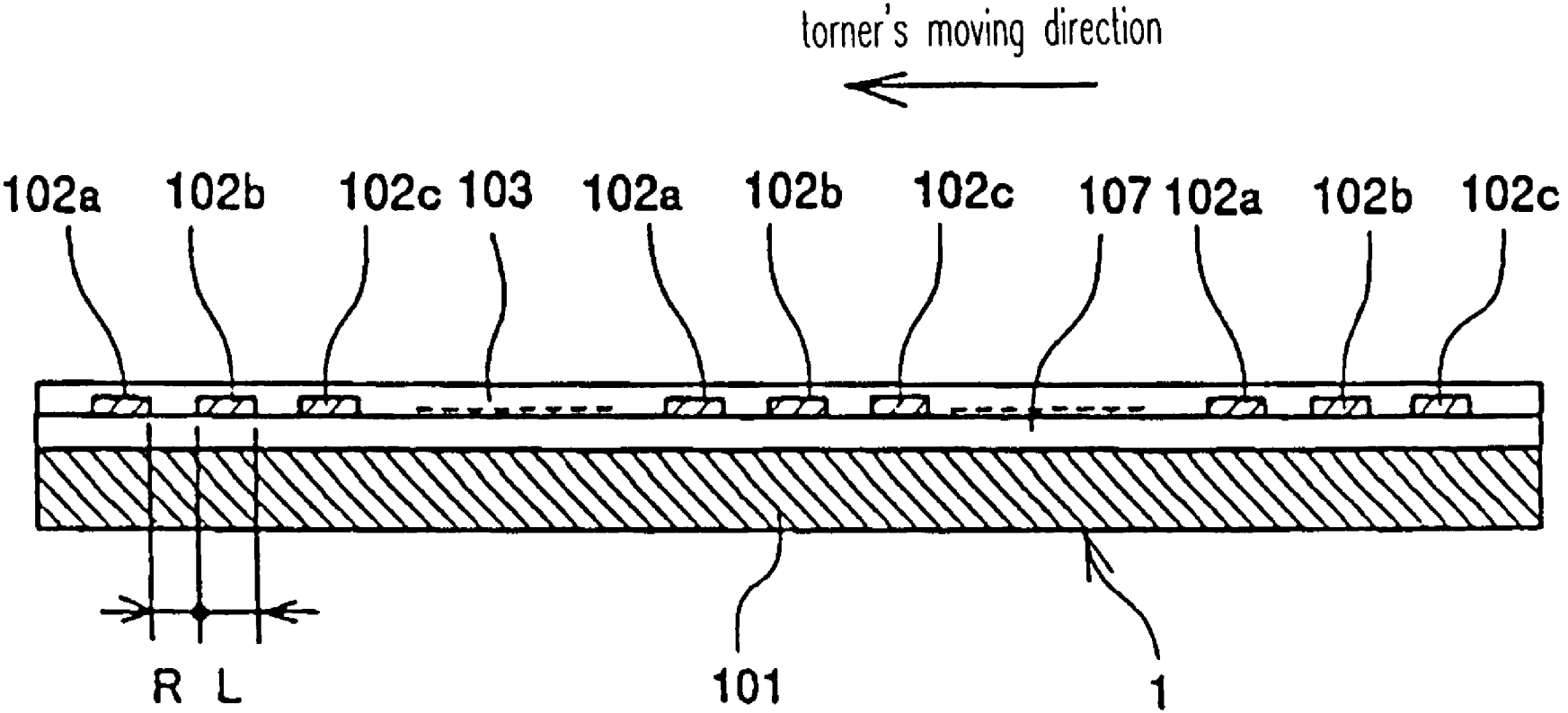
FIG. 3 is a cross-sectional view of the transporting substrate, which is cut along an A—A line in FIG. 2.
Figure 4:
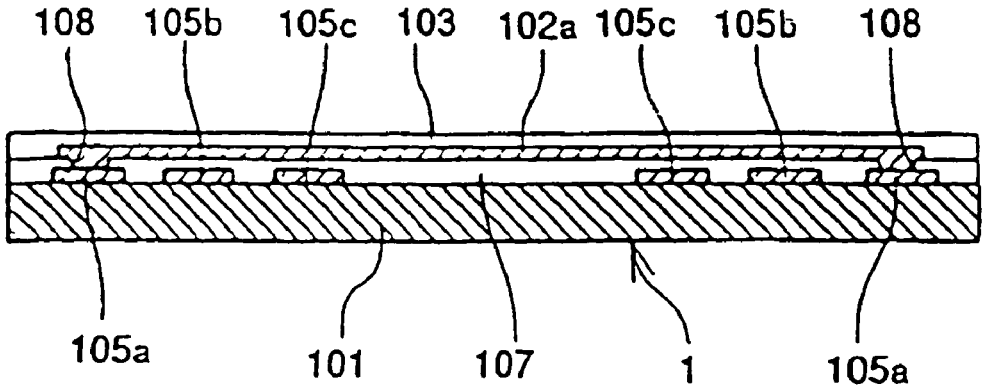
FIG. 4 is a cross-sectional view of the transporting substrate, which is cut along a B—B line in FIG. 2.
Figure 5:
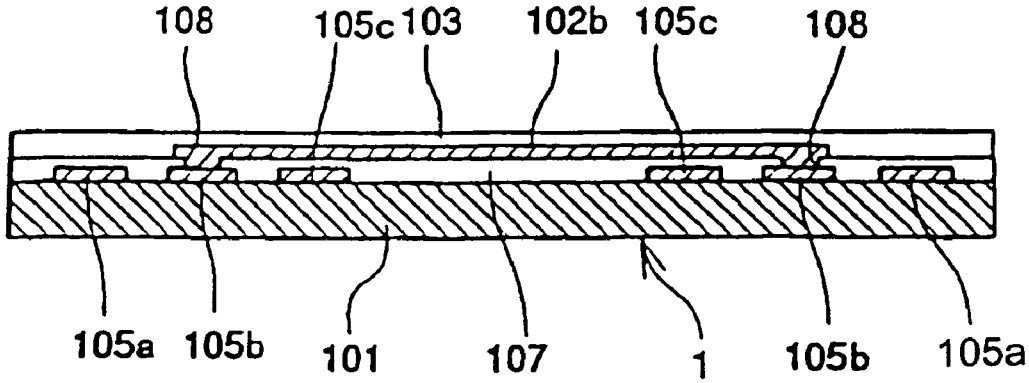
FIG. 5 is a cross-sectional view of the transporting substrate, which is cut along a C—C line in FIG. 2.
Figure 6:
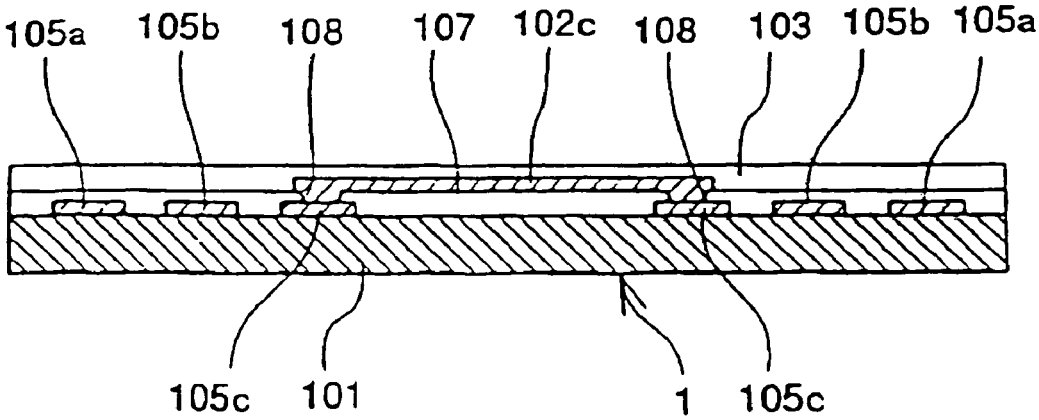
FIG. 6 is a cross-sectional view of the transporting substrate, which is cut along a D—D line in FIG. 2.

A structure of the transporting substrate 1 of the developing device (1) is described in detail referring to FIG. 2 to FIG. 6. FIG. 2 is top view of the transporting substrate. FIG. 3 is a cross-sectional view of the transporting substrate, which is cut along an A—A line in FIG. 2. FIG. 4 is a cross-sectional view of the transporting substrate, which is cut along a B—B line in FIG. 2. FIG. 5 is a cross-sectional view of the transporting substrate, which is cut along a C—C line in FIG. 2. FIG. 6 is a cross-sectional view of the transporting substrate, which is cut along a D—D line in FIG. 2.

Among the electrodes 102, each of three electrodes (transporting electrodes) 102*a*, 102*b*, 102*c* (all refer to 102) on a base substrate (a supporting substrate) 101 are grouped as one set, and these electrode sets are repeatedly formed in a direction substantially perpendicular to a toner moving direction and arranged with a predetermined gap along the toner moving direction. In FIGS. 2 and 3, the toner propagating direction or the toner moving direction is represented by an arrow direction. A surface protection layer 103, which is formed by an inorganic or an organic insulating material, is deposited on the transporting substrate 1 to serve as a protection layer that covers the electrodes 102, as well as to serve as an insulating transporting material to form a transporting surface on the electrodes. In addition, the surface protection layer 103 forms a transporting surface, but a surface layer with an excellent suitability to powder (toner) can be further formed on the surface protection layer 103.

Common electrodes 105*a*, 105*b*, 105*c* (hereinafter, all refer to 105), which are respectively connected to two ends of the corresponding electrodes 102*a*, 102*b*, 102*c*, are arranged at two sides of the electrodes 102*a*, 102*b*, 102*c* along the toner transporting direction, i.e., a direction substantially perpendicular to each of the electrodes 102. In this situation, a width of the common electrode 105 (this width is defined in a direction perpendicular to the toner transporting direction) is wider than a width of the electrode 102 (this width is defined in the toner transporting direction). Referring to FIG. 2, for distinguishing, the common electrodes 105 are represented by the common electrodes 105*a*1, 105*b*1, 105*c*1 at the transporting region 11, by the common electrodes 105*a*2, 105*b*2, 105*c*2 at the developing region 12, and by the common electrodes 105*a*3, 105*b*3, 105*a*3 at the recycling region 13, respectively.

Referring to FIG. 4, after patterns of the common electrodes 105*a*, 105*b*, 105*c* are formed on the supporting substrate 101, an interlayer insulating layer 107 is formed over the common electrodes 105. The material of the interlayer insulating layer can be the same as or different from the material of the surface protection layer 103. Referring to FIGS. 4 to 6, after contact holes 108 are formed in the interlayer insulating layer 107, the electrodes 102*a*, 102*b*, 102*c* are respectively connected to the common electrodes 105*a*, 105*b*, 105*c*.

A first interlayer insulating layer is formed on a first pattern where the electrode 102*a* and the common electrode 105*a* are integrally formed. A second pattern where the electrode 102*b* and the common electrode 105*b* are integrally formed is formed on the first interlayer insulating layer. A second interlayer insulating layer is further formed on the second pattern, and a third pattern where the electrode 102*c* and the common electrode 105*c* are integrally formed is formed on the second interlayer insulating layer. Namely, a triple-layered electrode structure can be made. Alternatively, forming electrode and the common electrode integrally formed to connect to each other and forming the electrode and the common electrode to be connected to each other by a contact hole can be used together.

Although not shown in the drawings, driving signal input terminals for inputting driving signals (driving waveforms) Va, Vb, Vc from the driving circuit 2 are respectively formed on the common electrodes 105*a*, 105*b*, 105*c*. The driving signal input terminals can be disposed on a back side of the supporting substrate 101 so as to connect to the common electrodes 105 via through holes. Alternatively, the driving signal input terminals can also be formed on the interlayer insulating layer 107 that will be described below.

The supporting substrate 101 can be a substrate made of an insulating material such as a glass substrate, a resin substrate or a ceramic substrate. The supporting substrate 101 can be formed by depositing an insulating layer (such as a SiO2 layer) on a substrate made of a conductive material, such as an SUS material (stainless steel). Alternatively, the supporting substrate 101 can be a substrate made of a flexibly deformable material, such as a polyimide film.

The electrodes 102 can be formed by a conductive material, such as Al, Ni—Cr, etc., to deposit a conductive film on the supporting substrate 101 with a thickness of 0.1 to 10 μm, and 0.5 to 2.0 μm is preferred. By using a photolithography technology, etc. to the conductive film, a desired electrode shape is patterned thereon and thus the electrodes 102 are formed on the supporting substrate 101. The width L of the plurality of electrodes 102 in the powder moving direction is one to twenty (20) times of the average diameter of the moved powder, and the gap R between the two adjacent electrodes 102 in the powder moving direction is one to twenty (20) times of the average diameter of the moved powder.

The surface protection layer 103 can be formed by such as SiO2, TiO2, TiO4, SiON, BN, TiN, Ta202 with a thickness of 0.5 to 10 μm, and 0.5 to 3 μm is preferred. In addition, an inorganic nitride compound, such as SiN, BN, W, etc., can also be used. In particular, when a surface hydroxyl group increases, a charge amount of the charged toner tends to reduce during the transportation, an inorganic nitride compound with less surface hydroxyl group is preferred.

Next, the operation principle of the electrostatic transportation for the toner on the transporting substrate 1 is described. By applying driving waveforms with n phases to the plurality of electrodes 102 of the transporting substrate 1, a phase-shifting electric field (traveling-wave electric field) is created by the plural electrodes 102. The charged toner on the transporting substrate 1 is subjected to a repulsive force and/or an attractive force, so as to move with transporting and hopping in a transportation direction.

For example, as shown in FIG. 7, three-phase pulse-shaped driving waveforms (driving signals) A (A phase), B (B phase) and C (C phase), which vary between a ground level "G" (e.g., 0V) and a positive voltage "+", are applied to the plural electrodes 102 on the transporting substrate 1, wherein timings of the three-phase driving waveforms A, B and C are shifted.

At this time, as shown in FIG. 8A, a negatively charged toner T is on the transporting substrate 1. If the consecutive electrodes 102 on the transporting substrate 1 are respectively applied with voltages "G", "G", "+", "G" and "G" as showing in (1), the negatively charged toner T is then positioned at the electrode 102 that is applied with the positive voltage "+".

As shown in FIG. 8B, at the next timing, the electrodes 102 are respectively applied with voltages "+", "G", "G", "+" and "G", the negatively charged toner T is subject to a repulsive force created between its left side electrode (with voltage "G") and the electrode 102 and an attractive force created between its right side electrode (with voltage "+") and the electrode 102. As a result, the negatively charged toner T is moved towards the next electrode 102 located its right side (applied with the positive voltage "+"). Next, referring to FIG. 8C, at the next timing, the electrodes 102 are respectively applied with voltages "G", "+", "G", "G" and "+", the negatively charged toner T is similarly subject to a repulsive force and an attractive force. As a result, the negatively charged toner T is further moved towards the next electrode 102 located its right side (applied with the positive voltage "+").

By applying multi-phase driving waveforms with voltage differences to the plural electrodes 102, a traveling-wave electric field is generated on the transporting substrate 1. The negatively charged toner T is thus moving, as well as transporting and hopping, in a propagation direction of the traveling-wave electric field. In addition, for a positively charged toner, the toner can move similarly in the same direction by applying a reverse varied pattern of the driving waves.

Figure 9A:
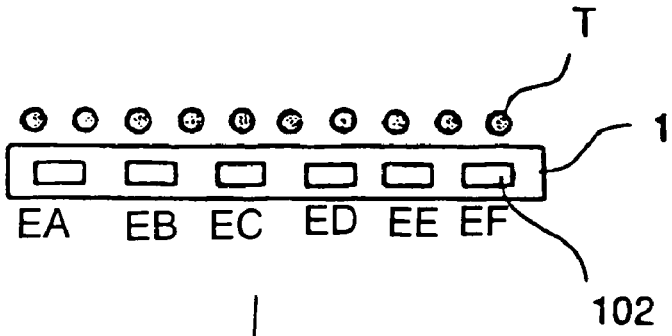
FIG. 9 is an exemplary circuit of the driving circuit in FIG. 1.
Figure 9B:
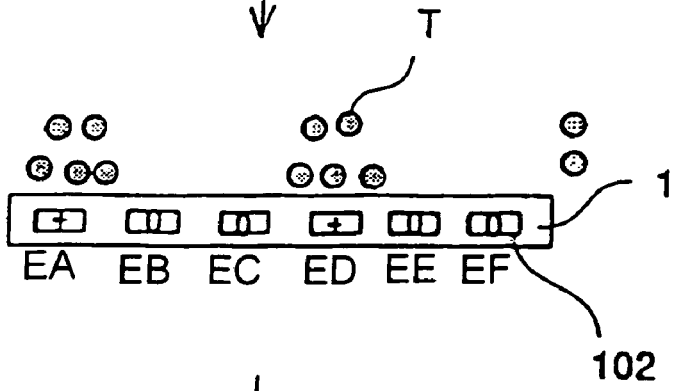
Figure 9C:
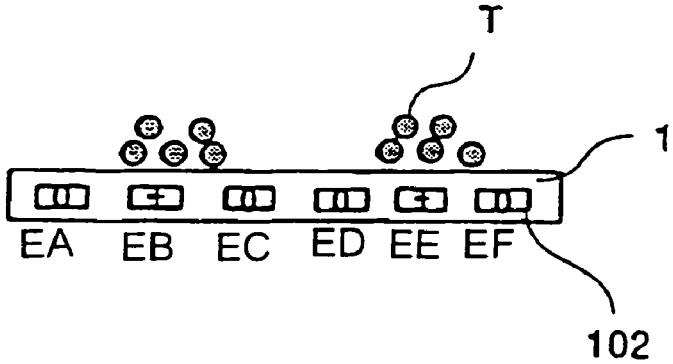
Figure 9D:
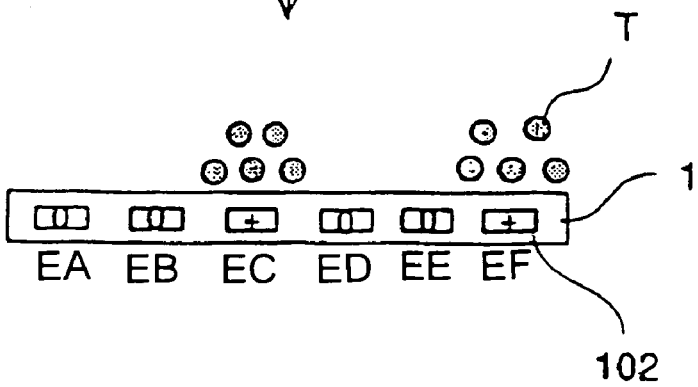

An example is described in detail by referring to FIGS. 9A to 9D. As shown in FIG. 9A, any one of the electrodes 102 are applied with the ground level "G", and the negatively charged toner T is laid on the transporting substrate 1. Referring to FIG. 9B, as the positive voltage "+" is applied to the electrodes EA and ED, the negatively charged toner T is attracted by the electrodes EA and ED, and then moved towards the electrodes EA and ED. At the next timing, as shown in FIG. 9C, the voltage applied to the electrodes EA and ED becomes "0", and the positive voltage "+" is applied to the electrodes EB and EE. Then, the toner on the electrodes EA, ED is subject to a repulsive force and an attractive force from the electrodes EB, EE. As a result, the negatively charged toner T on the electrodes EA, ED is moved respectively towards to the electrodes EB, EE. At the next timing, as shown in FIG. 9D, the voltage applied to the electrodes EB and EE becomes "0", and the positive voltage "+" is applied to the electrodes EC and EF. Then, the toner on the electrodes EB, EE is subject to a repulsive force and an attractive force from the electrodes EC, EF. As a result, the negatively charged toner T on the electrodes EB, EE is moved respectively towards to the electrodes EC, EF. By such a traveling-wave electric field, the negatively charged toner T is transported towards the right direction as shown in FIGS. 9A to 9D.

Figure 10:
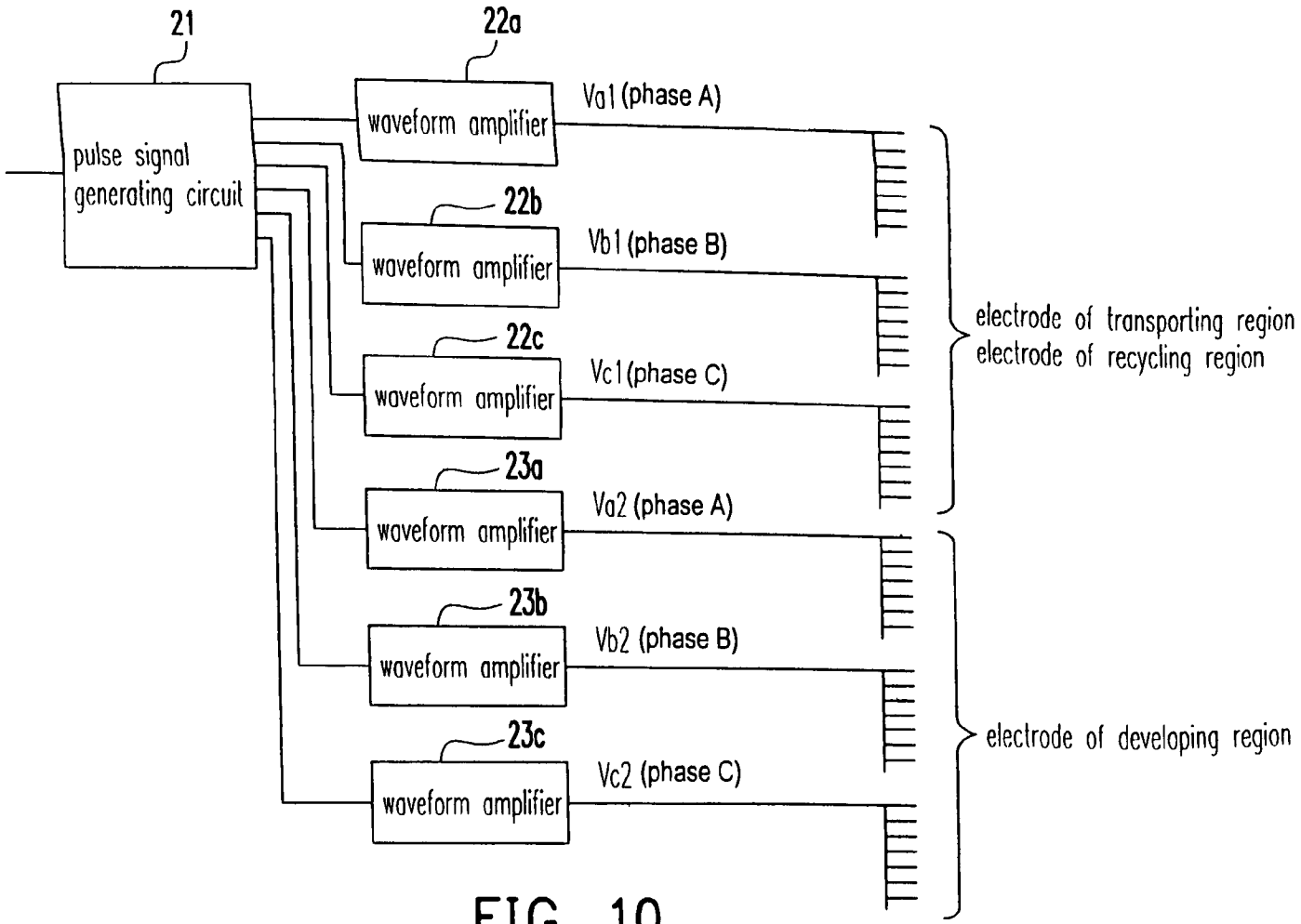
FIG. 10 is a block diagram of an example of a driving circuit of the developing device.

Next, the entire structure of the driving circuit 2 is described in detail by referring to FIG. 10. The driving circuit 2 comprises a pulse signal generating circuit 21, waveform amplifying circuits 22*a*, 22*b*, 22*c*, and waveform amplifying circuits 23*a*, 23*b*, 23*c*. The pulse signal generating circuit 21 generates and outputs a pulse signal. The waveform amplifying circuits 22*a*, 22*b*, 22*c* receives the pulse signal form the pulse signal generating circuit 21, and then generates and outputs driving waveforms Va1, Vb1, Vc1, respectively. The waveform amplifying circuits 23*a*, 23*b*, 23*c* receives the pulse signal form the pulse signal generating circuit 21, and then generates and outputs driving waveforms Va2, Vb2, Vc2, respectively.

The pulse generating circuit 21, for example, receives an input pulse with a logic level, and then uses two pulses whose phases are shifted by 120° each other to generate and output a pulse signal with an output voltage level of about 10V to 15V. This generated pulse signal is able to drive a switching means (e.g., a transistor circuit), included in the waveform amplifying circuits 22*a*, 22*b*, 22*c*, to perform a switching up to 100V.

Figure 11:
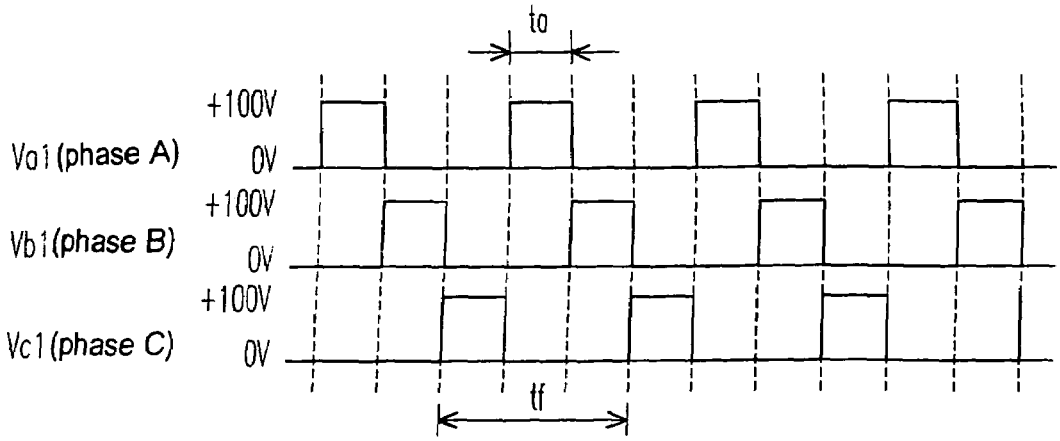
FIG. 11 shows an exemplary driving waveforms of the transporting voltage pattern and the recycling and transporting voltage pattern.

As shown in FIG. 11, the waveform amplifying circuits 22*a*, 22*b*, 22*c* apply the three-phase driving waveforms (driving pulses) Va1, Vb1, Vc1 to the electrodes 102 corresponding to the transporting region 11 and the recycling regions 13, in such a manner that the positive voltage 100V of each phase is repeatedly applied to the electrodes 102 for an applying interval ta, which is about one-third of the period tf, i.e., ta is about 33% of the period tf. This is a so called transporting voltage pattern, or a recycling-transporting voltage pattern.

Figure 12:
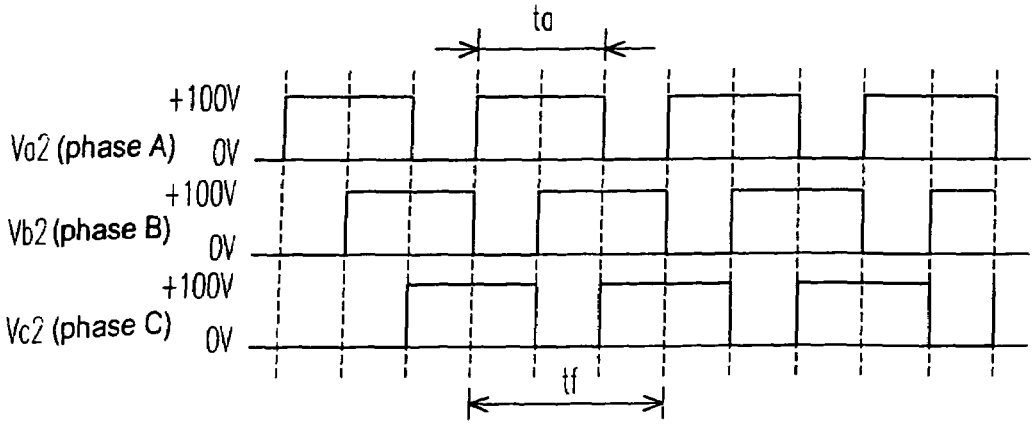
FIG. 12 shows an exemplary driving waveforms of the hopping voltage pattern.
Figure 13:
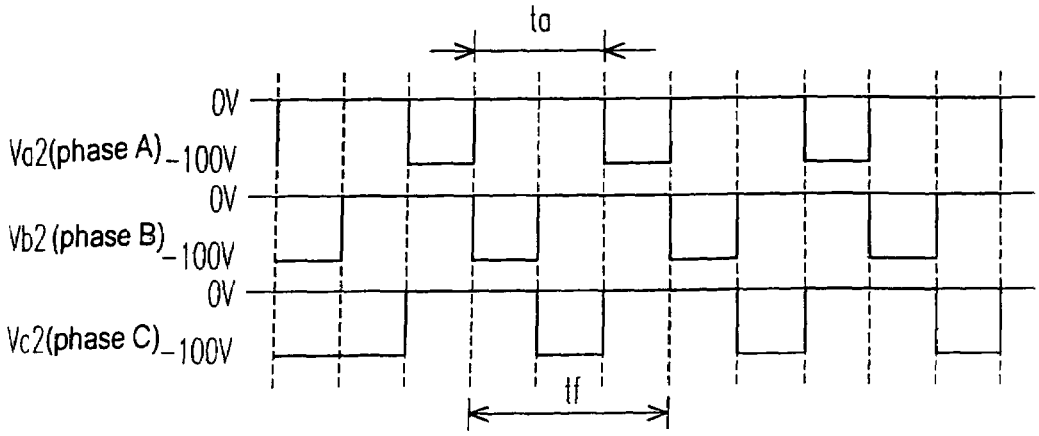
FIG. 13 is another example of a driving waveform of the hopping voltage pattern.

As shown in FIG. 12 or 13, the waveform amplifying circuits 23*a*, 23*b*, 23*c* apply the three-phase driving waveforms (driving pulses) Va2, Vb2, Vc2 to the electrodes 102 corresponding to the developing region 12, in such a manner that the positive voltage 100V of each phase is repeatedly applied to the electrodes 102 for an applying interval ta, which is about two-third of the period tf, i.e., ta is about 67% of the period tf. This is a so called hopping voltage pattern.

An ETH (electrostatic transporting and hopping) Odeveloping principle by using the transporting substrate 1 is described as follows. The ETH development utilizes an electrostatic transportation of the toner to progressively and actively send the toner towards a latent image supporting body, rather than utilizes a smoke or a cloud phenomenon of the toner (both of which are naturally created during the electrostatic transportation) to develop the latent image.

The ETH phenomenon does not occur by only using the conventional electrostatic transporting substrate 1, but will be observed due to setting a relationship among an electrode width, an electrode gap and driving waveforms, which will be described in following contents. First, a basic principle of a hopping phenomenon, included in the ETH phenomenon, is described based on a result from a simulation performed by using a two-dimensional difference method according to an experiment.

Figure 14:
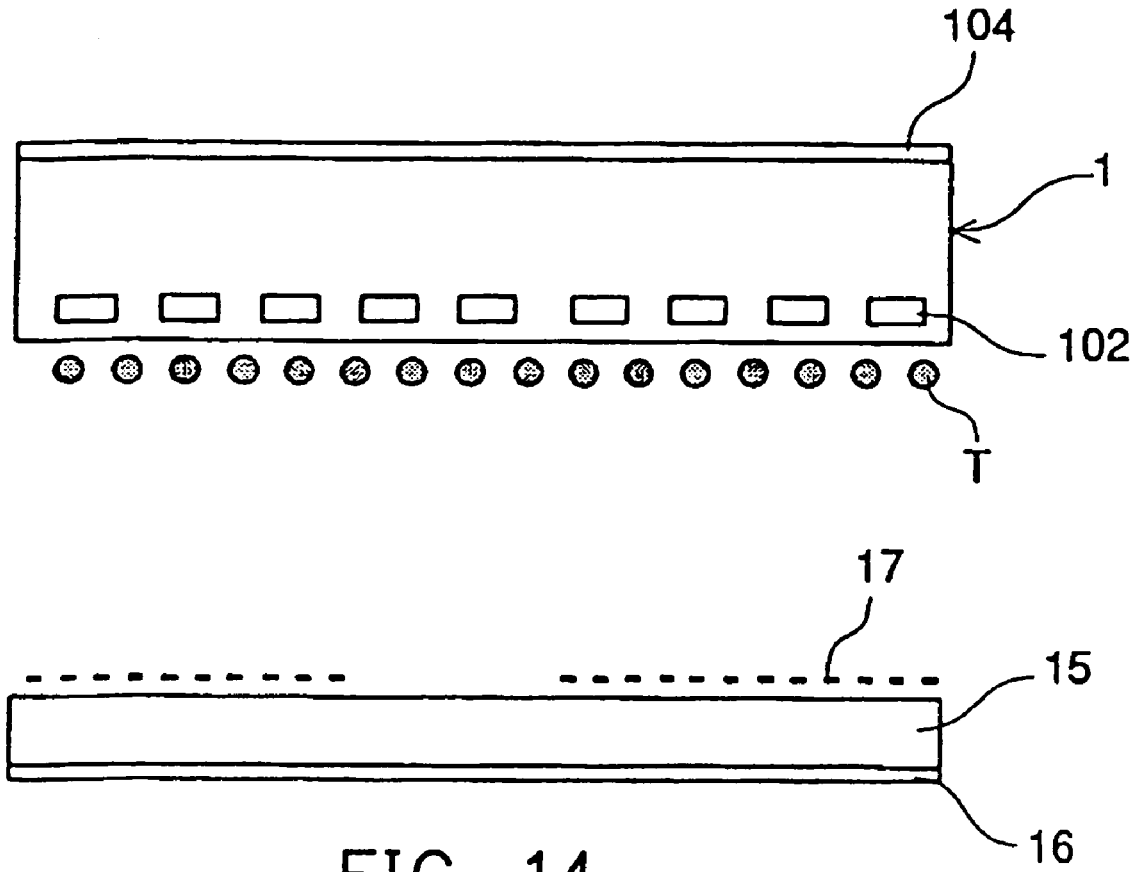
FIG. 14 is a diagram for a simulation region for describing the hopping principle.

An object region for this simulation is shown in FIG. 14. For convenience, the up direction is a direction of the gravity in the drawing. A conductive substrate 104 is arranged opposite to the electrodes 102 on the transporting substrate 1, and is usually grounded. In addition, an OPC layer 15, used as the photosensor drum 10, is arranged opposite to the transporting substrate 1. A conductive substrate 16 is arranged on the OPC layer 15, and is usually grounded. An electrostatic latent image 17 is laid on the OPC layer 15. In addition, because a reverse development is performed by using the negatively charged toner, there are no charges on an image portion of the electrostatic latent image 17, and charges exist only on an non-image portion of the electrostatic latent image 17.

Figure 15:
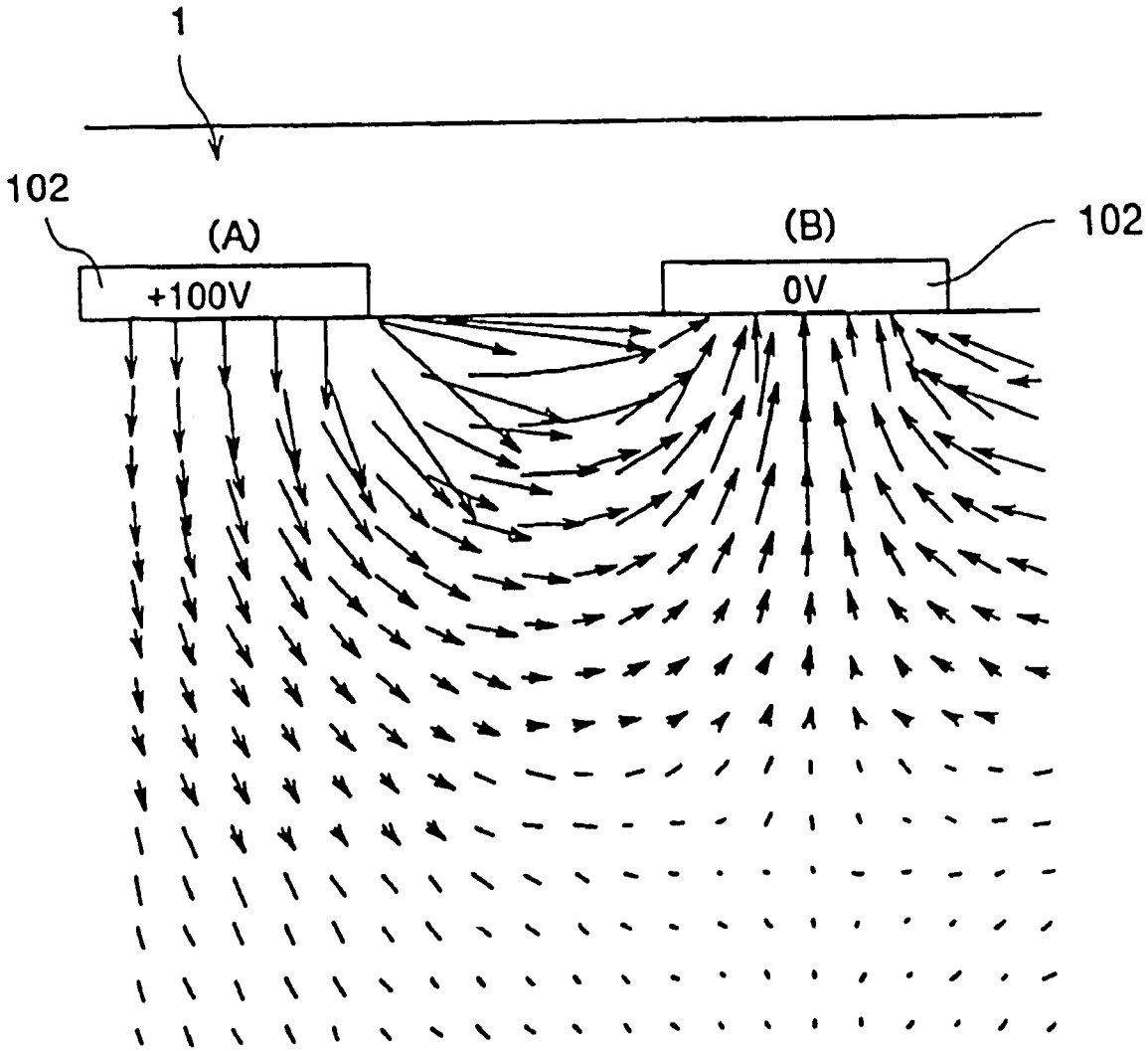
FIG. 15 shows vectors of an electric field in the vicinity of the electrodes.

A gap between the electrodes 102 on the transporting substrate 1 and the OPC layer is set 200 μm, an average diameter of the toner T is 8 μm, an average charge amount Q/m is −20 μC/g, a charge density on the OPC layer 15 is $-3.0\times10^{-4}$ (c/m$^2$). When the entire OPC layer 15 is charged by this charge density, the surface potential of the OPC layer 15 is −169V. One hundred and forty (140) toner is uniformly arranged in two layers with a simulation width 700 μm.

under the above condition, in a case that the charge density of the OPC layer 15 is "0", when voltages +100V, 0V, +100V are respectively applied to three electrodes A, B, C that are adjacently arranged on the transporting substrate 1, vectors of an electric field in the vicinity of the electrode B is as shown in FIG. 15.

In FIG. 15, an electric field near the electrode C is omitted because it is symmetric to an electric field near the electrode A with respect to the electrode B. In addition, the toner is omitted, too. The lower side of the two electrodes 102, 102 is a space facing the OPC layer 15 (the OPC layer 15 is not shown in FIG. 15.) Furthermore, although not shown in the drawing, the potential near the electrode A at the left side is about +100V, the potential near the electrode B at the left side is about 0V, and the potential at a space away from the electrodes A, B is about +50V. In FIG. 15, each arrow represents a vector of the electric field where the arrow is located, the direction indicated by the arrow is a direction of the electric field, and the length of the arrow represents the strength of the electric field.

As could be understood from FIG. 15, from the center of the electrode B where +100V is applied thereon to a space under (above, actually) the electrode B, the vectors of the electric field is vertically upwards. As a result, at this time, an electrostatic force in the direct downward direction acts on the negatively charged toner carried on the center of the electrode B, and the toner is accelerated downwards (upwards, actually). After the toner departures from the transporting substrate 1, the toner falls (rises, actually) straightly according to the direction of the vector the electric field.

Figure 16:
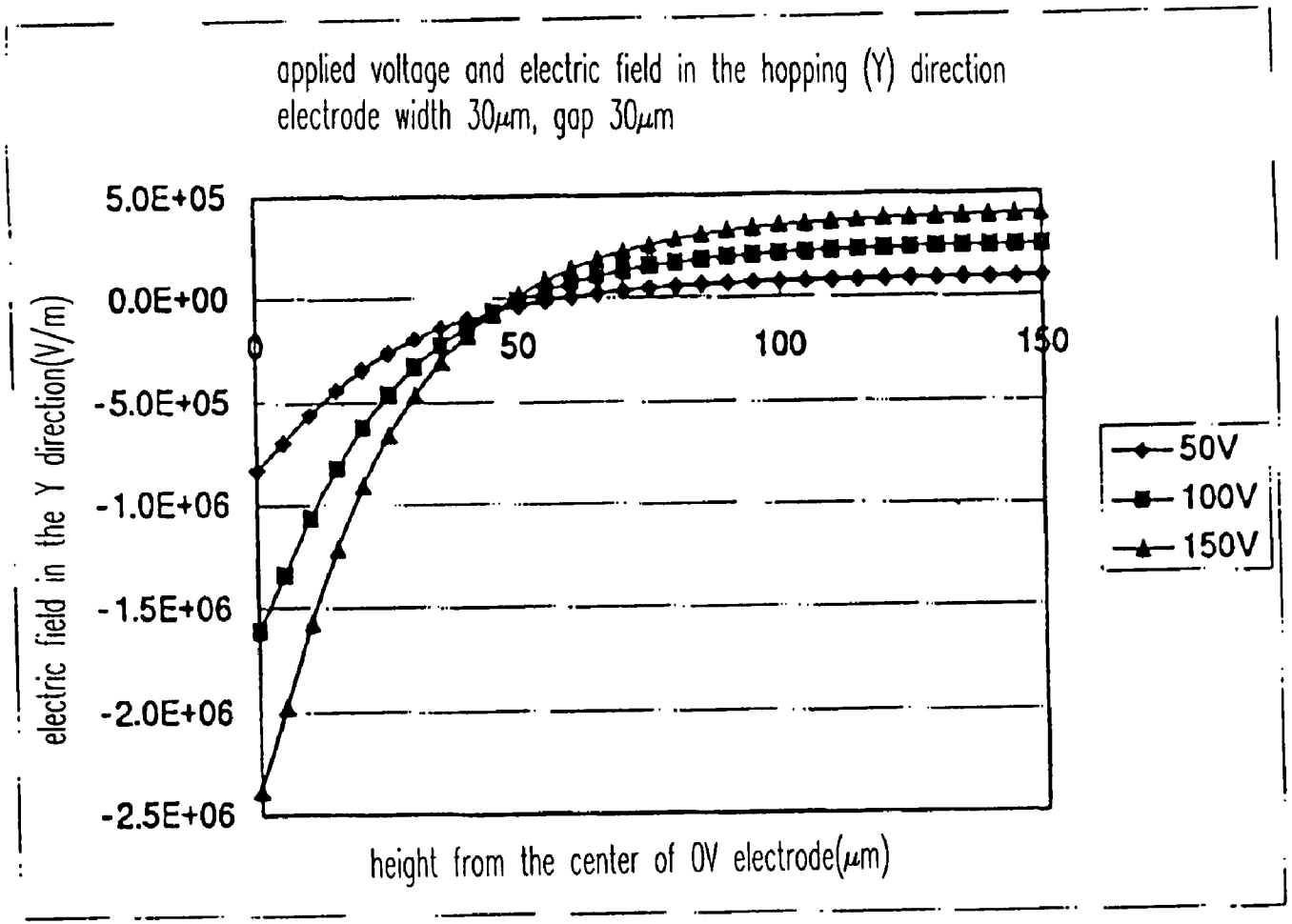
FIG. 16 shows an exemplary of the relationship among the applied voltage, the electric field in the hopping direction, and the height from the center of the 0V electrode.

When voltages 50V, 100V and 150V are applied to the electrodes A, C, an example of an electric field in the Y direction in a space from the center of the electrode B to its direct lower side (actually, the upper side) is shown in FIG. 16.

From FIG. 16, at a position 50 μm lower (actually, upper) than the electrode B, because the magnitude of the vector of the electric field is almost 0, the toner, which has been accelerated to this position, is then decelerated around this position due to a viscosity resistance of the air. Because the direction of the electric field is reverse, the toner is thus subject to a reverse electrostatic force and will lose its downward (upward, actually) speed.

Figure 17:
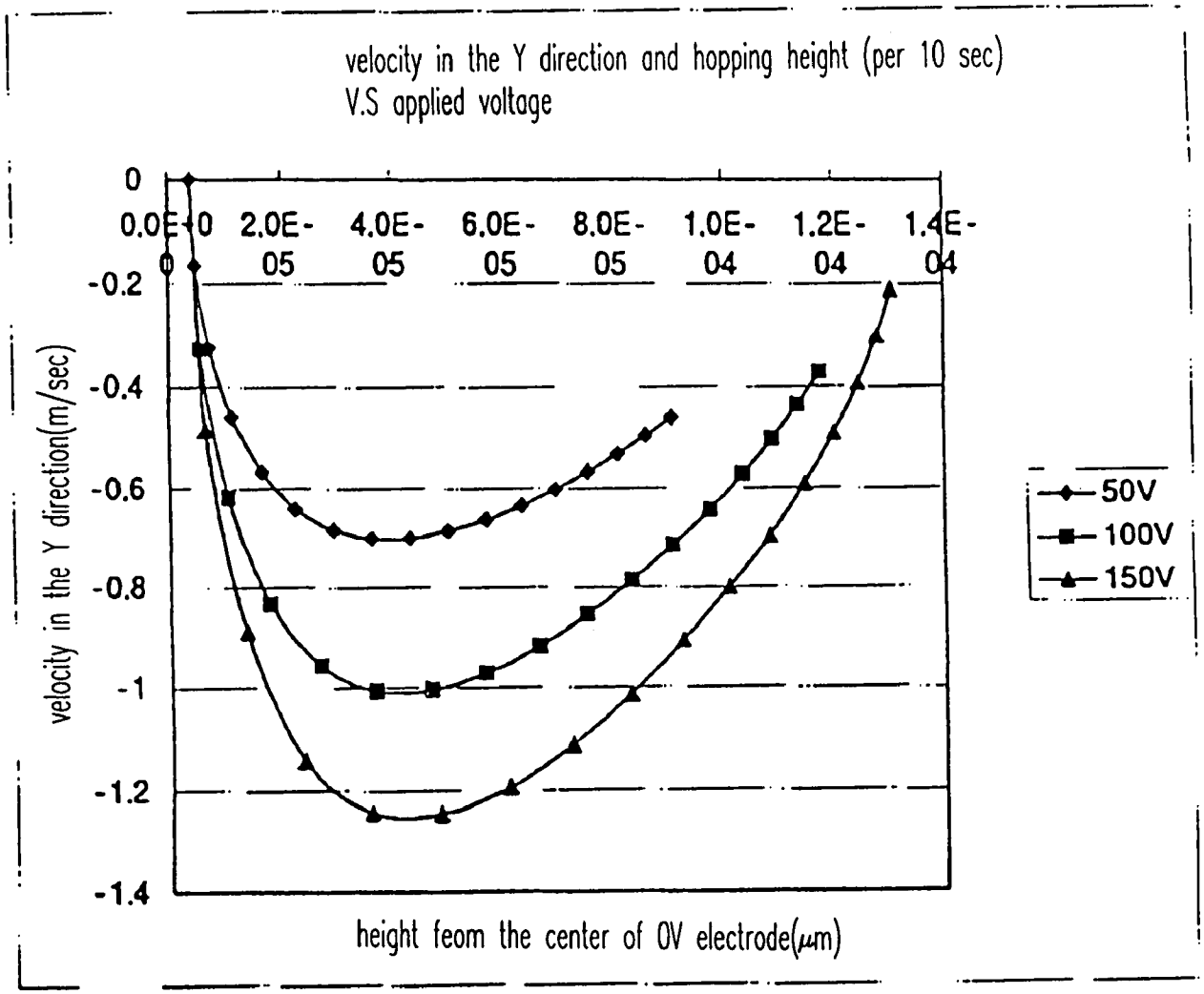
FIG. 17 shows an exemplary of the relationship of the speed in the Y direction and the hopping height with respect to the applied voltage.

When a toner with a diameter of 8 μm and a specific charge amount Q/m=−20 μC/g is laid on the center of the electrode B and the electrodes A, C are applied with voltages 50V, 100V and then 150V, a simulation result, showing the toner's position and speed in the Y direction per 10 μsec up to 160 μsec, is depicted in FIG. 17. In addition, the electrode width is 30 μm and the electrode gap is 30 μm.

As could be learned from FIG. 17, when a voltage +100V is applied to the two adjacent electrodes A, C of the electrode B, the toner laid on the electrode B reaches a position 40 to 50 μm above the electrode B after 50 to 60 μsec . At this time, the rising speed becomes 1 m/sec, and then the toner keeps rising while the rising speed slows down.

From the above simulation result, a condition to straightly launch the toner on the electrode is that for a negatively charged toner, the potential of the electrodes at the two sides of the 0V electrode are equal and higher than 0V, and the toner exists on the 0V electrode. For a positively charged toner, the condition is that the potential of the electrodes at the two sides of the 0V electrode are equal and lower than 0V (for example, −100V), and the toner exists on the 0V electrode.

A driving waveform pattern that satisfies the condition most is as shown in FIG. 12 or FIG. 13, i.e., the hopping voltage pattern that the positive voltage 100V or 0V voltage for each phase is repeatedly applied for an applying interval ta, which is about two-third of the period tf, i.e., ta is about 67% of the period tf. In this embodiment, the driving waveforms Va2, Vb2, Vc2 having the hopping voltage pattern are applied to each of the electrodes 102 on the transporting substrate 1 corresponding to the developing region 12.

In contrast, a most suitable pattern of a driving waveform pattern for transporting the toner is shown in FIG. 11; namely, in a case of applying driving waveforms Va (phase A), Vb (phase B), Vc (phase C), a positive voltage 100V for each phase is repeatedly applied for an applying interval ta, which is about one-third of the period tf, i.e., ta is about 33% of the period tf In this embodiment, the driving waveforms Va1, Vb1, Vc1 having the transporting voltage pattern are applied to each of the electrodes 102 on the transporting substrate 1 corresponding to the transporting region 11.

As focusing on a phase-B electrode, at a time that an applied voltage to the phase-B electrode becomes 0V , an applied voltage of a phase-A electrode is 0V and an applied voltage of a phase-C electrode is a positive voltage (+V), the propagation direction of the toner is from A to C. Therefore, the toner is repulsed between the phase-B electrode and the phase-A electrode, and is attracted between the phase-A electrode and the phase-C electrode. As a result, the transportation efficiency increases and particularly, a high-speed transportation for the toner can be performed.

In addition, even though the driving waveforms of the hopping voltage pattern are applied, toner that is not located at the center of the 0V electrode are also subject to a lateral force. Therefore, not all of the toner is launched highly and some toner will move in the horizontal direction. In contrast, even though the driving waveforms of the transporting voltage pattern are applied, according to the toner position, the toner is launched with a large tilt angle and the rising distance is larger than the moving distance in the horizontal direction.

Therefore, the driving waveform pattern applied to each electrode 102 corresponding to the transporting region 11 is not limited to the transporting voltage pattern shown in FIG. 11. In addition, the driving waveform pattern applied to each electrode 102 corresponding to the developing region 12 is also not limited to the hopping voltage pattern shown in FIG. 11 or FIG. 13.

Generally speaking, when n-phase (n≧3) pulse voltages (driving waveforms) are applied to each electrode to generate the traveling-wave electric field, the transporting and hopping efficiencies can be increased by setting a voltage applying duty cycle that the voltage applying time per phase is less than the {repeat period×(n−1)/n}. For example, when a three-phase driving waveform is used, the voltage applying time to for each phase is set less than two-third of the repeat period tf, i.e., 67%. When a four-phase driving waveform is used, the voltage applying time to for each phase is set less than three-fourth of the repeat period tf, i.e., 75%.

On the other hand, the voltage applying duty cycle is preferably set not less than {repeat period/n}. For example, when a three-phase driving waveform is used, the voltage applying time to for each phase is set less than one-third of the repeat period tf, i.e., 33%.

Namely, among a voltage applied to a noted (observed) electrode, a voltage applied to its adjacent electrode at the upstream side in the propagation direction, and a voltage applied to its adjacent electrode at the downstream side, by setting a time that the adjacent electrode at the upstream side repulses the toner and a time that the adjacent electrode at the downstream side attracts the toner, the efficiency can be improved. In particular, when the driving frequency is high, an initial speed for a toner on a noted (observed) electrode can be easily obtained by setting the voltage applying time per phase is not less than {repeat period/n} and less than the {repeat period×(n−1)/n}, i.e., tf×(n−1)/n<_to <tf×(n−1)/n.

Next, a charge pattern for the reverse development is formed on the OPC layer 15. FIG. 18 and its subsequent drawings show an example for a movement of a toner T that varies with time, when the driving waveforms Va2, Vb2, Vc2 of the hopping voltage pattern shown in FIG. 13 are applied to each electrode 102.

Referring to FIG. 18, the latent image 17 on the OPC layer 15 comprises an image portion 17*a* that contain no charge for the reverse development and a non-image portion (background) 17*b* that contains charges. Because a portion of the reverse development without charges is the image portion, the negative charges also exit at the outside of the non-image (background) portion 17*b*, but are omitted in the drawings (following drawings are the same). In addition, the surface potential of the OPC layer 15 is about −150V and the surface potential of the image portion 17*a* within the latent image 17 is about 0V . Furthermore, the voltage values of the hopping voltage pattern, which are applied to the electrodes 102, are "−100V " and "0V " as shown in FIG. 13.

Figure 19:
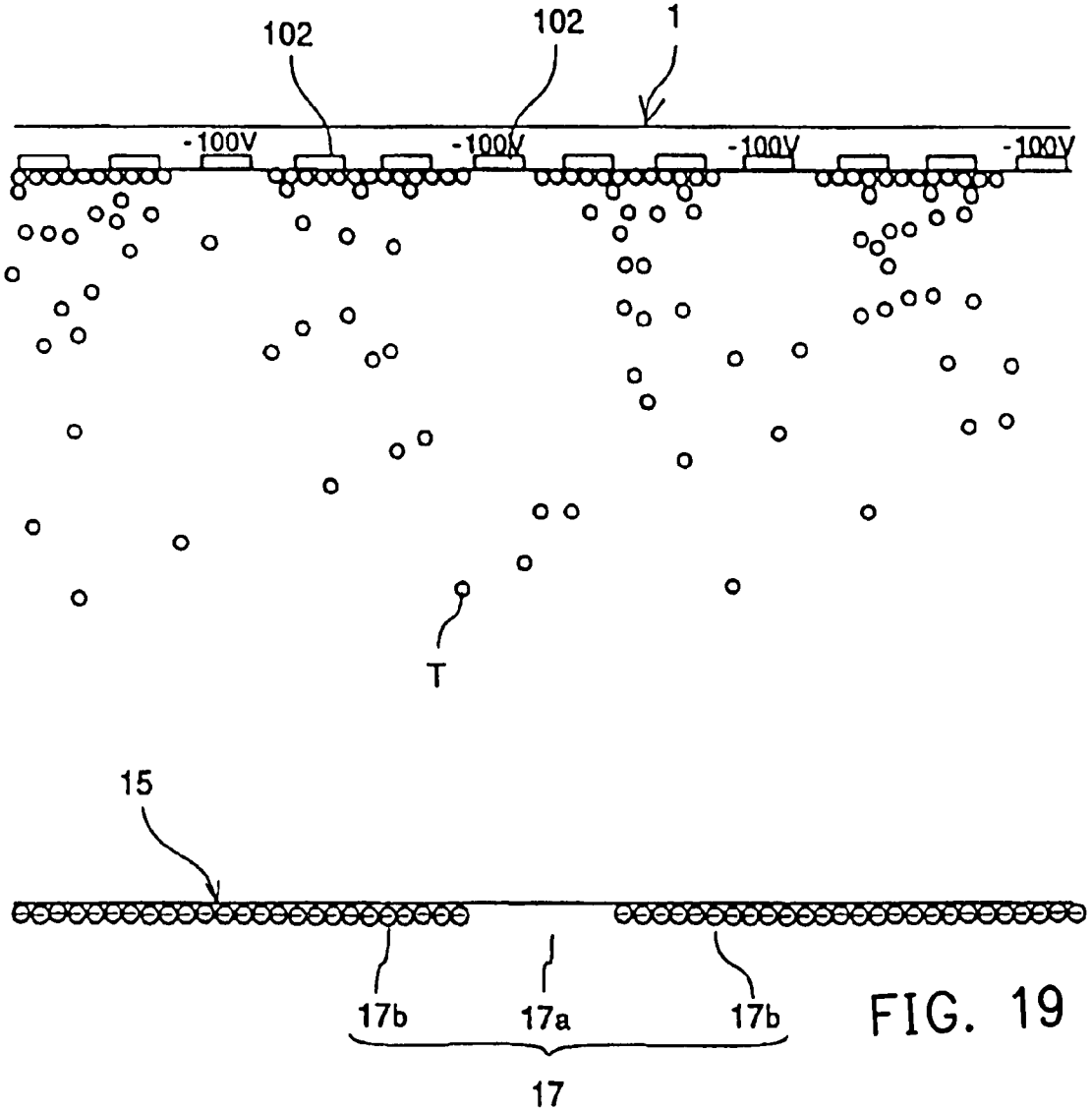
FIG. 19 shows a toner distribution after 100 μsec.

First, FIG. 18 shows an initial status at 0 μsec, in which the toner is located on the transporting substrate 1. >From this status, FIG. 19 and its subsequent drawings show status when the hopping voltage pattern is applied. FIG. 19 shows a toner distribution form the beginning of applying the hopping voltage pattern to a timing that 100 μsec has lapsed. As comparing the toner distribution in FIG. 19 with FIG. 18, the toner located on the electrode with −I00V (the phase-B electrode) 102 flies upwards (downwards in the drawings) or fly rightwards or leftwards.

Figure 20:
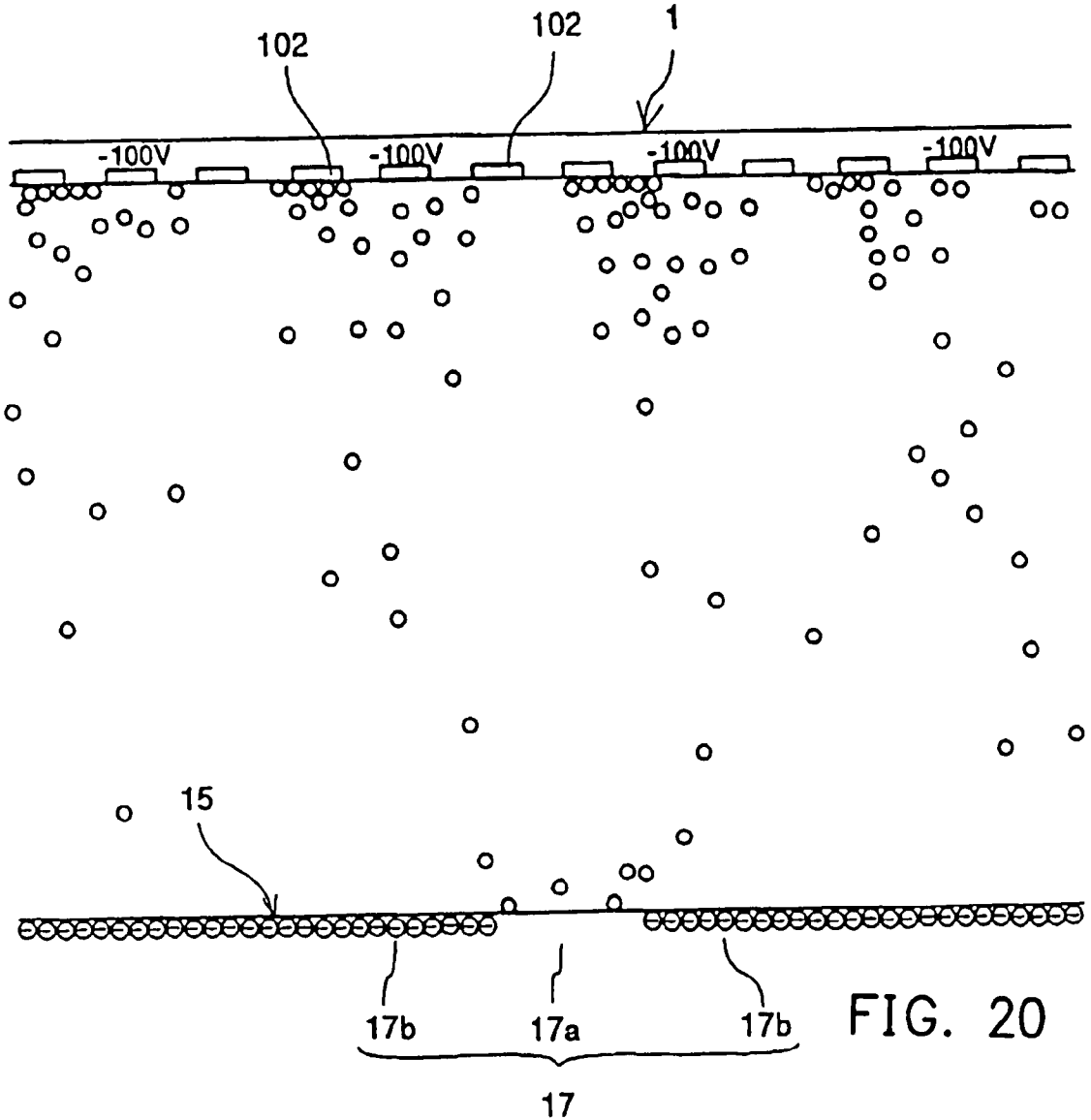
FIG. 20 shows a toner distribution after 200 μsec.

FIG. 20 shows a toner distribution after 200 μsec . In FIG. 20, the toner is adhered onto the image portion 17*a* whose potential is 0V , i.e, the portion of the latent image 17 on the OPC layer 15 that contains no charges, and thereafter, the reverse development starts. On the other hand, the toner will not reach the background portion 17*b* with a potential of about −150V, i.e, and contains charges. In addition, as compared with FIG. 19, the position of the electrodes with −100V move to the next adjacent electrodes respectively, and then toner is further launched.

Figure 21:
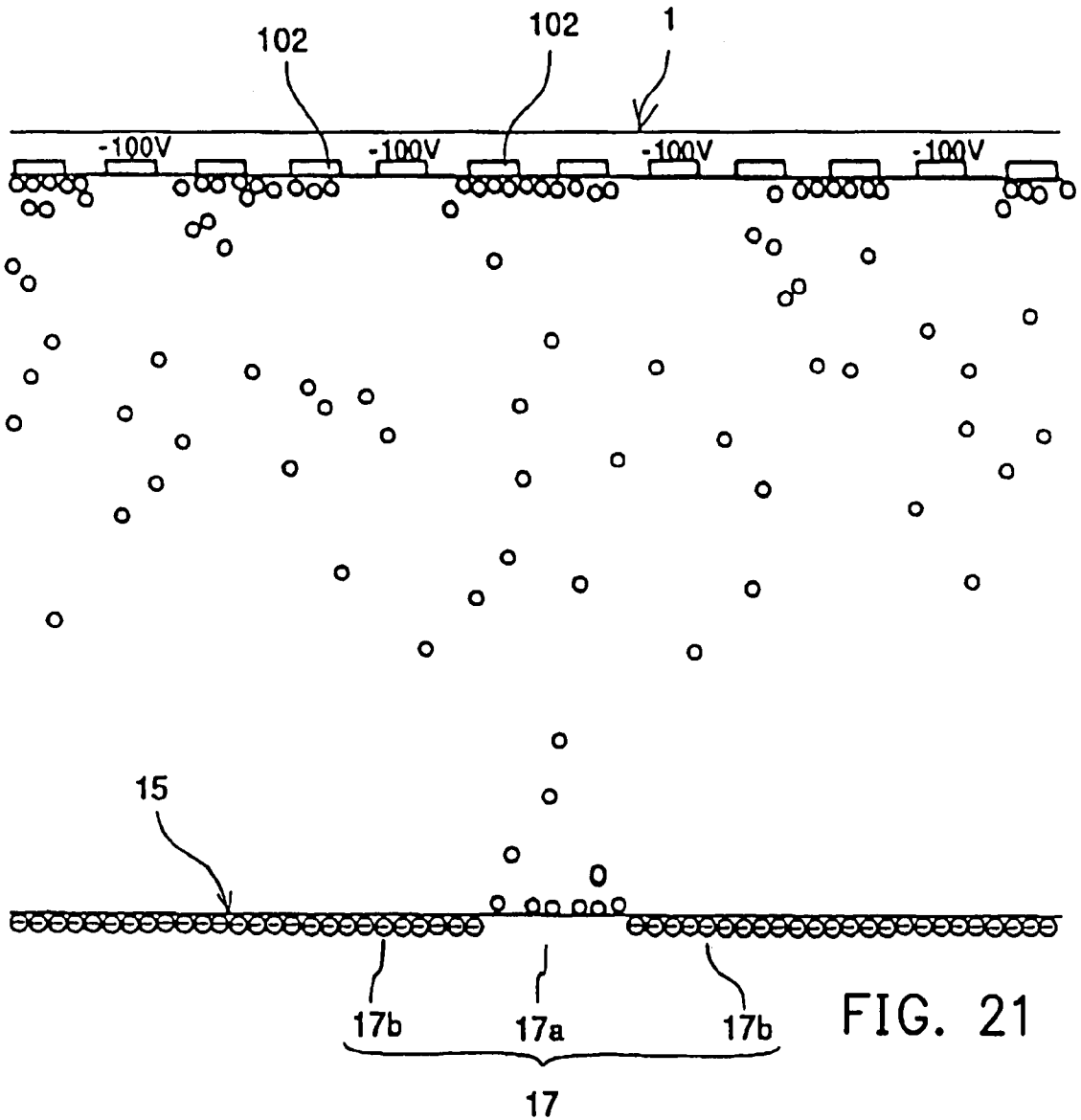
FIG. 21 shows a toner distribution after 300 μsec.

FIG. 21 shows a toner distribution after 300 μsec. In FIG. 21, the number of the toner, which is adhered onto the image portion 17*a* whose potential is 0V , i.e, the portion of the latent image 17 on the OPC layer 15 that contains no charges, increases more than that shown in FIG. 20. Therefore, the development is in process. Pn the other hand, at the background portion 17*b*, the toner that is initially launched return to the transporting substrate 1 by a reverse electric field generated between the OPC layer 15 and the transporting substrate 1.

Figure 22:
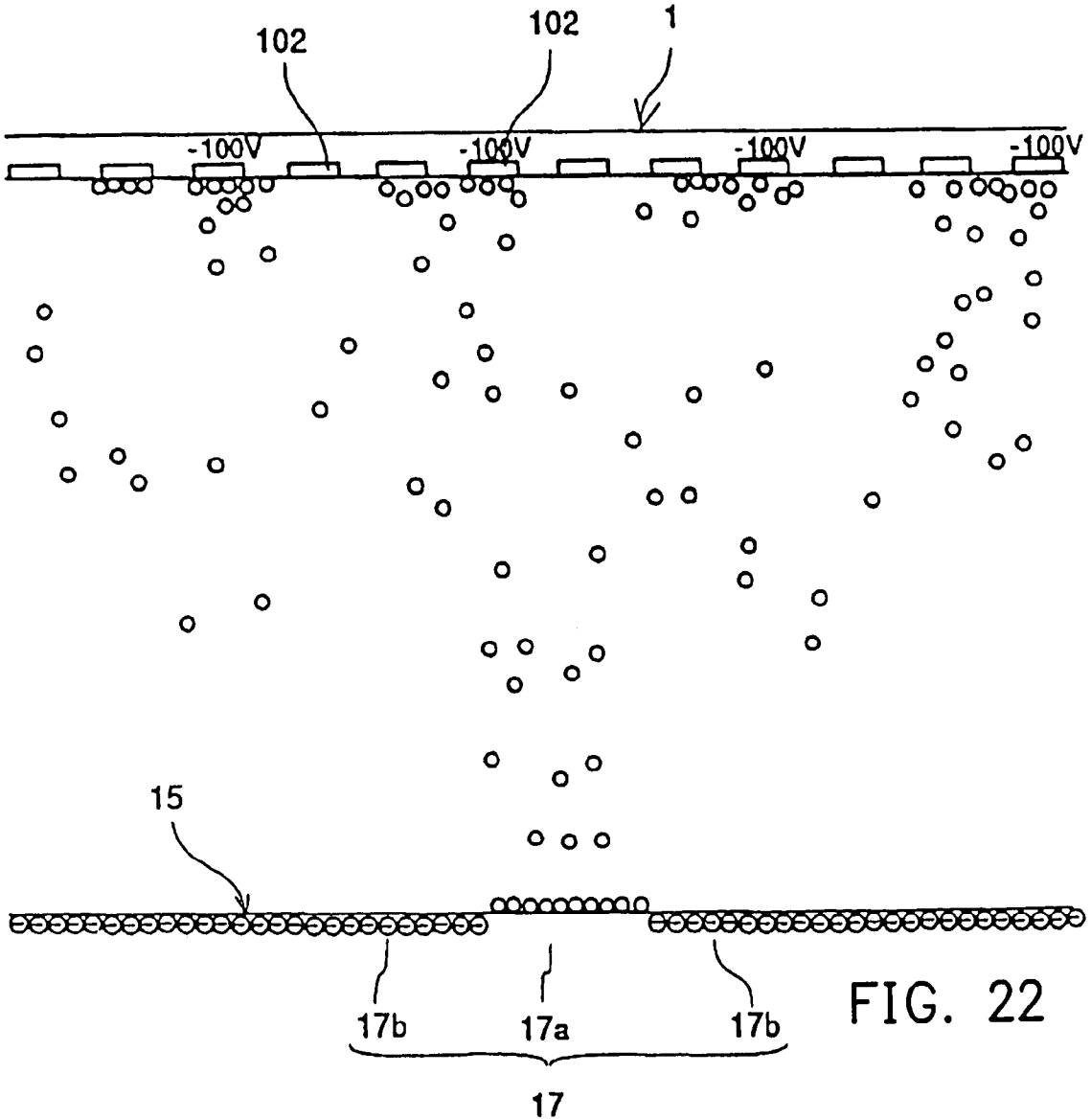
FIG. 22 shows a toner distribution after 500 μsec.

FIG. 22 shows a toner distribution after 500 μsec . In FIG. 22, the development is further processed. The toner is almost not adhered onto the background portion 17*b*.

Figure 23:
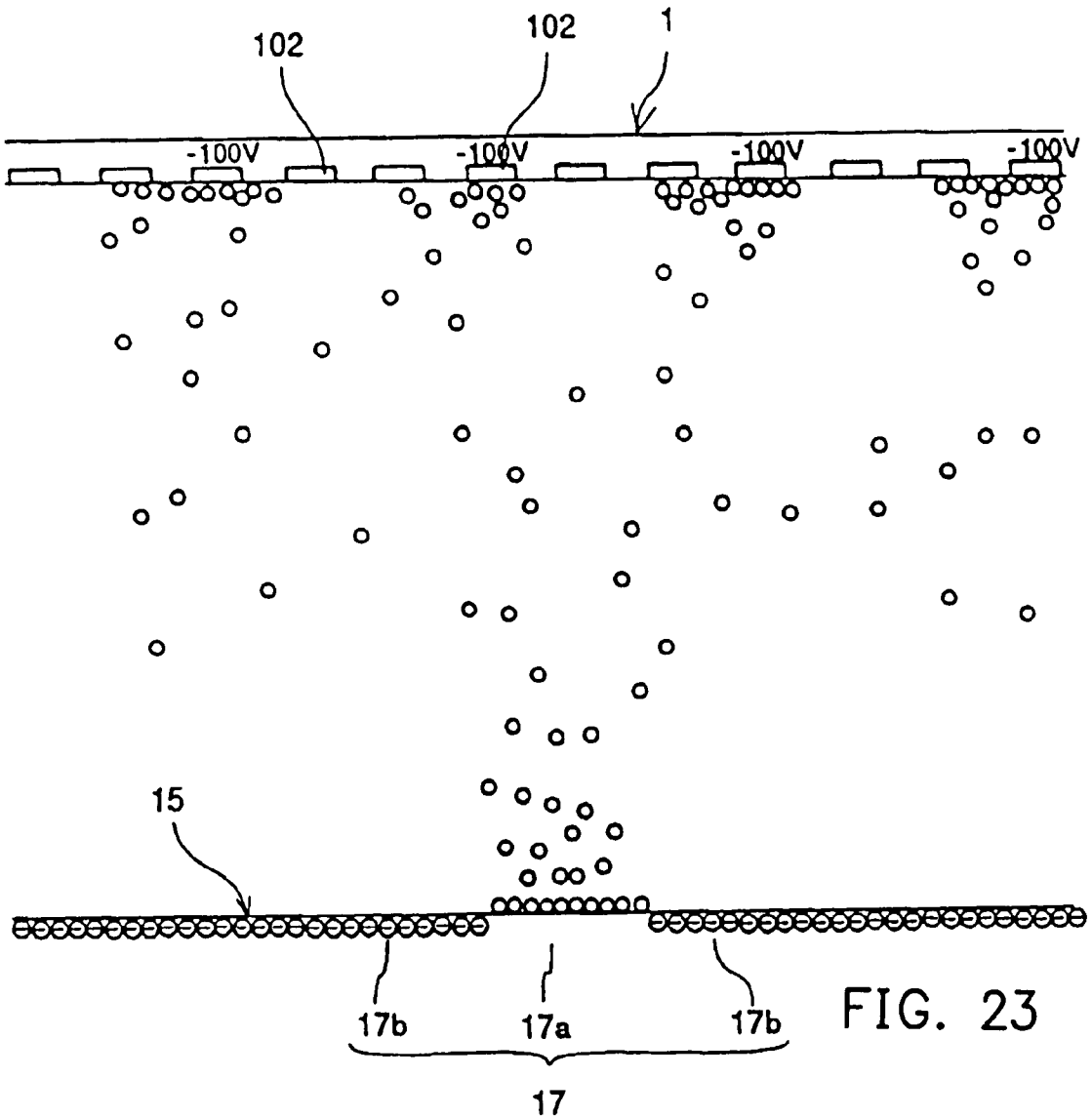
FIG. 23 shows a toner distribution after 1000 μsec.

FIG. 23 shows a toner distribution after 1000 μsec. As compared with FIG. 23, the development is further processed, but their difference is small.

Figure 24:
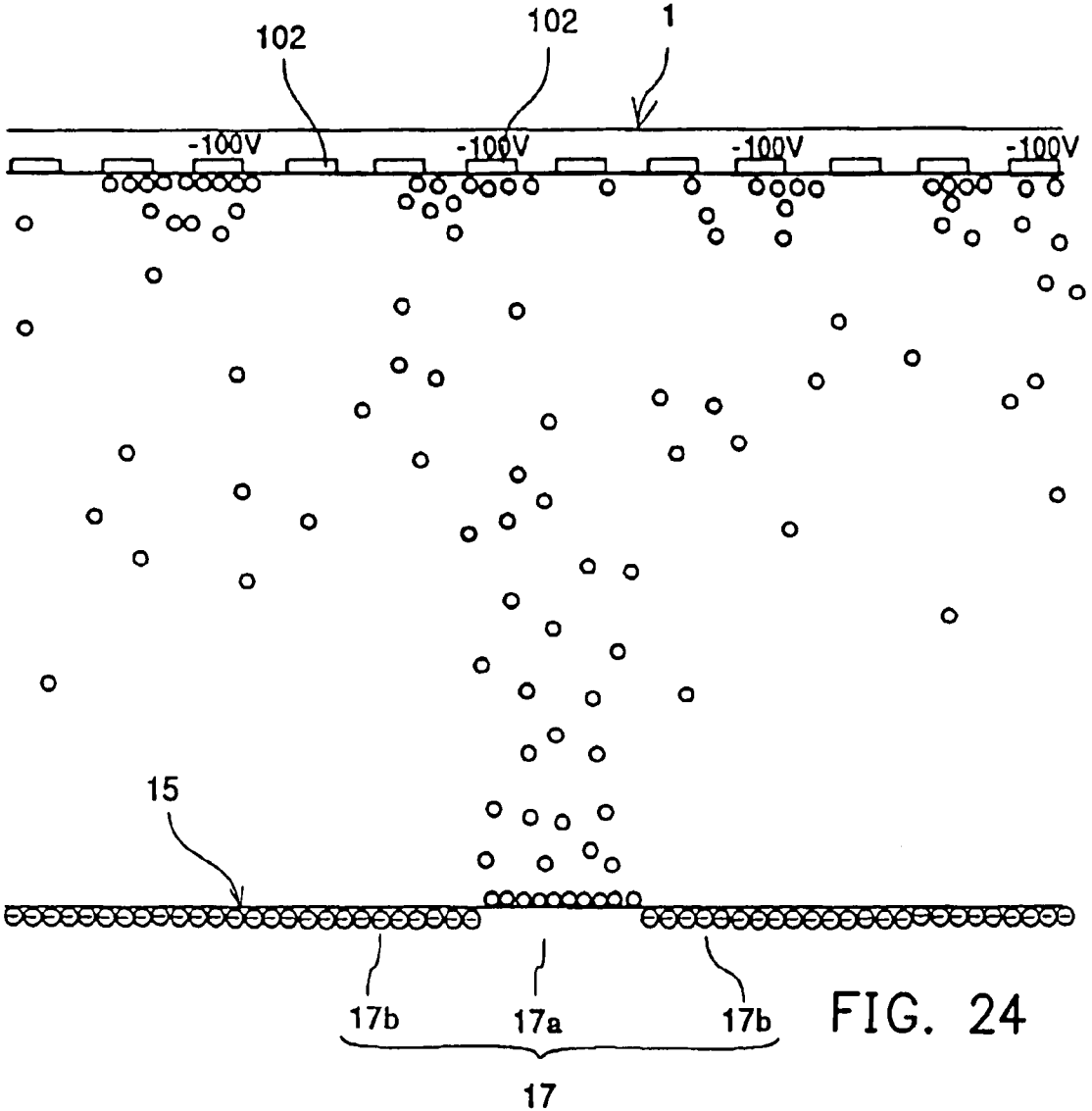
FIG. 24 shows a toner distribution after 1500 μsec.

FIG. 24 shows a toner distribution after 1500 μsec. As compared with FIG. 23, both of the toner numbers adhered onto the image portion 17*a* is the same. The development does not process between FIG. 23 and FIG. 24; namely, development is almost saturated after 1 msec.

Figure 25:
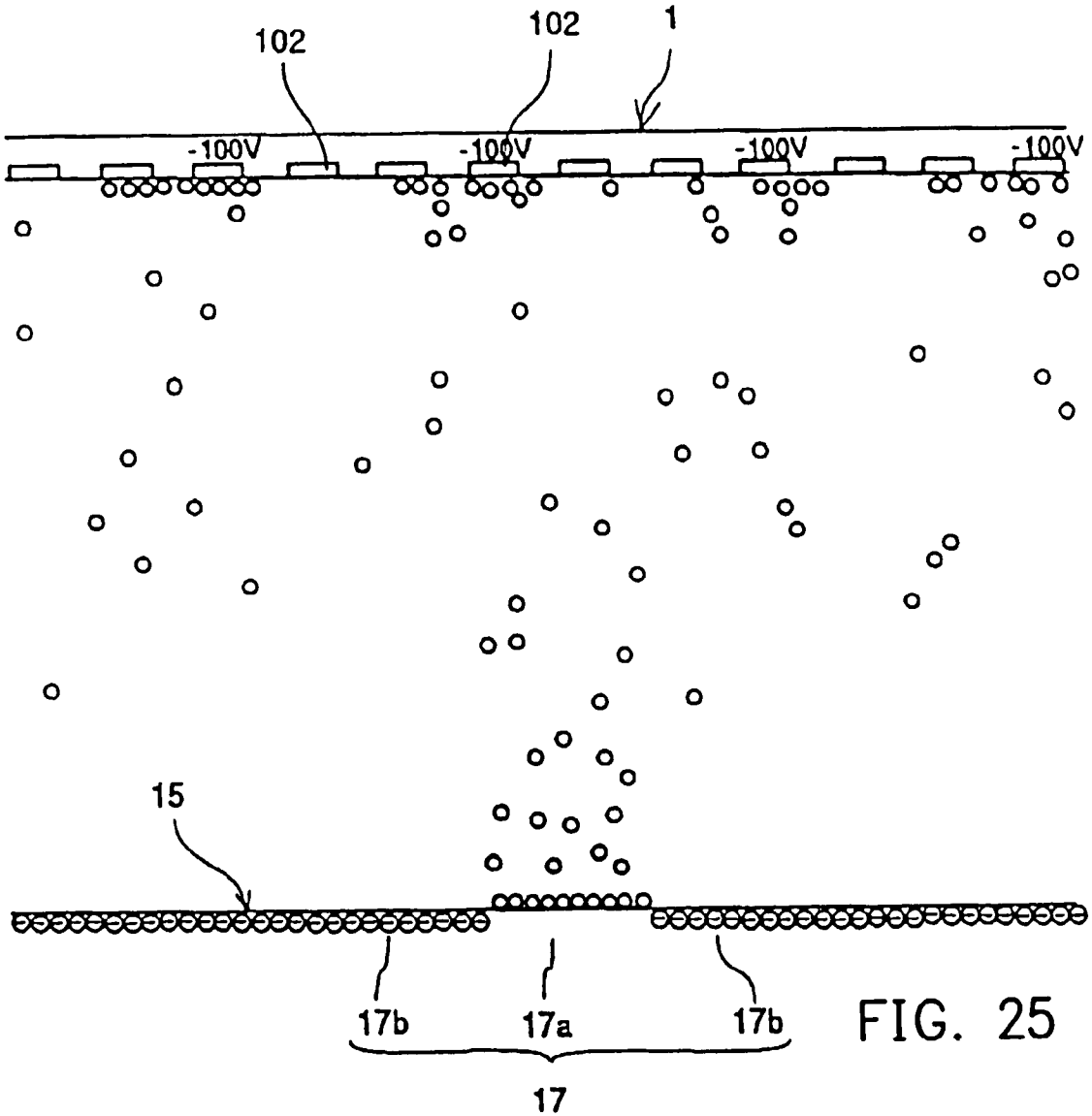
FIG. 25 shows a toner distribution after 2000 μsec.

FIG. 25 shows a toner distribution after 20000 μsec. As compared with FIG. 24, the development does not process between FIG. 24 and FIG. 25.

As described above, the ETH phenomenon can carry out a reverse development against the electrostatic latent image on the latent image supporter in one-component developing manner by hopping the toner. Namely, at the developing region, the development can be performed by preparing means for generating an electric field in a direction either that the toner moves towards the latent image supporter at the image portion of the latent image or that the toner moves in a direction opposite to the latent image supporter at the non-image portion.

For example, in a case that the driving waveforms of the hopping voltage pattern shown in FIG. 13 are pulse voltage waveforms that vary from 0V to −100V, when the potential of the non-image portion on the latent image supporter is lower than −100V, the toner moves towards the latent image supporter at the image portion of the latent image, while the toner moves in a direction opposite to the latent image supporter at the non-image portion. In this case, if the potential of the non-image portion of the latent image is −150V or −170V (described below), it could be confirmed that the toner moves towards the latent image supporter.

In addition, in a case that the driving waveforms of the hopping voltage pattern are pulse voltage waveforms that vary from 20V to −80V, when the potential of the image portion is about 0V and the potential of the non-image portion is −110V, the low level potential of the pulse driving waveform is between the potential of the image portion of the latent image and the potential of the non-image portion, so that the toner moves towards the latent image supporter at the image portion, while the toner moves in a direction opposite to the latent image supporter at the non-image portion.

In short, by setting the low level potential of the pulse driving waveform between the potential of the image portion of the latent image and the potential of the non-image portion, the toner can be prevented from adhering onto the non-image portion, so that a high quality development can be performed.

As described, in the ETH phenomenon, the toner is adhered onto the image portion of the latent image by hopping the toner, while the toner is repulsed at the non-image portion so as not to adhere onto the non-image portion. Therefore, the latent image can be developed by the toner. At this time, because an adhesion force is not generated between the toner and the transporting substrate 1, the toner that has hopped can be easily transported to the latent image supporter, so that a development for obtaining a high image quality can be performed with a low voltage.

Namely, in the conventional jumping development, in order to separate the charged toner from the developing roller to transport the charged toner to the photosensor, it requires to apply a voltage above an adhesion force between the toner and the developing roller. A bias voltage of DC 600V to DC 900 V is necessary. In contrast, according to the present invention, the adhesion force of the toner is 50 nM to 200 nN usually, but the adhesion force between the toner and the transporting substrate 1 (used for hopping toner at the transporting substrate) is almost 0. Therefore, a force for separating the toner from the transporting substrate 1 is not required, and the toner can be transported to the latent image supporter side with a sufficiently low voltage.

Moreover, even though the voltage applied between the electrodes 102 is a low voltage not greater than |150 to 100|V, the generated electric field is still very large. Therefore, the toner adhered on the surface of the electrode 102 can be easily separated, flown, and hopped. In addition, when the photosensor (e.g., the OPC layer 15) is electrified, only a very few amount of or none of ozone and NOx is generated, it is very advantageous in the environment issue and the durability of the photosensor.

Therefore, it is not necessary to apply a high voltage bias (500V to several thousands volts), like the conventional manner, between the developing roller and the photosensor in order to separate the toner adhered on the surface of the developing roller or the carrier surface. The charging potential of the photosensor can be set to a very low value to form the latent image and then to develop the latent image.

For example, in a case that the OPC photosensor is used wherein a thickness of a charge transport layer (CTL) of the photosensor surface is 15 μm, a specific dielectric constant $\epsilon$ is 3, a charge density of the charged toner is $-3\times10^{-4}C/m^2$, the surface potential of the OPC layer is about −170V. But, in this case, when a pulse driving voltage with a voltage of 0V to −100V and with a 50% duty cycle, as an applying voltage, is applied to the electrodes on the transporting substrate 1, the average potential is −50V. If the toner is negatively charged, the electric field between the transporting substrate and the OPC photosensor has a relationship as described above.

At this time, if a gap between the transporting substrate 1 and the OPC photosensor is 0.2 m to 0.3 m, the development can be performed sufficiently. Differences exist due to the applying voltage to the electrodes on the transporting substrate 1, the Q/M ratio of the toner and the printing speed, i.e., the rotational speed of the photosensor, but, in a case of the negatively charged toner, even though the potential for charging the photosensor is less than −300V, or less than −100V (if considering the developing efficiency priorly), the development can be performed sufficiently. In addition, when the toner is positively charged, the charging potential is a positive potential.

The aforementioned ETH phenomenon utilizes hopping the toner on the transporting substrate 1 to perform the development by making an adhesion force between the transporting substrate 1 and the toner. But, according to the research of the inventors, only hopping the toner on the transporting substrate 1, the hopped toner still has a mobility to move towards the latent image supporter. Therefore, the toner cannot be securely adhered onto the latent image of the latent image supporter, and the toner will be scattered.

After a detail research on the ETH phenomenon, the inventors find a condition that the hopped toner can be actually and selectively adhered onto the image portion of the latent image on the latent image supporter without being adhered onto the non-image portion; namely, a condition that the contamination will not occur.

Namely, the relationship between the potential (the surface potential) of the latent image on the latent image supporter and the potential applied to the transporting substrate 1 (for generating an electric field) is set to a predetermined relationship. In other words, as described above, an electric field is generated in which the toner moves towards to the latent image supporter at the image portion of the latent image on the latent image supporter and moves in a direction opposite to the latent image supporter at the non-image portion. In this way, the toner can be actually adhered onto the image portion of the latent image. Because the toner moving towards the non-image portion will be forced to return to the transporting substrate 1, the toner hopped from the transporting substrate 1 can be efficiently used in the development, so that the toner scattering can be avoided and a high quality development can be driven by a low voltage.

In this case, by setting the average value of the potential applied to the electrodes on the transporting substrate 1 to a potential between the potential of the image portion of the latent image on the latent image supporter and the potential of the non-image portion, as described, an electric field can be generated in such a way that the toner moves towards to the latent image supporter at the image portion of the latent image on the latent image supporter and moves in a direction opposite to the latent image supporter at the non-image portion.

According to the research result obtained by the inventors, because the toner is not adhered onto the non-image portion (the background portion), the background contamination does not occur.

Namely, the inventors make the aforementioned transporting substrate, toner with the same diameter and the same amount of charge is used. After a photosensor drum with an OPC layer of a thickness of 15 μm is charged to have a surface potential of −170V, a latent image is formed thereon by a laser beam optical system. The transporting substrate is fixed by separating 0.200 mm from the photosensor drum that rotates with a peripheral speed of 200 mm/sec. The transporting voltage pattern is applied to the transporting substrate, and then the toner is transported on the transporting substrate with a speed equal to the peripheral speed of the photosensor drum. Furthermore, the transporting voltage pattern is switched to the hopping voltage pattern that is applied to electrodes at the developing region, at which the transporting substrate and the photosensor drum has a minimum width of 0.4 mm. Then, a reverse development is performed to the latent image. The toner image formed on the OPC photosensor drum is then transferred and fixed on a white paper by any known method to form a black toner image.

As a result, contamination occurs on the background portion of the formed image. In addition, after the printing test is repeatedly performed, the toner is adhered within the printer. When observing the movement of the toner at the developing region by using a high-speed camera, toner, which has no contribution to the development (not adhered to the photosensor) and do not return to the transporting substrate, will be engaged into an air stream that is created around the photosensor accompanying with the rotation of the photosensor.

In addition, it could be understood that the toner scattering increases at the image portion than the background portion. Furthermore, it could be understood that if the charging potential of the OPC layer increases, the toner scattering decreases. In addition, in the conventional developing method, when the amount of charge of the toner decreases, the toner scattering increases. However, in the ETH developing, in contrast, it could be understood that as the charge amount of the toner decreases, the toner scattering can decrease.

As shown in FIG. 23 to FIG. 25, a very strong air stream occurs accompanied with the rotation of the photosensor drum, it could be understood that toner, which is floating right above (below) the image portion, are scattered.

The reason that the subsequent toner stays above the image portion is that the toner in the air has no power to move.

Because an electric field for attracting the negatively charged toner to the image portion is formed in the vicinity of the image portion, the electric field disappears or becomes weak, so that the subsequently reached toner will not be attracted. As described above, the charge density of the OPC layer is $-3.0\times10^{-4}$C/mm$^2$. However, as the toner that is charged to −20 μC/g are collected up to 1.5 mg with one centimeter square (1 cm$^2$), the charge density of the toner is also $-3.0\times10^{-4}$C/mm$^2$.

In fact, even though in the saturation phenomenon, toner of 1.5 mg does not carried within one square centimeter (1 cm$^2$). But, as the toner occupies the half of the region, a potential difference between the background portion and the image portion is half reduced and the electric field also decreases half, so that the toner begins to stay. This is a case that the charge distribution is uniform, but if considering a Coulomb repulsive force between the toner, one subsequent toner is repulsed by a plurality of toner that moves in advance, and cannot move to the latent image supporter.

In other examples of the present invention, means for generating an electric field for drawing toner at a region after the developing region back to the transporting substrate 1 is further equipped. Namely, in the first embodiment, as described above, the recycling region 13 is arranged on the transporting substrate 1, and the driving waveforms Va1, Vb1, Vc1 of the recycling and transporting voltage pattern are applied from the driving circuit 2 to the electrodes 102 corresponding to the recycling region 13. On the other words, the driving waveforms of the transporting voltage pattern applied to the electrodes 102 corresponding to the transporting region 11 are directly applied to the electrodes 102 corresponding to the recycling region 13, and used as the driving waveforms of the recycling and transporting voltage pattern.

As described, by forming the electric field in a direction where the toner moves in a direction opposite to the image latent supporter at a region after the developing region, the floating toner can be recycled back to the transporting substrate 1. As a result, the toner can be reused.

Regarding this point, it will be further described in detail. As described with reference to FIG. 18 and its subsequent drawings, the charge pattern for the reverse development is carried on the OPC layer 15, the driving waveforms Vat, Vb2, Vc2 of the hopping voltage pattern shown in FIG. 13 are applied to each electrode 102 to perform the development. Then, the driving waveforms Va1, Vb1, Vc1 of the recycling and transporting voltage pattern shown in FIG. 11 are applied to each electrode 102. At this time, the movement of the toner is described by referring to FIG. 26 and its subsequent drawings.

Figure 26:
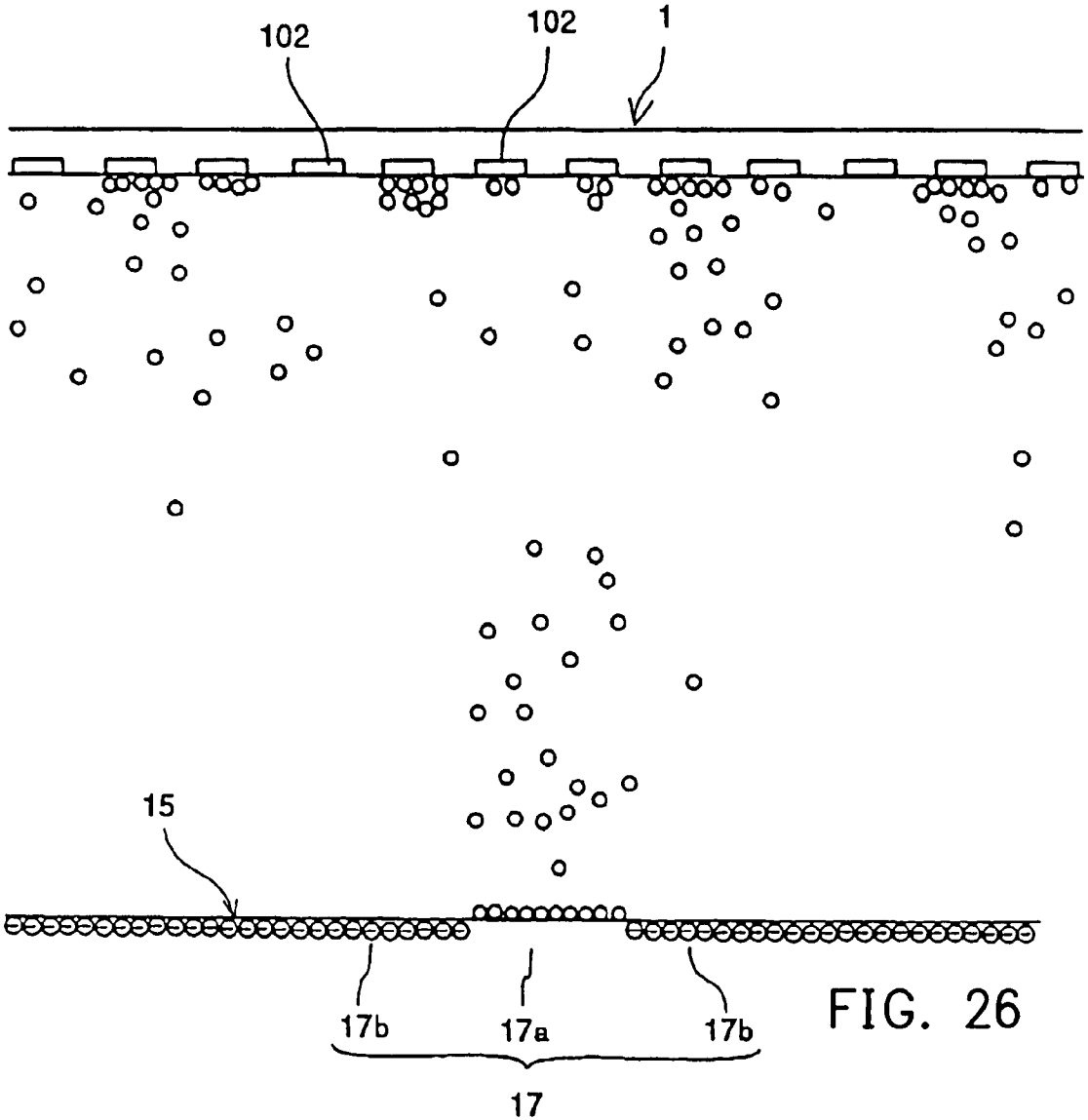
FIG. 26 shows a toner distribution that 100 μsec has lapsed after the development is finished and the driving waveforms of the recycling and transporting voltage pattern are applied.

First, FIG. 26 shows a toner distribution when 100 μsec has lapsed after the voltages applied to each electrode 102 are switched to the driving waveforms Va1, Vb1, Vc1. As compared with FIG. 23, the toner floating above (actually, below) the image portion 17*a* begins to be drawn to the transporting substrate 1. In addition, not only the above image portion 17*a*, but also toner floating in the air above the transporting substrate 1 corresponding to the background portion 17*b* can begin to be drawn to the transporting substrate 1.

Figure 27:
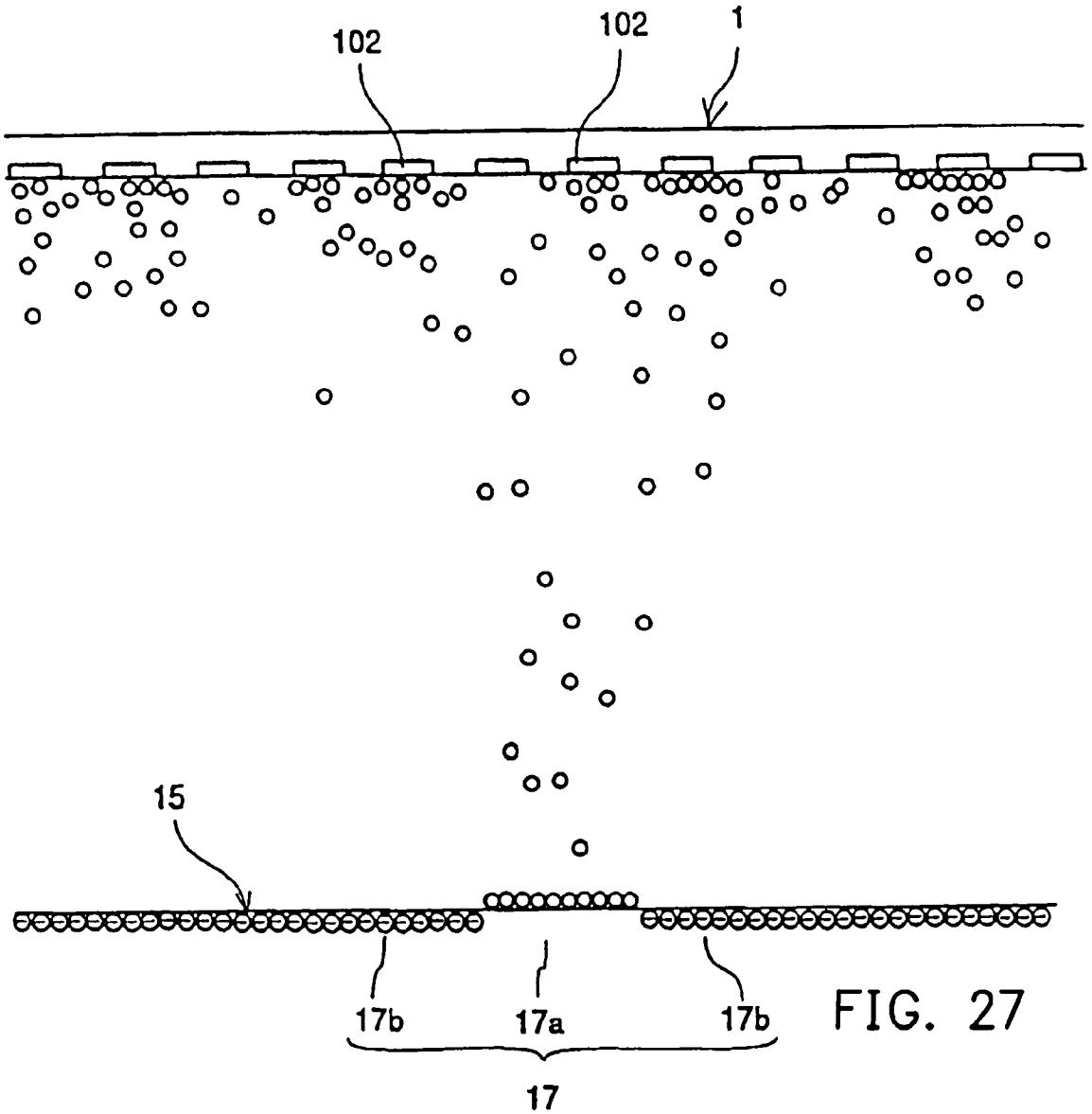
FIG. 27 shows a toner distribution after 200 μsec from FIG. 26.

FIG. 27 shows a toner distribution where 200 μsec has lapsed after switching the driving waveforms. As compared with FIG. 26, the toner at the image portion 17*a* and the background portion 17*b* is further drawn to the transporting substrate 1.

Figure 28:
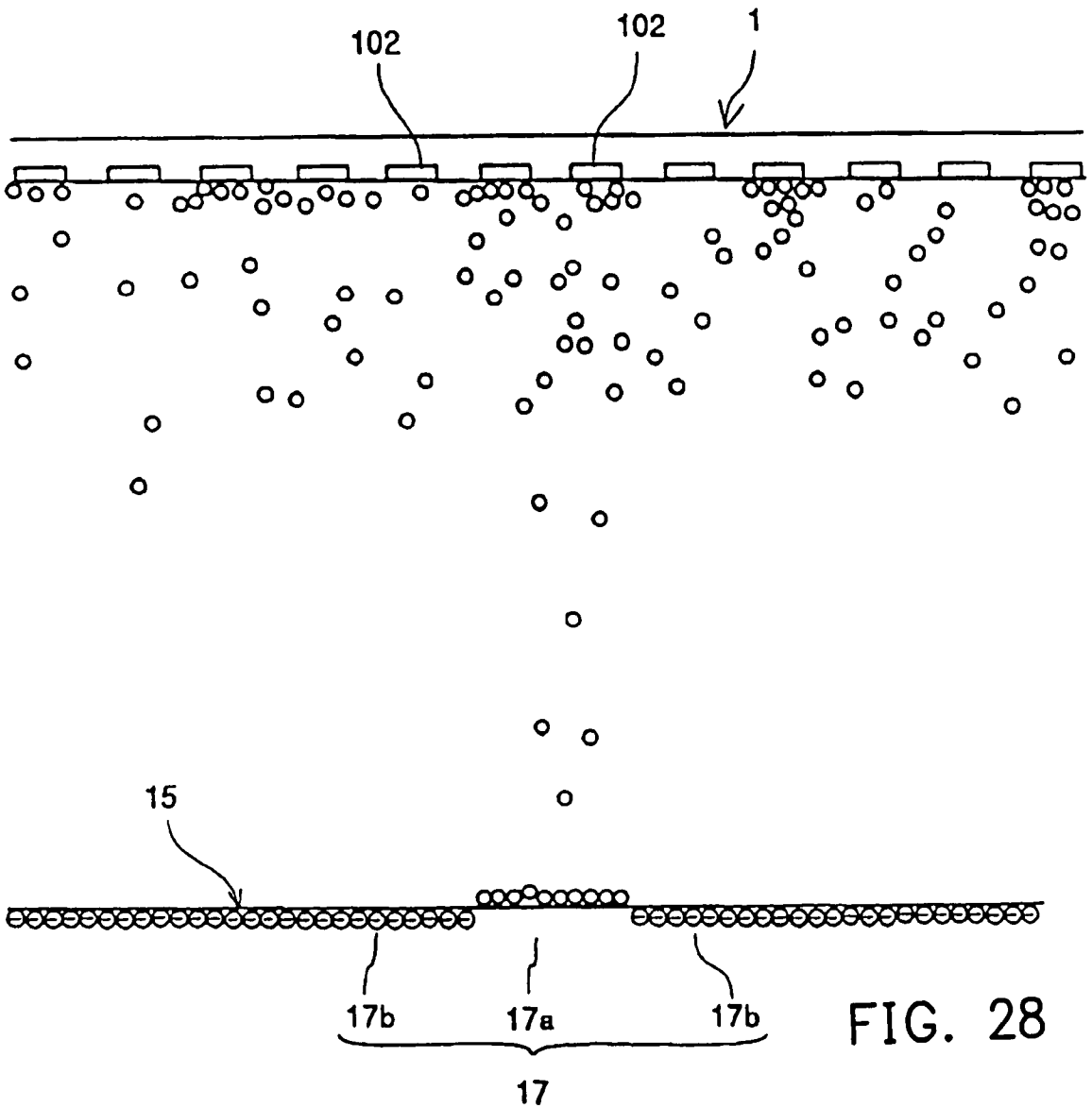
FIG. 28 shows a toner distribution after 300 μsec from FIG. 26.

FIG. 28 shows a toner distribution where 400 μsec has lapsed after switching the driving waveforms. Floating toner corresponding to the image portion 17*a* is further recycled back to the transporting substrate 1. However, a portion corresponding to the backgrounds portion 17*b* swells slightly because there is newly launched toner.

Figure 29:
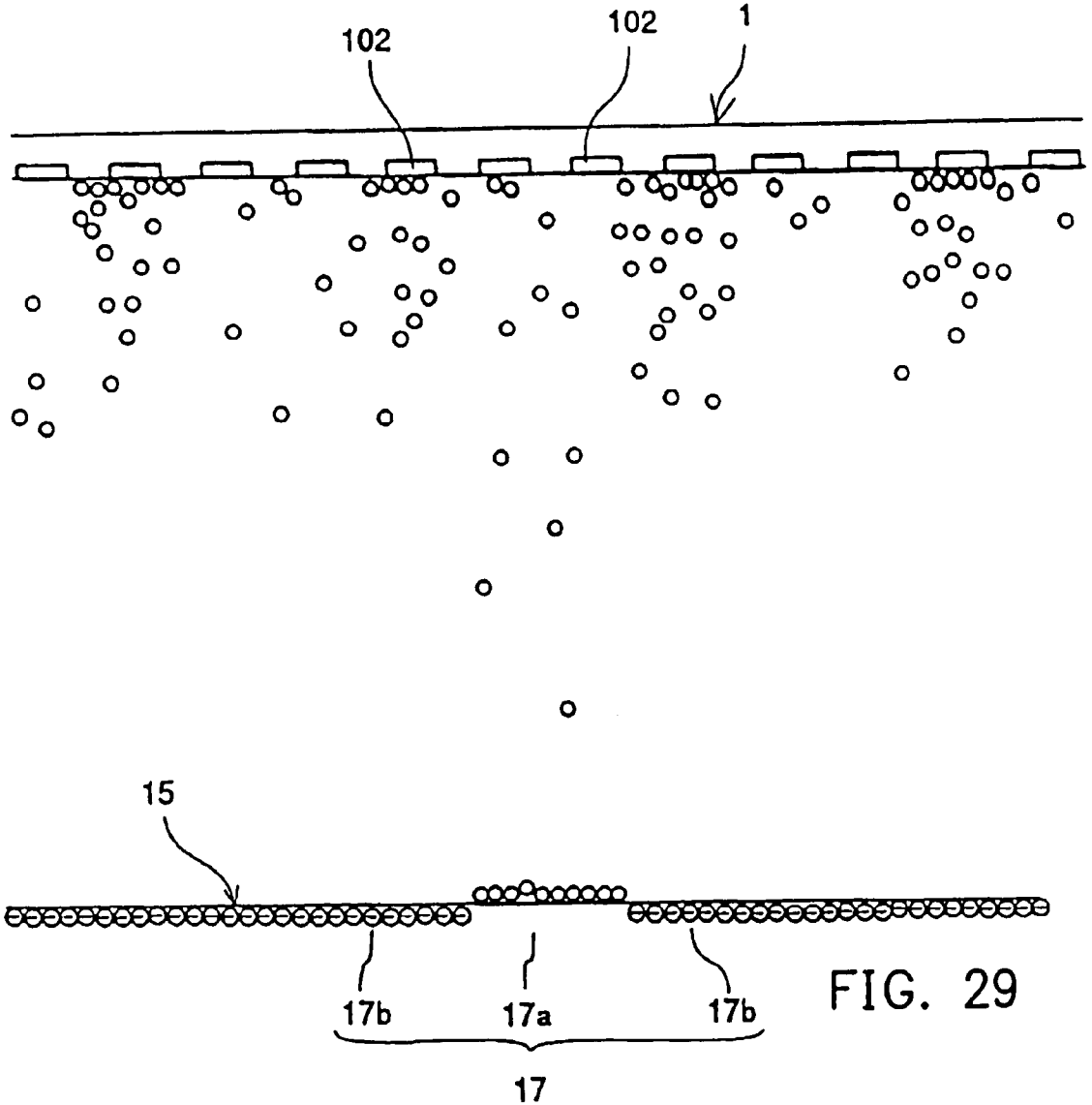
FIG. 29 shows a toner distribution after 500 μsec from FIG. 26.

FIG. 29 shows a toner distribution where 700 μsec has lapsed after switching the driving waveforms. Among the floating toner corresponding to the image portion 17*a*, toners located at the most rear position also moves to the midway between the transporting substrate 1 and the OPC layer 15.

FIG. 30 shows a toner distribution where 1000 μsec has lapsed after switching the driving waveforms. The toner located at the most rear position also enter the transporting substrate 1 side, and the floating toner does not exit completely at the OPC layer 15 side.

In this case, the toner adhered on the image portion 17*a* does not return to the transporting substrate 1. The reason is that a strong image force is acted between the charged toner and the OPC layer (a dielectric layer). In addition, no mater whether there exit charges, a van der Waals force and a liquid junction bridging force are also acted between the charged toner and the OPC layer. Furthermore, when the image portion 17*a* is small, an electrostatic force due to an edge electric field is also acted. Because the toner is subject to these forces and then forced to the OPC layer 15 side, the toner does not return to the transporting substrate 1 as the floating toner. In addition, the van der Waals force and the liquid junction bridging force do not act to the floating toner, and additionally, the image force is zero in fact, so that the floating toner will return to the transporting substrate 1.

However, as will be described later, as the potential applied to the electrode of the transporting substrate 1 increases, even the toner adhered on the photosensor drum 10 will be drawn back to the transporting substrate 1. Therefore, the strength of the electric field that is formed after passing the developing region is preferably set within a range so that the toner adhered on the latent image supporter will not be separated from the surface of the latent image supporter. In this case, if the strength of the electric field is not strong enough, all of the toner will not be separated and there might be a situation that the toner with a weak adhesion force is separated.

In addition, in the aforementioned simulation, all of toner above the second layer and the subsequent layers on the image portion 17*a* is recycled back to the transporting substrate 1. But, this is because the attractive force between the toner in the simulation is zero. In fact, because the van der Waals force and the liquid junction bridging force also act between the toner, toner of the second layer also adheres to the toner of the first layer and thus remain on the image portion 17*a*.

In this way, at the region after the developing region, the toner scattering can be significantly avoided from occurring by preparing means for generating an electric field in a direction where the toner moves in a direction opposite to the latent image supporter.

In this case, at the developing region, an average voltage of the voltages applied to the electrodes 102 on the transporting substrate 1 (the transporting member) is set a potential between the potential of the image portion of the latent image and the potential of the non-image portion, and therefore, the ETH development can be performed. When negatively charged toner is used, at the region (the recycling region) after the developing region, the average voltage is set a potential higher than either the potential of the image portion of the latent image or the potential of the non-image portion; when positively charged toner is used, at the region after the developing region, the average voltage is set a potential lower than either the potential of the image portion of the latent image or the potential of the non-image portion. In this way, the floating toner can return back to the transporting substrate 1.

Figure 31:
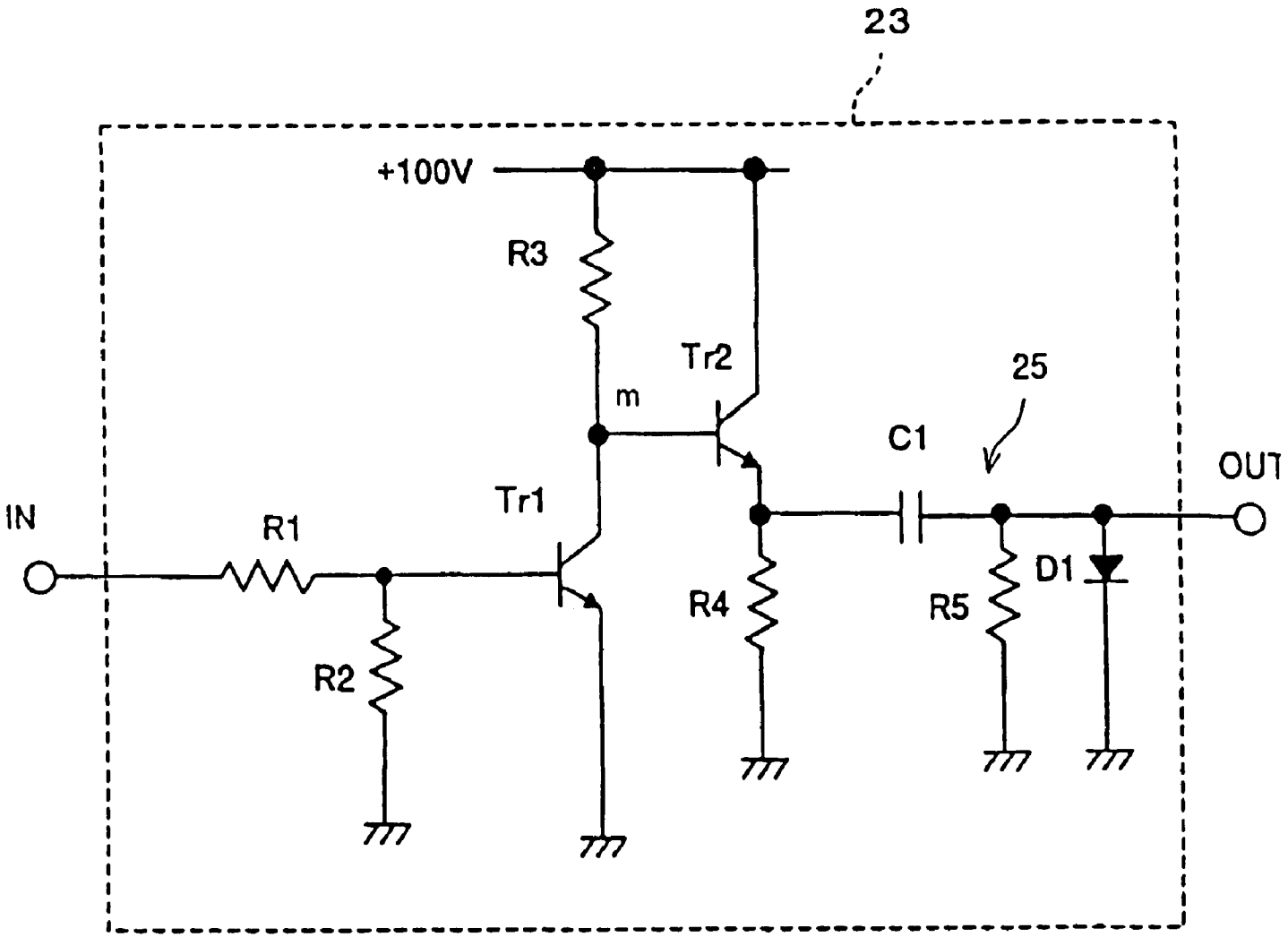
FIG. 31 is an example of a waveform amplifier for the hopping voltage pattern.

FIG. 31 is an exemplary circuit diagram for describing the waveform amplifiers 23*a*, 23*b*, 23*c* (here, referring to 23) that are used to generate driving waveforms of the hopping voltage pattern shown in FIG. 13. In addition, as described above, each phase of the driving waveforms of the hopping voltage pattern shown in FIG. 13 is a pulse waveform of 0V to −100V and has a duty cycle of 67% (time percentage that the potential is relatively positive (i.e., 0V)). But, in this example, a waveform with a duty cycle of 33% (time percentage that the potential is relatively positive (i.e., 0V)) is described.

The waveform amplifier 23 comprises a clamper resistors R1, R2 for dividing a voltage of an input signal, a transistor Tr1 for switching, a collector resistor R3, a transistor Tr2, a current limiting resistor R4, and a clamper circuit 25 including a capacitor C1, a resistor R5 and a diode D1.

As shown in FIG. 32A, an input signal IN is input to the waveform amplifier 23 from the aforementioned pulse signal generating circuit 21, wherein the input signal IN is a pulse waveform with a voltage of 0V and 15V and a duty cycle for the 15V voltage is about 67% of the input signal IN. The input signal IN is divided by the resistors R1, R2, and then the divided input signal is transmitted to the base of the transistor Tr1. The transistor Tr1 is operated to switch to reverse the phase and to boost an output level up to 0V to +100V, so that a collector voltage m shown in FIG. 32B is obtained at the collector of the transistor Tr1.

The transistor Tr2 receives the collector voltage m and outputs a waveform having the same level with a low impedance. In the clamper circuit 25 connected to the emitter of the transistor Tr2, a time constant with respect to the positive waveform is small, and a time constant with respect to the negative waveform is determined by the capacitor C1 and the resistor R5. But, the time constant is set to a very large value with respect to the period of the pulse waveform, by which the clamper circuit 25 can output an output waveform OUT 0V to −100V in which the zero level is clamped, as shown in FIG. 32C.

Figure 33:
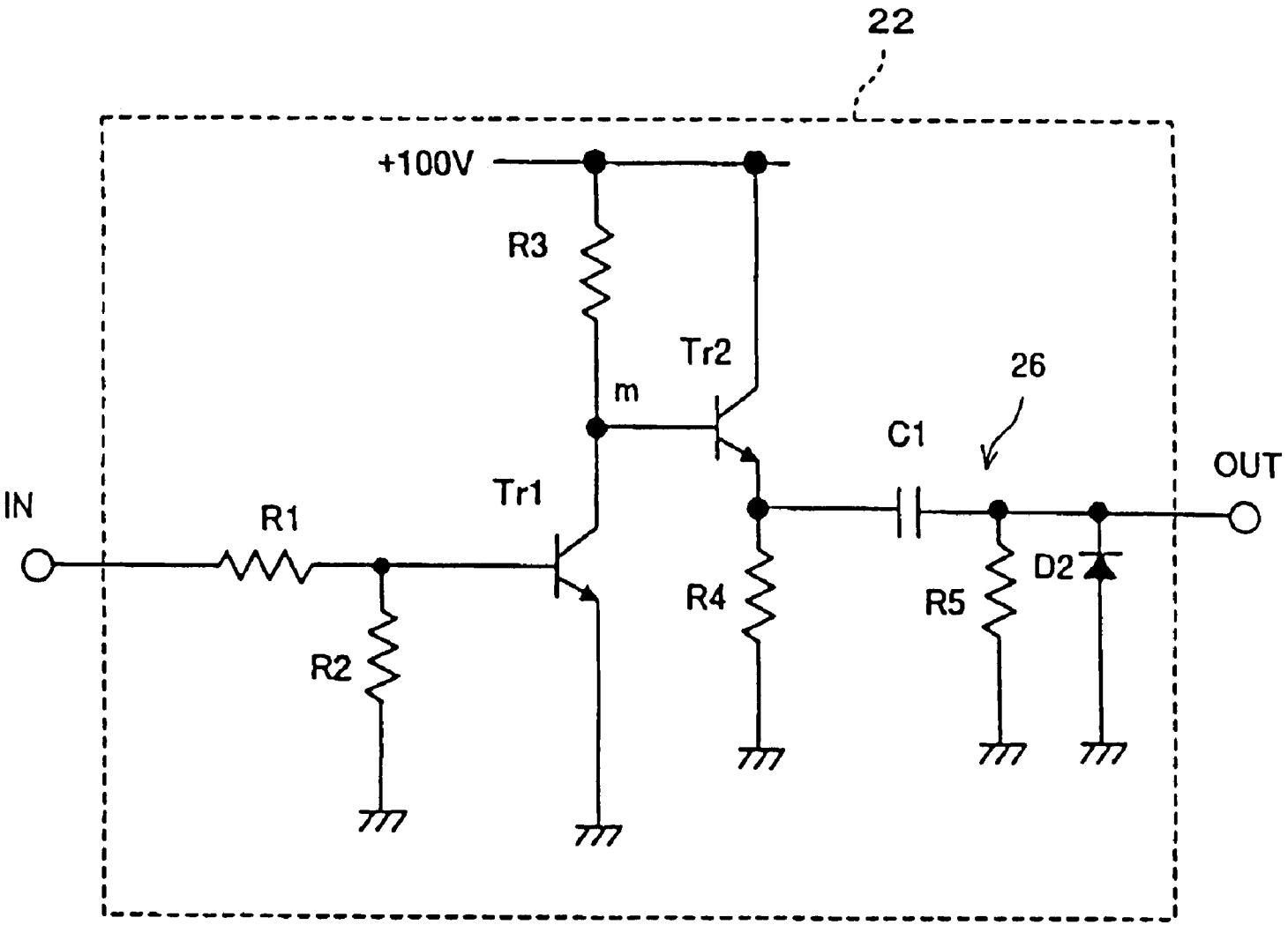
FIG. 33 is an example of a waveform amplifier for the transporting voltage pattern and the recycling and transporting voltage pattern.

Next, FIG. 33 is an exemplary circuit diagram for describing the waveform amplifiers 22*a*, 22*b*, 22*c* (here, referring to 22) that are used to generate driving waveforms of the recycling and transporting voltage pattern shown in FIG. 11. As described above, each phase of the driving waveforms of the recycling and transporting voltage pattern shown in FIG. 11 is a pulse waveform of 0V to +100V and has a duty cycle of 33% [time percentage that the potential is relatively positive (i.e., +100V)].

The waveform amplifier 22 comprises resistors R1, R2 for dividing a voltage of an input signal, a transistor Tr1 for switching, a collector resistor R3, a transistor Tr2, a current limiting resistor R4, and a clamper circuit 26 including a capacitor C1, a resistor R5 and a diode D2. Namely the only difference between the waveform amplifier 22 and the waveform amplifier 23 is that the direction of the diode D1 in the clamper 25 and the direction of the diode D2 in the clamper 26 are opposite.

Figure 34:
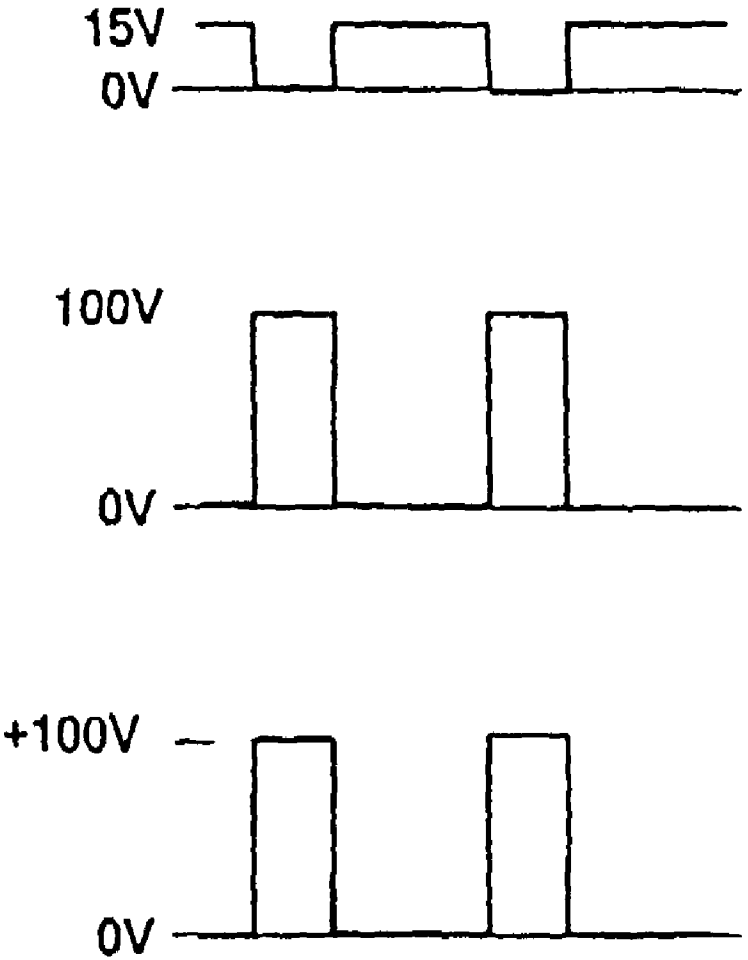
FIGS. 34A to 34C show driving waveforms for the waveform amplifier.

As shown in FIG. 34A, an input signal IN is input to the waveform amplifier 22 from the aforementioned pulse signal generating circuit 21, wherein the input signal IN is a pulse waveform with a voltage of 0V and 15V and a duty cycle for the 15V voltage is about 67% of the input signal IN. The input signal IN is divided by the resistors R1, R2, and then the divided input signal is transmitted to the base of the transistor Tr1. The transistor Tr1 is operated to switch to reverse the phase and to boost an output level up to 0V to +100V, so that a collector voltage m shown in FIG. 32B is obtained at the collector of the transistor Tr1.

The transistor Tr2 receives the collector voltage m and outputs a waveform having the same level with a low impedance. In the clamper circuit 26 connected to the emitter of the transistor Tr2, a time constant with respect to the negative waveform is small, and a time constant with respect to the positive waveform is determined by the capacitor C 1 and the resistor R5. But, the time constant is set to a very large value with respect to the period of the pulse waveform, by which the clamper circuit 26 can output an output waveform OUT 0V to +100V in which the zero level is clamped, as shown in FIG. 34C.

In this way, the driving waveforms applied to each electrode of the transporting substrate is formed by the clamper circuit comprising the capacitor, the resistor and the diode. Therefore, with a simple circuit structure, since the low level side is clamped, no draft occurs and a stable waveform with a constant peak value can be obtained, so that the toner can be correctly transported and hopped.

The relationship of the charging polarity of the toner and the voltage (potential) applied to the electrodes 102 of the transporting substrate 1 is described. When the negatively charged toner is used, the voltage at the developing region is set 0V to −V1, and the voltage at the region after the developing region (the recycling region) is set 0V to +V2. Namely, the voltage of the hopping driving waveform is 0V to −V, while the voltage of the recycling and transporting driving waveform is 0V to +V. In this manner, with the above simple driving circuit, the reliability can be improved.

Similarly, when the positively charged toner is used, the voltage at the developing region is set 0V to +V3, and the voltage at the region after the developing region (the recycling region) is set 0V to −V4. Namely, the voltage of the hopping driving waveform is 0V to +V, while the voltage of the recycling and transporting driving waveform is 0V to −V. In this manner, with the above simple driving circuit, the reliability can be improved.

In addition, the aforementioned voltages V1, V2, V3, V4 can be voltages with the same absolute value. Alternatively, their absolute values can be different.

Next, widths (electrode widths) L and the electrode gap R of the plural electrodes 102 on the transporting substrate 1 (which are used for hopping and transporting the toner), and the surface protection layer 103 are described. The electrode width L and the electrode gap R of the electrodes 102 on the transporting substrate 1 have great influence on the hopping efficiency. That is, by the electric field substantially directed in the horizontal direction, toner located between the electrodes moves to the electrode that is adjacent to the surface of the transporting substrate 1. In contrast, most of the toner carried on the electrodes flies away from the surface of the transporting substrate 1 since the toner is at least provided with an initial speed having a component in the vertical direction.

In particular, toner near the end faces of the electrodes will fly over the adjacent electrode to move, and therefore, the number of the toner carried on that electrode becomes large. Toner with a large moving distance increases, and therefore, the transporting efficiency increases. However, if the electrode width L is too wide, the strength of the electric field in the vicinity of the electrode center decreases, so that the toner is adhered on the electrodes and the transporting efficiency decreases. According to the research result of the inventors, a proper electrode width for effectively transporting and hopping the powder (the toner) with a low voltage.

The strength of the electric field between the electrodes 102 is determined from the electrode gap R and the applying voltage. As the gap R gets narrower, the strength of the electric field gets stronger, so that the initial speed for hopping and transporting can be easily obtained. However, for the toner moving from one electrode to another electrode, the moving distance for each movement becomes shorter and the moving efficiency cannot be increased if the driving frequency is not increased. Also, According to the research result of the inventors, a proper electrode gap R for effectively transporting and hopping the powder (the toner) with a low voltage.

Furthermore, the thickness of the surface protection layer 103 that covers the surface of the electrodes has also an influence on the strength of the electric field. In particular, the thickness of the surface protection layer 103 has a great influence on the electric force lines of components in the vertical direction, and could be found as a factor to determine the hopping efficiency.

In this invention, by setting a proper relationship between the electrode width on the transporting substrate, the electrode gap and the thickness of the surface protection layer, the problem for adhering the toner onto the surface of the electrode can be solved and the toner can be effectively moved with a low voltage.

In detail, regarding the electrode width, when the electrode width is set one time of the diameter of the toner, this is a dimension for carrying at least one toner to transport and hop. If the electrode width L is less than the above value, the electric field acting on the toner will reduce. Therefore, the transporting and flying ability reduces, which is insufficient in practice.

In addition, if the electrode width L becomes wider, in particular, the electric force lines in the vicinity of the center of the electrode is tilted to the propagating direction (the horizontal direction), a region where the electric field in the vertical direction occurs, and therefore, the force to create the hopping effect is reduced. As the electrode width L becomes very large, in a extreme case, adhesion force due to the image force corresponding to the charges on the toner, the van der Waals force and water, etc. dominates, and toner is accumulated.

From the point of view of the transporting and hopping efficiency, if about 20 toner is carried on the electrode, it is very difficult to adhere the toner, and therefore, the transporting and hopping operations can be more effectively performed by driving waveforms with a low voltage, e.g., about 100V. If the electrode width is wider than the above value, a region where a portion of the toner is adhered is occurred. For example, if the average diameter of the toner is 5 μm, the range of the electrode width is about 5 μm to 100 μm.

A more preferable range for the electrode width L is two to ten times of the average diameter of the toner for more effectively driving the toner by the applying voltage of the driving waveforms (a low voltage not greater than 100V). By setting the electrode width L with the above range, the strength of the electric field in the vicinity of the center of the electrode surface can be suppressed down to one-third and the hopping efficiency reduction is below 10%, by which the efficiency will not be greatly reduced. For example, if the average diameter of the toner is 5 μm, the range of the electrode width is about 10 μm to 50 μm.

Furthermore, more preferable range for the electrode width L is two to six times of the average diameter of the toner. For example, if the average diameter of the toner is 5 μm, the range of the electrode width is about 10 μm to 30 μm. It could be understood that as the electrode width L within this range, the efficiency is very good.

Figure 35:
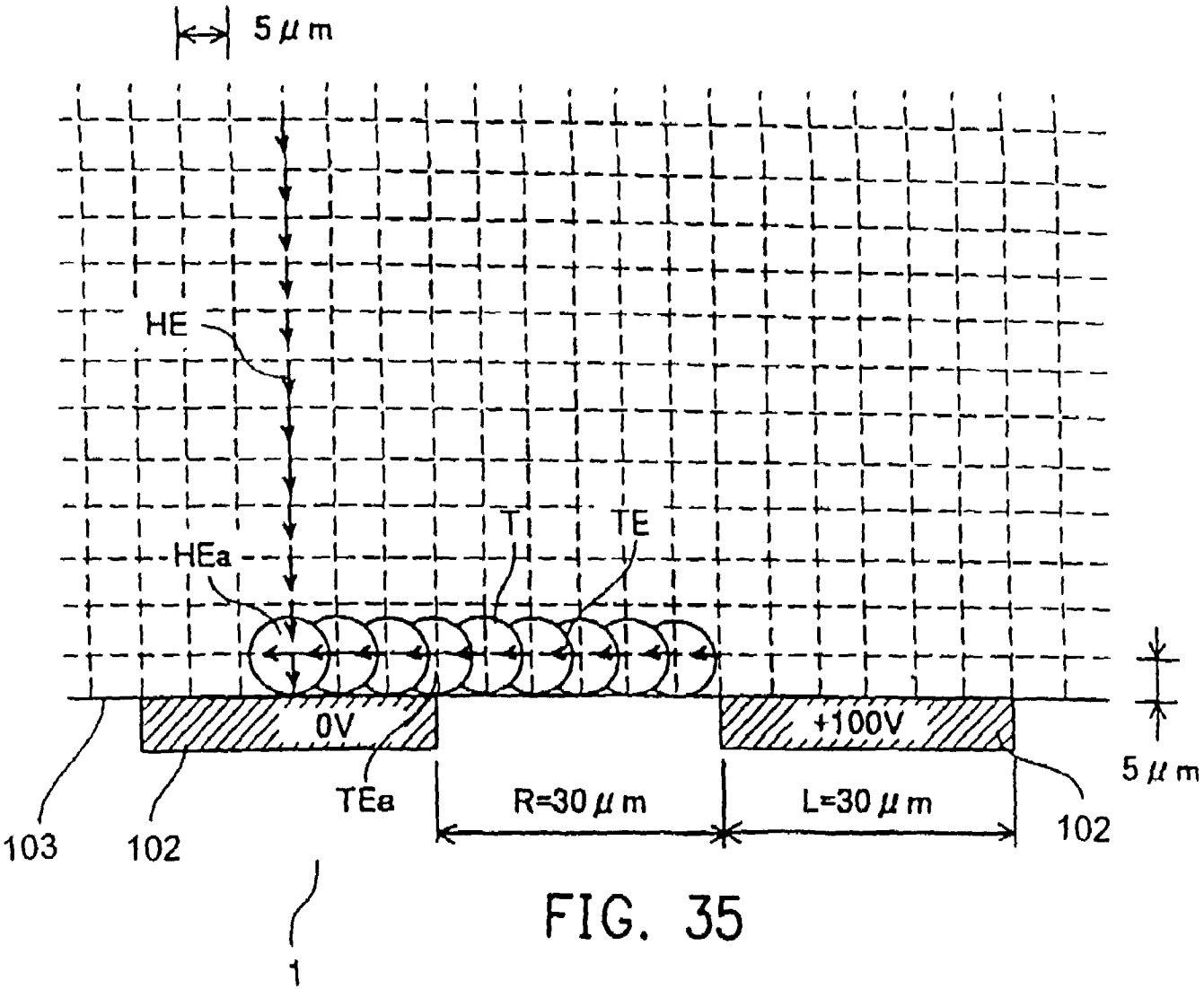
FIG. 35 is a diagram for describing the electrode width and the electrode gap in the developing device.
Figure 36:
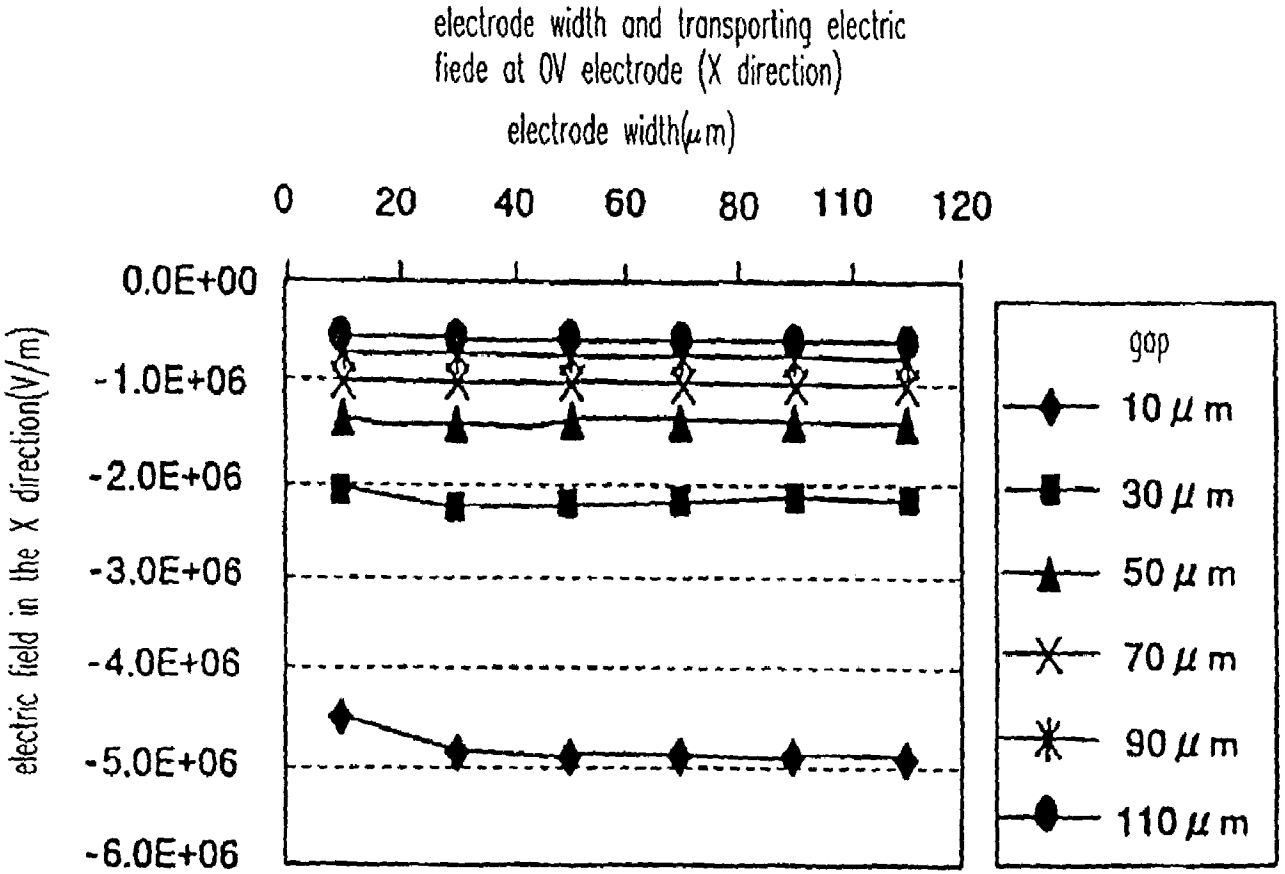
FIG. 36 is a diagram showing a relationship between the electrode width and the electric field at the end of the electrode (in the X direction)
Figure 37:
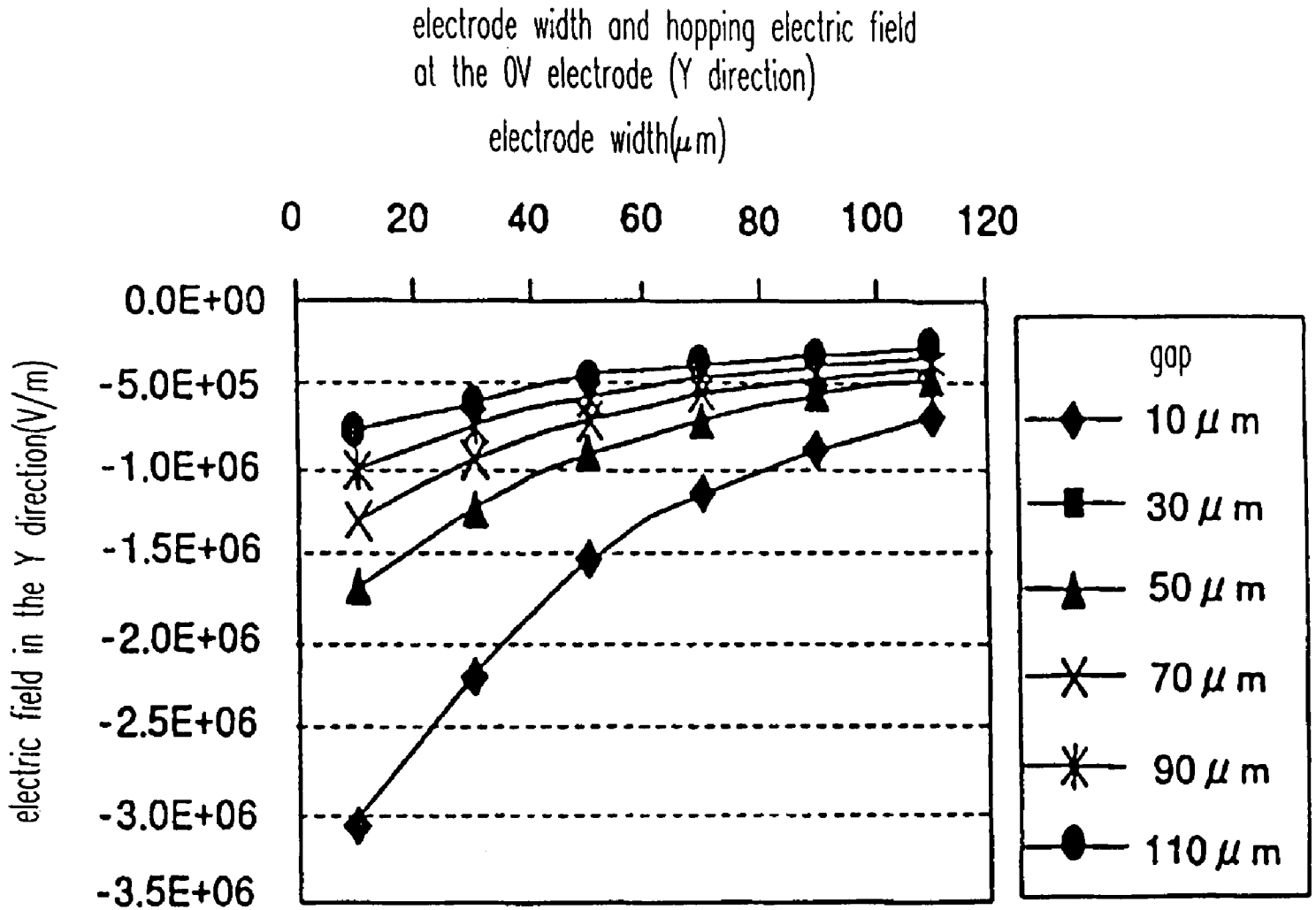
FIG. 37 is a diagram showing a relationship between the electrode width and the electric field at the end of the 0V electrode (in the Y direction)

In FIG. 35, the electrode width L of the electrode 102 on the transporting substrate 1 is 30 μm, the electrode gap R is 30 μm, the thickness of the electrode 102 is 5 μm, the thickness of the surface protection layer 103 is 0.1 μm, and the adjacent two electrodes 102 are respectively applied with +100V and 0V . FIGS. 36 and 37 show results of measuring the strengths of the transporting electric field TE and the hopping electric field HE with respective to the electrode width L and the electrode gap R.

Each evaluated data is a simulation and an actual measurement, and the behavior of the particles (the toner), which is a result actually measured and evaluated by a high-speed video camera. In FIG. 35, only two electrodes 102 are depicted in order to understand the details easily. But, the actual simulation and the experiment are evaluated regarding the region having a sufficient number of the electrodes. In addition, the diameter of the toner is 8 μm and the charge amount is −20 μC/g.

The strength of the electric field shown in FIGS. 36 and 37 are values of typical points on the surface of the electrode. The typical point TEa of the transporting electric field TE is a point 5 μm above the edge of the electrode shown in FIG. 35. The typical point HEa of the transporting electric field HE is a point 5 μm above the center of the electrode shown in FIG. 35. These typical points TEa and HEa are respectively equivalent to the strongest electric fields acted on the toner in the X direction and the Y direction.

From FIGS. 36 and 37, the electric field capable of providing a force for transporting and hopping the toner is not less than $5\times10^5$V/m. Without the adhesion issue, the preferable electric field is not less than $1\times10^6$V/m. Furthermore, more preferable electric field capable of providing a sufficient force is not less than $2\times10^6$V/m.

Regarding the electrode gap R, because as the gap gets wider, the strength of the electric field in the transporting direction reduces, values of the electrode gap R also correspond to the range of the strength of the electric field mentioned above. As described above, the electrode gap R is one to twenty times of the average diameter of the toner. Two to ten times of the average diameter of the toner is better, and two to six times of the average diameter of the toner is preferred.

In addition, from FIG. 37, the hopping efficiency reduces when the electrode gap R gets wider. However, in practice, the hopping efficiency can be still obtained as the electrode gap R is 20 times of the average diameter of the toner. If the electrode gap R is greater than 20 times of the average diameter of the toner, the adhesion forces of the toner cannot be ignored, and toner that is completely not hopped will occur. Therefore, from this point of view, the electrode gap R has to be not greater than 20 times of the average diameter of the toner.

As described above, the electric field in the Y direction id determined by the electrode width L and the electrode gap R. A narrower electrode width L and a narrower electrode gap R will cause the electric field with a high strength. In addition, the strength of the electric field near the edge of the electrode 102 in the X direction is also determined by the electrode gap R. Therefore, a narrower electrode gap R will cause the electric field with a high strength.

In this manner, by setting that the electrode width L in the toner propagating direction is one to twenty times of the average diameter of the toner and the electrode gap L in the toner propagating direction is one to twenty times of the average diameter of the toner, the image force, the van der Waals force and the adhesion force dominate for the charged toner located on the electrodes or located between the electrodes, so that a sufficient electrostatic force for transporting and hopping the toner can be effected. Therefore, the toner can be preventing from staying, and can be stably and efficiently transported and hopped with a low voltage.

According to the research of the inventors, when the average diameter of the toner is 2 to 10 μm, and the ratio Q/M is −3~−40 μC/g (better is −10~−30 μC/g) for the negatively charged toner and is +3~+40 μC/g (better is +10~+30 μC/g) for the positively charged toner, the transporting and hopping processes with the above electrode structure can be efficiently performed.

Next, the surface protection layer 103 is described. By forming the surface protection layer 103, there are no contamination to the electrodes 102 and adhesion of particles, and therefore, the surface can be maintained in a good condition for transporting the toner. In addition, a surface leakage can be avoided in a high humidity environment. Moreover, the ratio Q/m does not vary, and therefore, the charge amount of the toner can be stably maintained.

Figure 38:
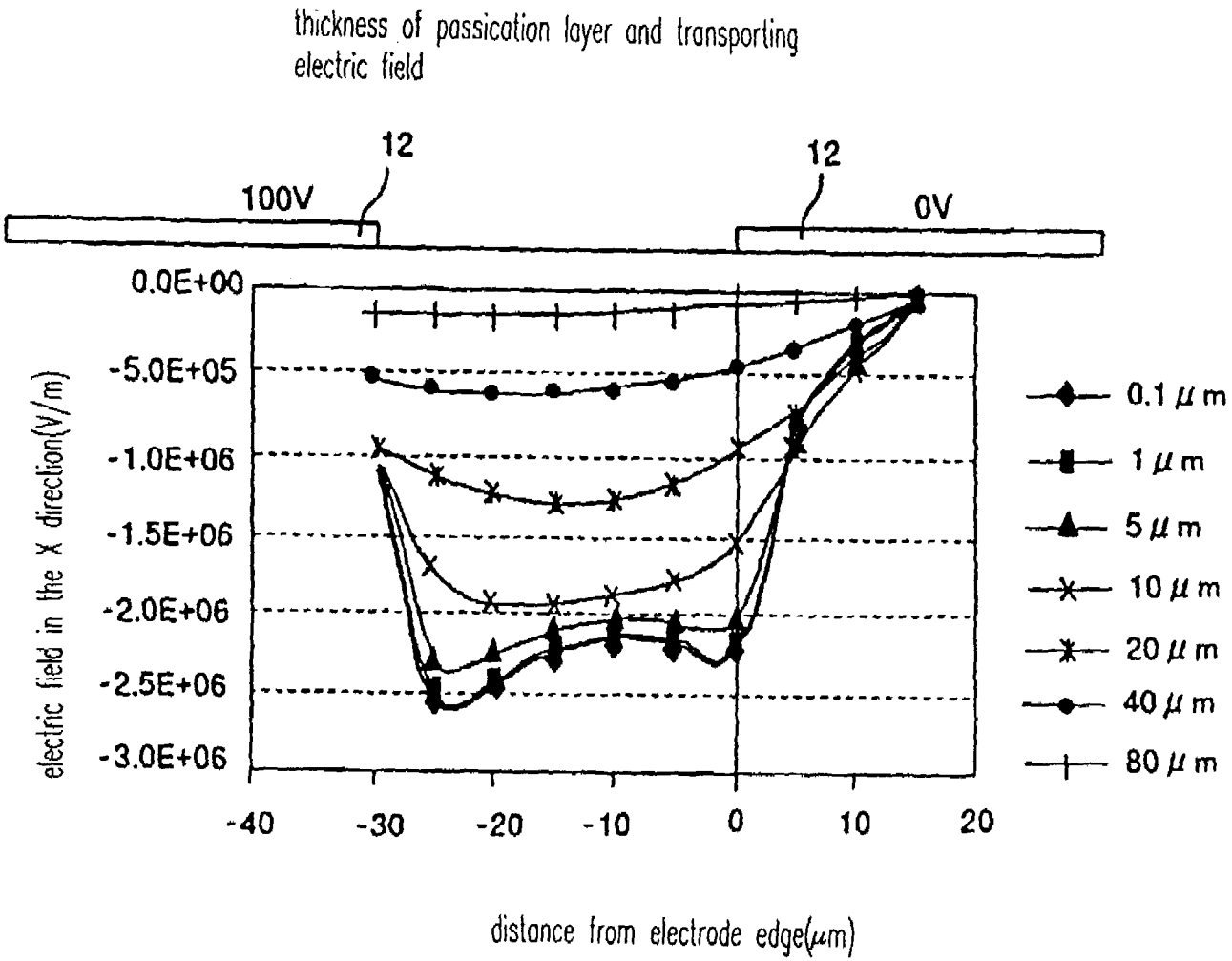
FIG. 38 is a diagram showing a relationship between the strength of the electric field and the thickness of the surface protection layer.

FIG. 38 shows a result by calculating the strength of the electric field in the X direction when the thickness of the surface protection layer 103 (FIG. 35) varies from 0.1 μm to 80 μm.

The dielectric constant s of the surface protection layer 103 is higher than the dielectric constant of the air, and is usually equal to or greater than 2. As could be understood from the drawing, when the thickness of the surface protection layer (the thickness from the surface of the electrode) is too thick, the strength of the electric field acting on the toner on the surface will reduce. Considering the transporting efficiency and the temperature durability, the humidity and the environment factors, etc., in practice, the thickness of the surface protection layer is not greater than 10 μm, by which a problem of efficiency reduction in the transporting operation does not exist and the efficiency is only reduced by 30%. More preferable, the thickness of the surface protection layer is not greater than 5 μm, for suppressed the efficiency reduction down to only several percentages (%).

Figure 39:
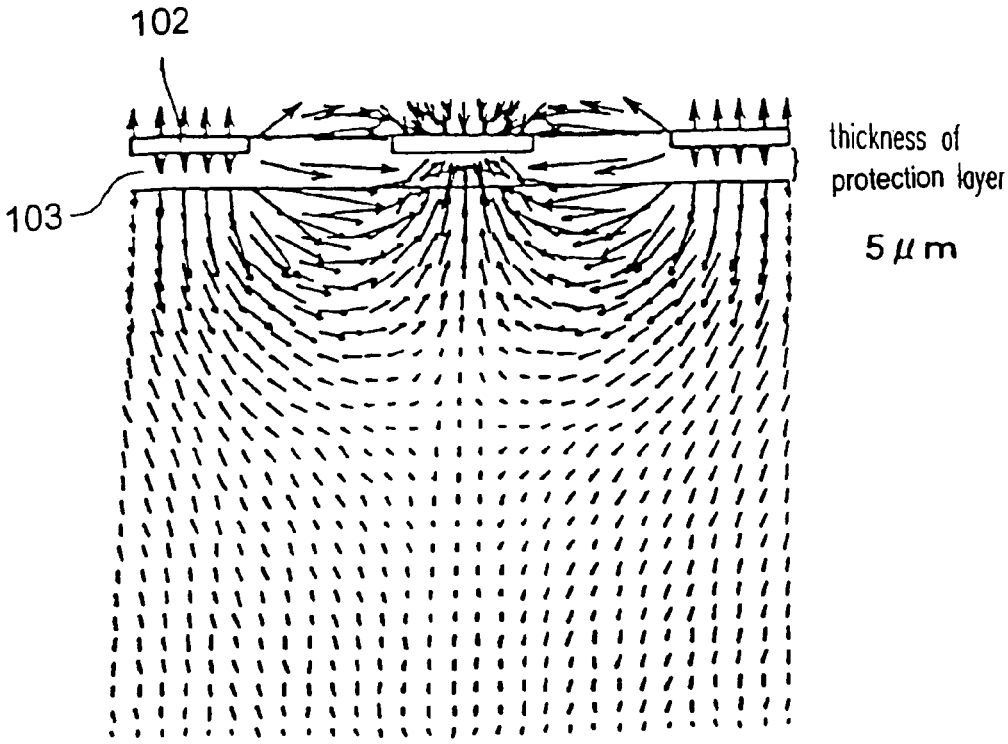
FIG. 39 is a diagram for explaining the relationship between the strength of the electric field and the thickness of the surface protection layer.
Figure 40:
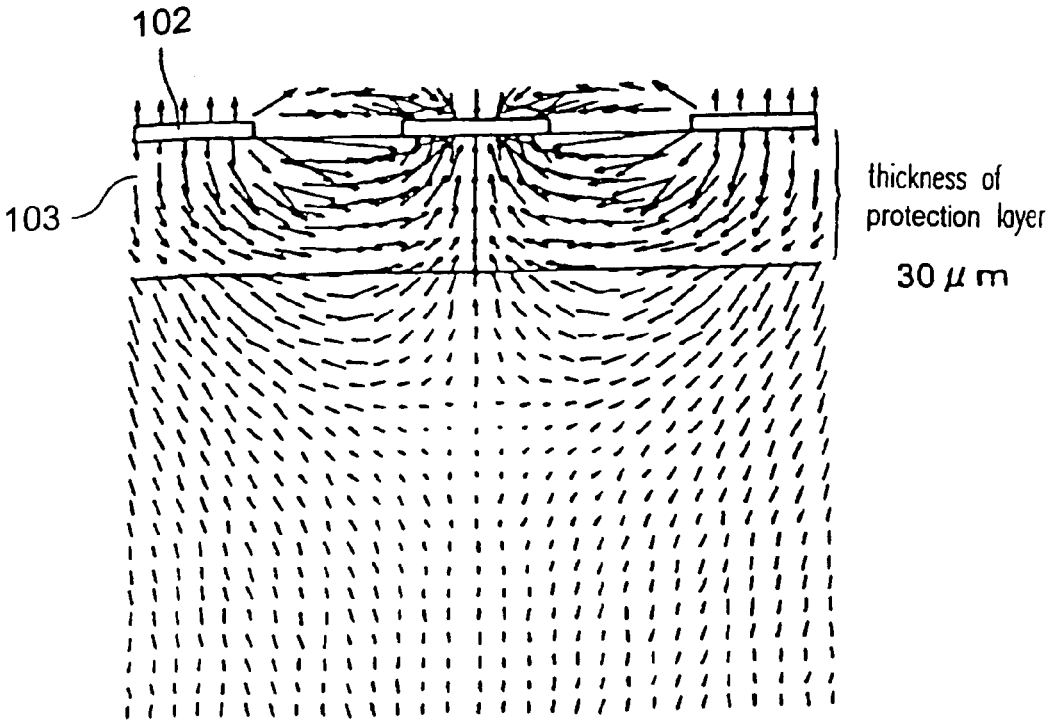
FIG. 40 is a diagram for explaining the relationship between the strength of the electric field and the thickness of the surface protection layer.

In addition, FIGS. 39 and 40 show an example of the strength of the electric field that acts during the hopping operation on the surface of the electrode. FIG. 39 shows an example in which the thickness of the surface protection layer is 5 μm. FIG. 40 shows an example in which the thickness of the surface protection layer is 30 μm. Either in FIG. 39 or FIG. 40, the electrode width is 30 μm, the electrode gap is 30 μm and the applying voltages are 0V and 100V.

As could understood from the drawings, when the thickness of the surface protection layer 103 gets thicker, the electric field, which is directed from the surface protection layer with a dielectric constant higher than the air to the adjacent electrode, will increase, and therefore, the component in the surface's vertical direction decreases and the strength of the electric field, which acts on the toner on the surface, reduces due to the thickness of the surface protection layer 103.

Namely, the electric force lines of the component in the vertical direction, which acts during the hopping process, depends on the thickness of the surface protection layer 103 greatly. The electric field, capable of providing a force acting efficiently during the hopping process with a low voltage about 100V , is preferably not less than $1\times10^6$V/M, if no adhesion issue. Furthermore, for being able to provide a sufficient force, the electric field is preferably not less than $2\times10^6$V/m. Therefore, the thickness of the surface protection layer 103 is preferably not greater than 10 μm, and more preferably, the thickness of the surface protection layer 103 is not greater than 5 μm.

In addition, a material with a specific resistance not less than $10\times10^6\Omega$cm and with a dielectric constant s not less than 2 is preferably used as the surface protection layer 103.

As described, by forming the surface protection layer to cover the surfaces of the electrodes and by setting the thickness of the surface protection layer not greater than 10 μm, the component of the electric field in the vertical direction, which acts on the toner, can becomes stronger, so that the hopping efficiency can be increased.

In addition, regarding a relationship with the charging potential of the latent image supporter, when the toner is negatively charged, the charging potential of the surface of the latent image supporter is not greater than −300V, while when toner is positively charged, the charging potential of the surface of the latent image supporter is not greater than +300V. Namely, the charging potential of the surface of the latent image supporter is not greater than |300 |V.

In this manner, as described above, when the electrodes are fine pitch, even though the voltage applied to the electrodes 102 is a low voltage below 150 to 100V, the generated electric field is also very large. Therefore, the toner adhered on the surface of the electrode can be easily separated, flown, and hopped. In addition, ozone and NOx, which are created during charging the OPC photosensor, are only few or even not created, it is advantageous in the environment issue and the durability of the photosensor.

Next, followings describe a relationship between the charging parity for moving the toner and the material of the outermost layer of the surface protection layer. In addition, when the surface protection layer comprises only one layer, the layer is the outermost layer of the surface protection layer. When the surface protection layer comprises a plurality of layers, the outermost layer of the surface protection layer is the layer that contacts with the toner.

When transporting toner for being used in an image forming device, above 80% of the toner is made of a resin material. Considering the melting temperature and the transparency of colors, the resin material in general uses copolymer of a styrene-acryl system, a polyester resin, an epoxy resin and a polyol resin, etc. These resin material affects the charging characteristic of the toner. However, a charging control agent for progressively controlling the charging amount is added. For example, the charging control agent for a black toner (BK) can be nigrosin system colorant, quaternary ammonium salts when the positively charged toner is used, and can be azo metal complex and salicylic acid metal complex when the negatively charged toner is used. In addition, the charging control agent for a color toner can be quaternary ammonium salts or imidazole complex when the positively charged toner is used, and can be salicylic acid metal complex, salts, or organic boron salts when the negatively charged toner is used.

On the other hand, the toner is transported on the transporting substrate 1 by the phase shifting electric field (the traveling-wave electric field), or repeatedly in contact with and separated from the surface protection layer 103 by the hopping operation. Therefore, the toner is affected by the friction charging, but the charging amount and the polarity are determined by the charging sequence between materials.

In this case, by maintaining at the saturated charging amount where the charging amount of the toner is mainly determined by the charging control agent, or a few reduction, the efficiencies of the transporting, hopping and the development of the photosensor cam be improved.

When the charging polarity of the toner is negative, at least, the material of a layer forming the outermost layer of the surface protection layer 103 preferably uses a material that positions on the friction charging sequence and in the vicinity of the material used as the charging control agent for the toner (when the transporting and hopping regions are few), or a material that positions at the positive end side. For example, when the charging control agent is salicylic acid metal complex, the polyimide that positions nearby is preferred. For example, polyimide (Nylon, trade mark) 66, Nylon (trade mark) 11, etc. can be used.

In addition, when the charging polarity of the toner is positive, at least, the material of a layer forming the outermost layer of the surface protection layer 103 preferably uses a material that positions on the friction charging sequence and in the vicinity of the material used as the charging control agent for the toner (when the transporting and hopping regions are few), or a material that positions at the negative end side. For example, when the charging control agent is quaternary ammonium salts, the polyimide that positions nearby is preferred. For example, fluorine system material, etc. (Teflon, trade mark) can be used.

Next, the thickness of the electrode is described. As described above, when the surface protection layer 103 with a thickness of several μm is formed to cover the surfaces of the electrodes 102, a concave-convex shape is created on the surface of the transporting substrate 1 since there are regions under which no electrodes 102 exist and regions under which the electrodes 102 exist. At this time, by forming the electrode with a thickness less than 3 μm, there is no unevenness problem of the surface of the surface protection layer 103, so that particles, such as the toner with a diameter of about 5 μm can be smoothly transported. Therefore, if the electrode 102 is formed with a thickness less than 3 μm, it is not necessary to planarize the surface of the transporting substrate 1 and a transporting substrate with a thin surface protection layer can be used. Furthermore, there is not a reduction in the strength of the electric field for hopping, and the transporting and hopping operations can be more effectively performed.

Figure 41:
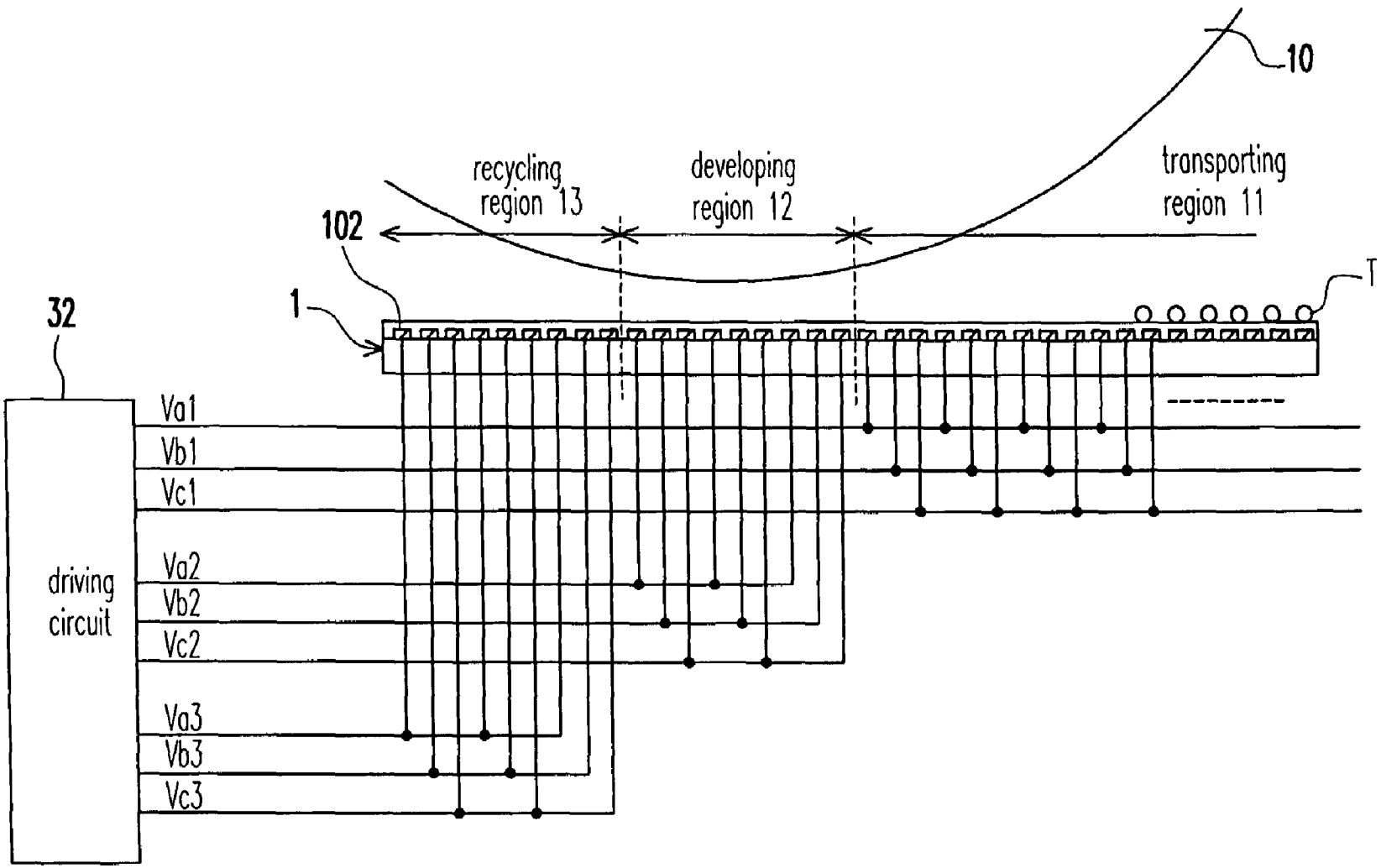
FIG. 41 shows a schematic diagram of the developing device according to the second embodiment.

Next, the second embodiment of the present invention is described according to FIG. 41 and its subsequent drawings. In the second embodiment, a driving circuit 32 is used to replace the driving circuit 2 in the first embodiment, in which the driving circuit 32 is used to apply driving waveforms Va1, Vb1, Vc1, driving waveforms Va2, Vb2, Vc2, and driving waveforms Va3, Vb3, Vc3 to each electrode 102 arranged at the transporting region 11, the developing region 12 and the recycling region 13 on the transporting substrate 1.

Figure 42:
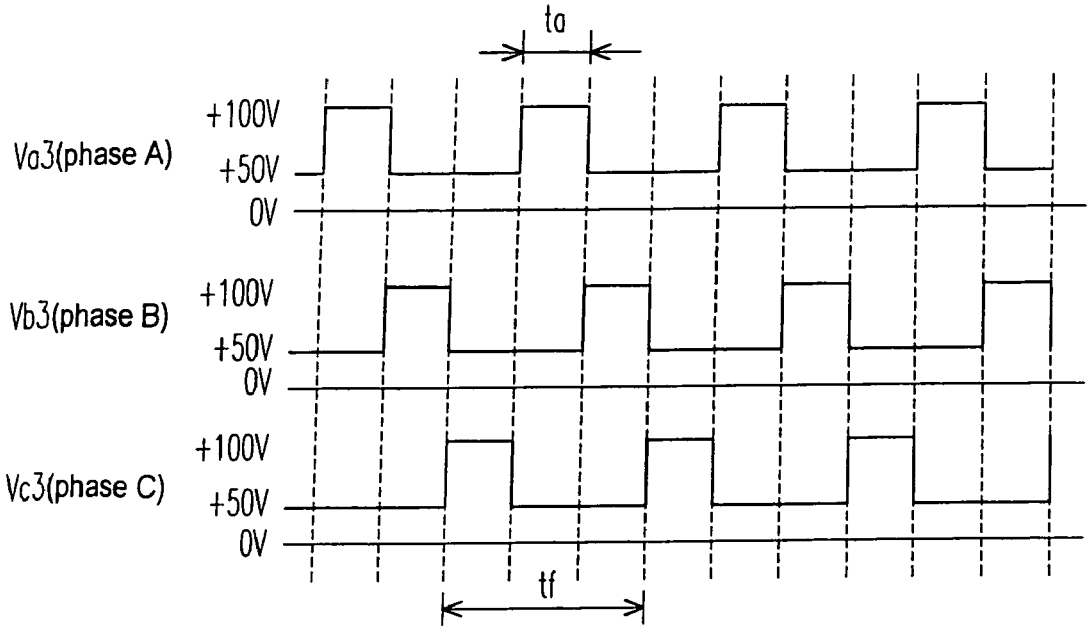
FIG. 42 shows an exemplary driving waveforms of the recycling and transporting voltage pattern.

As shown in FIG. 42, the recycling and transporting driving waveforms Va3, Vb3, Vc3, which are output to the electrodes 102 at the recycling region 13 from the driving circuit 32 are set by adding a bias voltage of about DC +50V to the transporting driving waveforms Va1, Vb1, Vc1. Each phase is a pulse waveform with voltages of +50V and +100V. The waveforms of phase A, B and C are shifted one another by 120°.

Figure 44:
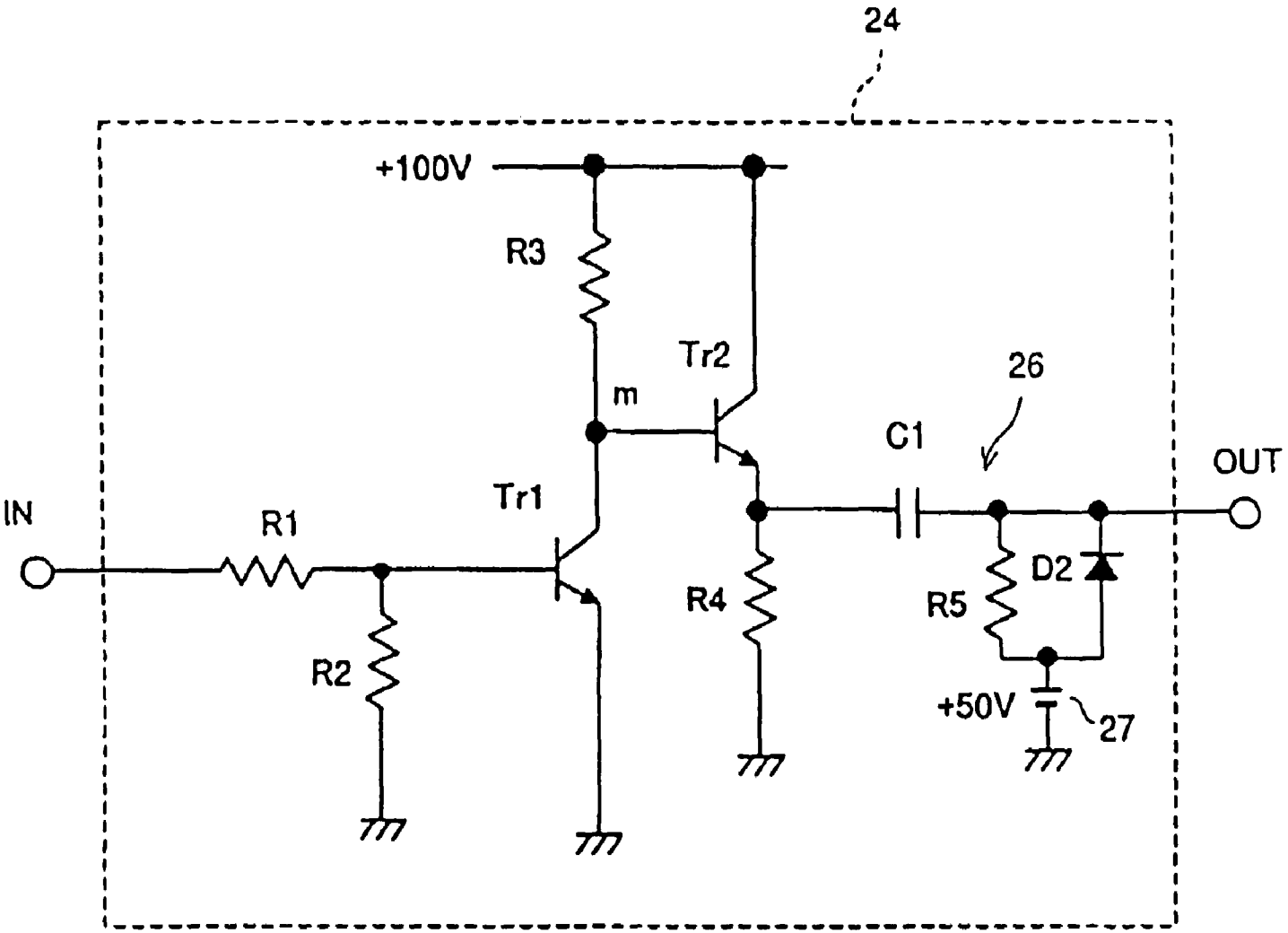
FIG. 44 shows a toner distribution that 1000 μsec has lapsed after the recycling and transporting voltage pattern is applied.

The waveform amplifier 24 for the recycling and transporting voltage is included in the driving circuit 32 that is used to generate the driving waveforms. The waveform amplifier 24, as shown in FIG. 44, a voltage source 27 for providing a DC +50V bias is inserted between the ground GND and the clamper circuit 26, in which the positive end of the diode D2 and one end of the resistor R5 are connected to the positive end of the voltage source 27 and the other end of the voltage source 27 is connected to the ground GND. Therefore, the output waveforms of the aforementioned waveform amplifier 22 is biased by the DC voltage (+50V), and then the waveform amplifier 24 outputs a waveform with voltages of +50V to +100V.

In this way, the driving waveforms applied to each electrode of the transporting substrate is formed by the clamper circuit comprising the capacitor, the resistor, the diode and the bias voltage generating means. Therefore, with a simple circuit structure, since the low level side is clamped, no draft occurs and a stable waveform with a constant peak value can be obtained, so that the toner can be correctly transported and hopped. In addition, a waveform where the low level side is not 0V but a predetermined bias can be provided by inserting a simple voltage source, so that the bias electric field between the photosensor 10 and the transporting substrate 1 can be adjusted and a condition for obtaining an optimum image can be easily set.

According to the second embodiment, by overlapping a DC bias voltage to the driving waveforms applied to the electrodes 102 at the recycling region 13, the recycling efficiency can be further improved and the toner scattering can be firmly prevented from occurring.

Namely, as described above, at the region after the developing region 12, by arranging means for forming an electric field to draw the toner back to the transporting substrate 1 side, the toner scattering will decrease greatly, but not zero. The reason is that near the transporting substrate 1 side, the air also moves due to the rotating OPC photosensor drum 10, which could be realized from the high-speed video camera and the aforementioned simulation.

In this embodiment, by overlapping a DC bias of +50V with the waveforms applied to the electrodes 102 at the recycling region 13, the strength of the electric field is increased, the occurrence of the toner scattering is almost zero. At this time, the average voltage of the driving waveform is 83.3V.

At this time, an exemplary movement of the toner is shown in FIG. 43. FIG. 43 shows a toner distribution when 1000 μsec has lapsed after the voltages applied to the electrodes 102 is switched to the driving waveforms Va3, Vb3, Vc3 of the recycling and transporting voltage pattern, which has the same time lapse as shown in FIG. 27 (the first embodiment). As comparing FIG. 44 with FIG. 30, the toner is drawn back to the transporting substrate 1.

According to the research result of the inventors, it could be understood that there is also a suitable value for the bias voltage. That is, when the DC bias voltage is set +100V (the driving waveform is +100V to +200V, and the average voltage is 133.3V), an exemplary movement of the toner is shown in FIG. 45. FIG. 45 shows a toner distribution when 1000 psec has lapsed after the voltages applied to the electrodes 102 is switched to the driving waveforms Va3, Vb3, Vc3 of the recycling and transporting voltage pattern. As comparing FIG. 45 with FIG. 44, the toner is drawn back to the transporting substrate 1. But, because the electrostatic force drawn by the transporting substrate 1 is very strong, there are toner without being transported.

Furthermore, when the DC bias voltage is set +150V (the driving waveform is +150V to +250V, and the average voltage is 183.3V), an exemplary movement of the toner is shown in FIG. 46. FIG. 46 shows a toner distribution when 1000 μsec has lapsed after the voltages applied to the electrodes 102 is switched to the driving waveforms Va3, Vb3, Vc3 of the recycling and transporting voltage pattern. As comparing FIG. 46 with FIG. 45, the electrostatic force drawn by the transporting substrate 1 is further stronger, even the toner adhered on the OPC layer 15 are drawn back to the transporting substrate 1 and thus the developed image disappears.

Namely, there is a suitable value for the bias voltage added to the recycling and transporting voltage. If the bias voltage is too low, the floating toner will be engaged with the air stream created by the rotation of the OPC photosensor drum, and therefore, the floating toner will not be drawn back to the transporting substrate 1 side where the air does not move. In contrast, if the bias voltage is too high, even the developed toner will be recycled and thus the image disappears.

Next, the third embodiment of the present invention is described. In this embodiment, the surface potential of the OPC photosensor drum 10 is increased and a negative DC bias voltage is overlapped with the driving waveforms Va2, Vb2, Vc2 of the hopping voltage pattern.

Figure 47:
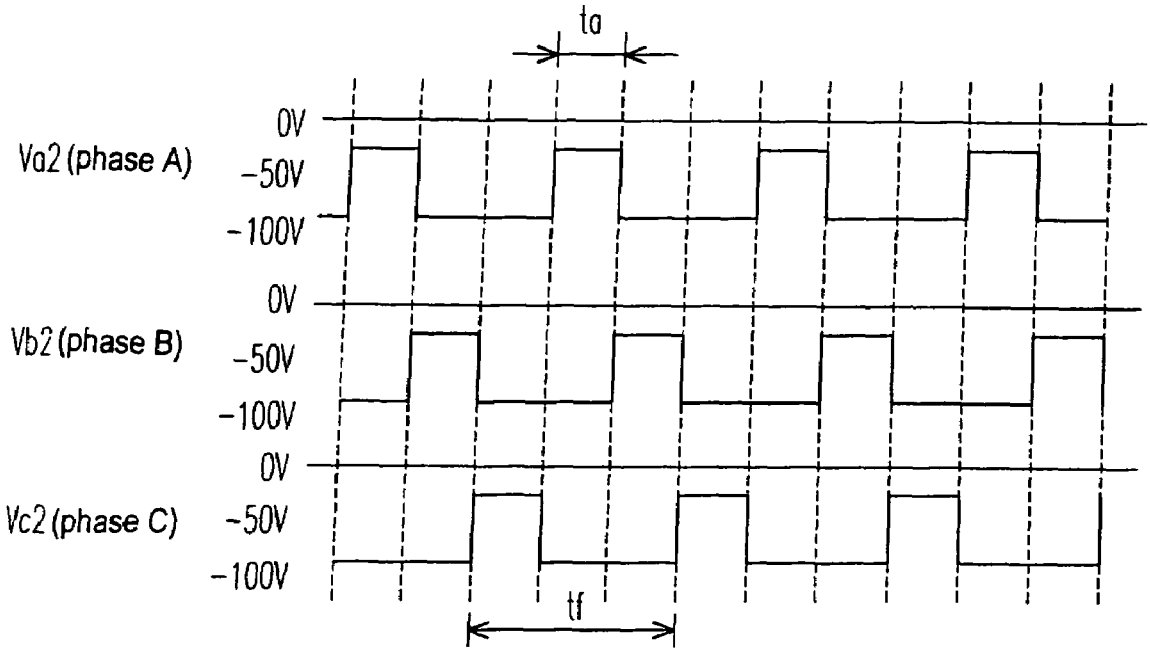
FIG. 47 shows driving waveforms of the hoping voltage pattern of the developing device according to the third embodiment of the present invention.

Namely, the charge density on the OPC layer 15 is increased up to $-10\times10^{-4}C/m^2$ and the potential is increased up to −220V. On the other hand, as shown in FIG. 47, the driving waveforms applied to each electrode 102 at the developing region 12 is biased by a negative DC bias voltage, e.g., −50V, so as to provide driving waveforms of −50V to −150V. In addition, the waveform has a duty cycle time of 33% for the relatively positive pulse.

Figure 48:
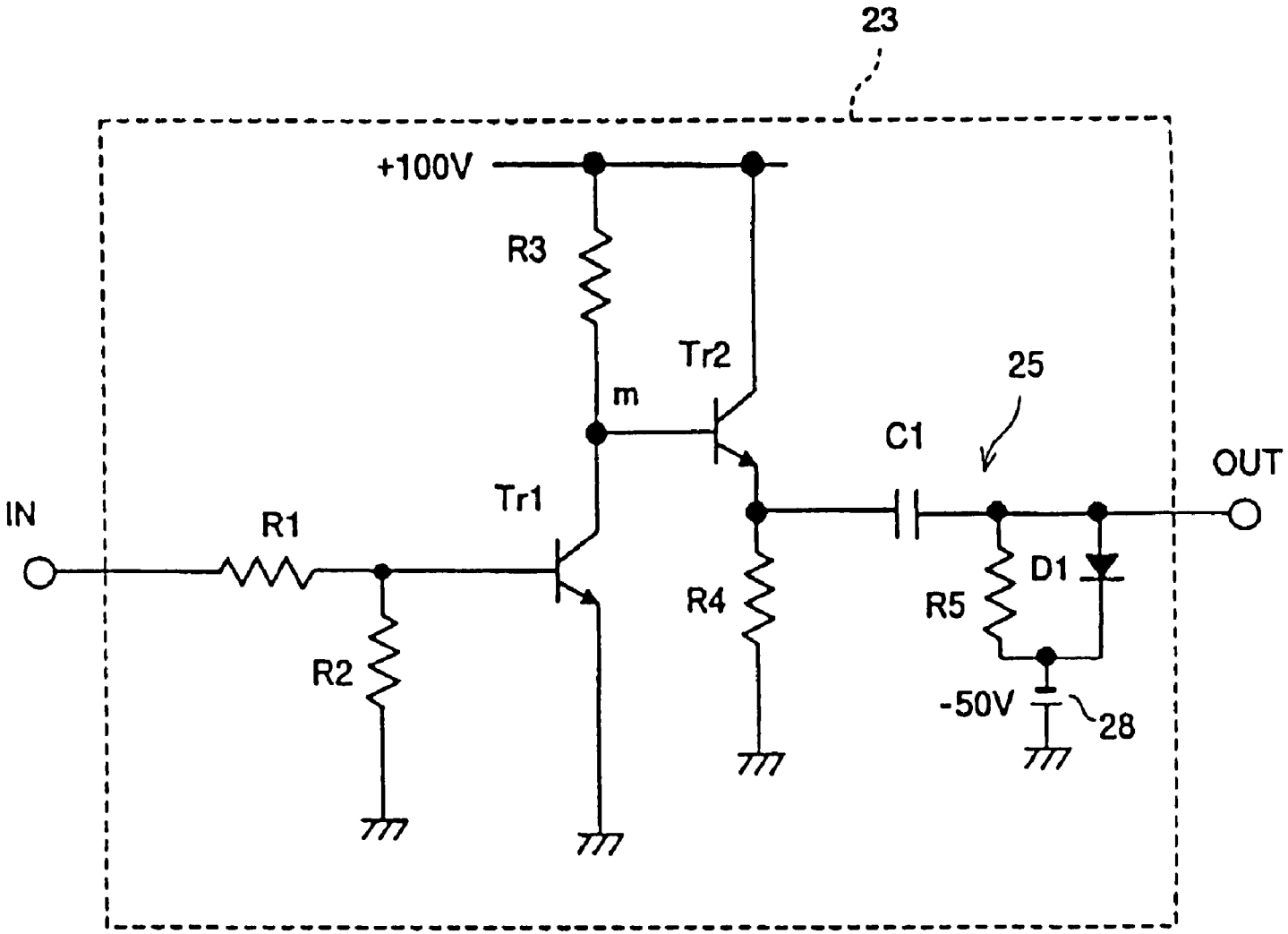
FIG. 48 shows an example of a waveform amplifier for generating the driving waveforms of the hopping voltage pattern.

As shown in FIG. 48, in the waveform amplifier 23 for generating the driving waveforms, a voltage source 28 for providing a DC bias of −50V is inserted between the ground GND and the clamper circuit 26, in which the negative end of the diode D1 and one end of the resistor R5 are connected to the negative end of the voltage source 28 and the other (the positive) end of the voltage source 28 is connected to the ground GND. Therefore, the output waveforms of the aforementioned waveform amplifier 23 is biased by the DC bias voltage (−50V), and then the waveform amplifier 23 outputs a waveform with voltages of −50V to −100V.

Figure 49:
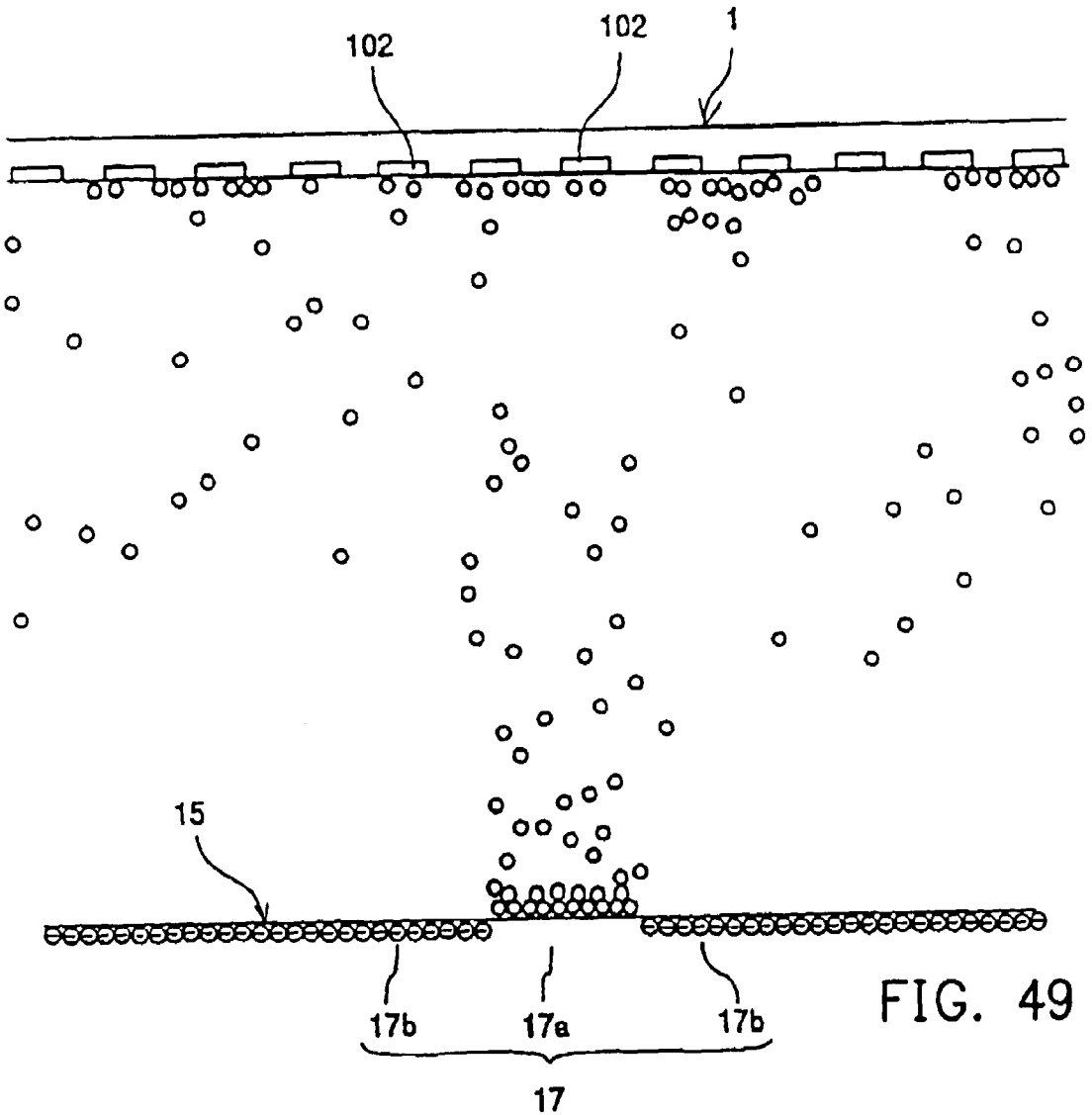
FIG. 49 shows a toner distribution after the development is finished in the third embodiment.

At this time, FIG. 49 shows an exemplary movement of the toner T. FIG. 49 shows a toner distribution when the development is finished. As compared with FIG. 23 (the first embodiment), the number of toner adhered on the image portion 17*a* is twice as the toner number adhered on the image portion 17*a* in the first embodiment.

In this way, according to this embodiment, the toner adhered (developed) on the image portion 17*a* increases, so that the image concentration increases and an image without the background contamination can be obtained.

By combining the second and the third embodiments, when the negatively charged toner is used, voltages of −V5 to −V6 (V5>V6) are applied to the electrodes 102 on the transporting substrate 1 at the developing region 12 and voltages of +V7 to +V8 (V8>V7) are applied to the electrodes 102 on the transporting substrate 1 at the region after the developing region 12 (i.e., the recycling region 13). On the other hand, by using voltages of −V to −(V+α) as the applied driving waveforms at the developing region 12 and using voltages of +V to +(V+α) at the region after the developing region 12 (i.e., the recycling region 13), the developing amount of toner and the recycling amount of floating toner can be further increased.

Similarly, when the positively charged toner is used, voltages of +V9 to +V10 (V 10>V9) are applied to the electrodes 102 on the transporting substrate 1 at the developing region 12 and voltages of −V 11 to −V 12 (V 11>V 12) are applied to the electrodes 102 on the transporting substrate 1 at the region after the developing region 12 (i.e., the recycling region 13). On the other hand, by using voltages of +V to +(V+α) as the applied driving waveforms at the developing region 12 and using voltages of −V to −(V+α) as the applied driving waveforms at the region after the developing region 12 (i.e., the recycling region 13), the developing amount of toner and the recycling amount of floating toner can be further increased.

In addition, the voltages V 9, V 10, V 11, V 12 can have the same absolute value, or can be different absolute values.

Next, the fourth embodiment of the present invention is described. In this embodiment, the voltage pattern of the same driving waveforms as the first embodiment is used, and the gap between the transporting substrate 1 and the OPC photosensor 10 is increased from 200 μm to 400 μm.

At this time, FIG. 50 shows an exemplary movement of the toner T. FIG. 50 shows a toner distribution when 1000 μsec has lapsed after the driving waveforms of the recycling and transporting voltage pattern is applied. As compared with FIG. 43 (the second embodiment), the floating toner is relatively drawn back to the transporting substrate 1 side. In this way, the toner scattering can be further avoided.

Figure 51:
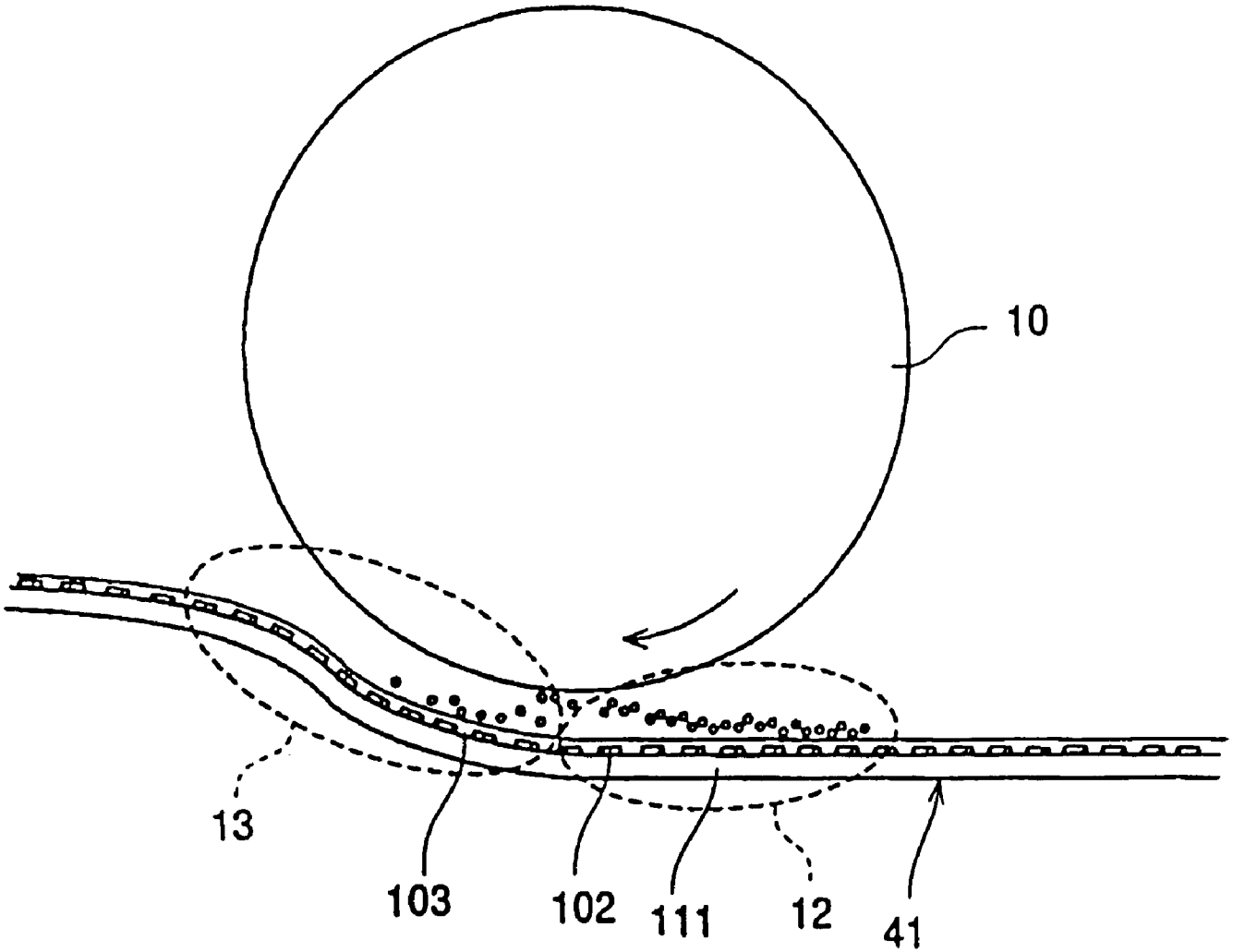
FIG. 51 shows a main portion for describing the developing device according to the fifth embodiment.

Next, the fifth embodiment is described according to FIG. 51. In this embodiment, a transporting substrate 41, where a plurality of electrodes 102 are formed on a flexible supporting substrate 111 and a surface protection layer 103 is formed on the electrodes 102, is used, a portion of the transporting substrate 41 corresponding to the recycling region 13 is bent to comply with the surface shape of the photosensor drum 10.

Namely, in the first embodiment, as the rotational number of the photosensor drum 10 increases (i.e., the peripheral speed increases), the toner scattering occurs. The reason is that since the gap between the photosensor drum 10 and the transporting substrate 1 is getting wider at the downstream side of the photosensor drum 10, the recycling time gets shorter. Before the floating toner is drawn back to the transporting substrate 1, the OPC layer moves farther than the transporting substrate 1.

By using the flexible substrate as the transporting substrate 41 and by keeping the gap between the transporting substrate 41 and the photosensor drum 10 to be substantially the same at the recycling region 13, the time for sufficiently recycling the toner can be maintained. Because the floating toner can be drawn back to the transporting substrate 1, the issue of the toner scattering can be cleared.

Figure 52:
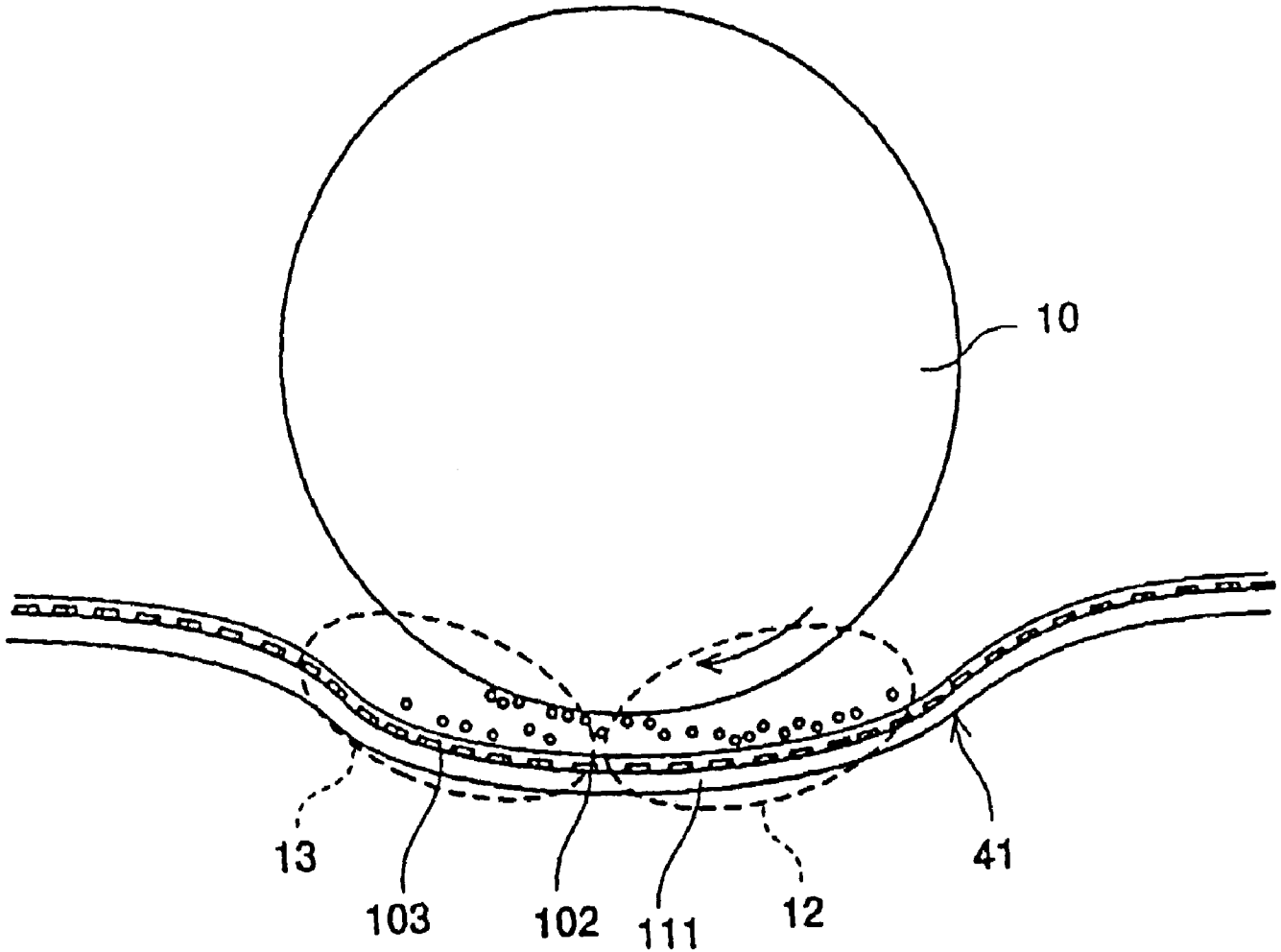
FIG. 52 shows a main portion of another example for describing the developing device according to the fifth embodiment.

As shown in FIG. 52, when the developing time is not enough, the flexible transporting substrate 41 can be bent to comply with the curvature of the OPC photosensor drum 10 at the developing region 12, so that the developing time can be maintained.

In the case of bending the transporting substrate 41, by setting that the gap between the latent image supporter (the photosensor drum 10) and a portion of the transporting substrate 41 where a bending surface is formed is getting wider at the downstream side of the moving direction of the latent image supporter, the disturbance of air stream does not occur and can be quickly attenuated. Therefore, the floating toner can be more firmly recycled.

As an example of the transporting substrate with flexible and fine-pitch thin electrodes, a base film made of polyimide is used as a substrate (the supporting substrate 111), on which a thin film (such as Cu, Al, Ni—Cr, etc.) with a thickness of 0.1 μm to 3 μm is formed by an evaporation method. If the width is 30 cm to 60 cm, the transporting substrate can be made by using a roll-to-roll device, so that the mass productivity is very high. The common bus line is simultaneously formed when forming the electrodes with a width of about 1 mm to 5 mm.

Means for the evaporation method can be a sputtering method, an ion plating method, a CVD method, an ion beam method, etc. For example, when the electrodes are formed by the sputtering method, an intermedium layer of such a Cr film can be further formed in order to increase the adhesion ability with the polyimide. By using a plasma process or a primer process as a preprocess, the adhesion ability can be improved.

In addition, for a method other than the evaporation method, the thin electrodes can be also formed by a n electrodeposition method. In this case, electrodes are first formed on a polyimide substrate material by an electroless plating method. A tin chloride layer, a palladium chloride layer and a nickel chloride layer are sequentially immersed to form a lower electrode, and then the electrolytic plating is performed in a Ni electrolyte and then a Ni film with a thickness of 1 μm to 3 μm can be formed by using a roll-to-roll device.

Then, a resist layer is coated on the thin electrode film and then the electrodes 102 are formed by the patterning and etching method. In this case, if the thin electrode has a thickness of 0.1 μm to 3 μm, the electrodes with a thickness of 5 μm to several ten μm and with a fine-patterned gap can be accurately formed.

Next, the surface protection layer 103 (such as $SiO_2$, $TiO_2$, etc.) with a thickness of 0.5 μm to 2 μm is formed by the sputtering method. Alternatively, the surface protection layer can be formed by that a polyimide (PI) with a thickness of 2 μm to 5 μm is coated by a roll coater or other coating device, and then the polyimide layer is baked. When it is difficult to directly use the PI, a SiO2 layer or other inorganic film with a thickness of 0.1 μm to 2 μm can be further formed by the sputtering method on the outermost surface of the PI layer.

Alternatively, as another example, a base film made of polyimide is used as a substrate (the supporting substrate 111), on which a thin film (such as Cu, SUS, etc.) with a thickness of 10 μm to 20 μm can be used as the electrode material. In this case, in contrast, the polyimide is coated on the metal material with a thickness of 20 μm to 100 μm by the roll coater, and then the polyimide is baked. Afterwards, the metal material is patterned by the photolithographic and etching process to define the shape of the electrodes 102, and then polyimide is coated on the electrodes 102 as the surface protection layer 103. When there is an unevenness corresponding to that the metal material of the electrode has a thickness of 10 μm to 20 μm, a planarization is performed to include proper step parts.

For example, a polyimide system material (with a viscosity of 50 to 10000 cps, and 100 to 300 cps is preferred) and polyurethane system material are spin-coated, and then the unevenness of the substrate is smoothened by the surface tension of the material. Therefore, the outermost surface of the transporting substrate is planarized. Thereafter, a stable protection film is formed by a thermal process.

Moreover, as another example for further increasing the strength of the flexible transporting substrate, the substrate uses a material, such as SUS, AL, etc., with a thickness of 20 μm to 30 μm. A polyimide material (that is diluted to about 5 μm), which is used as an insulating layer (for insulating the electrode from the substrate), is coated on the surface of the substrate by using the roll coater. Then, for example, the polyimide is pre-baked at 150° C. for 30 minutes and then post-baked at 350° C. for 60 minutes, so as to form a thin polyimide film as the supporting 111.

A plasma process and a primer process are performed for increasing the adhesion ability. Then, a Ni—Cr film as the thin electrode layer is formed by the evaporation with a thickness of 0.1 μm to 2 μm, and electrodes 102 with a fine pattern of several ten micrometers are formed by the photolithographic and etching processes. Furthermore, a surface protection layer 103 (such as SiO2 or TiO2, etc.) are formed on the surface of the electrodes 102 with a thickness of 0.5 μm to 1 μm by the sputtering method. In this manner, a flexible transporting substrate can be obtained.

Next, the sixth embodiment of the present invention is described. As described above, when the rotational number of the photosensor drum 10 increases (i.e., the peripheral speed increases), the toner scattering occurs. The reason is that since the gap between the photosensor drum 10 and the transporting substrate 1 is getting wider at the downstream side of the photosensor drum 10, the recycling time gets shorter. Before the floating toner is drawn back to the transporting substrate 1, the OPC layer moves farther than the transporting substrate 1.

In this embodiment, a hard type transporting substrate 1 is used. The bias voltage added to the driving waveforms of the recycling and transporting voltage pattern is sequentially increased according to an increasing gap between the transporting substrate 1 and the OPC photosensor drum 10. In this way, when the peripheral speed increases, the toner scattering can be also solved.

At this time, the gap between the plate-shaped transporting substrate 1 and the OPC photosensor drum 10 with respect to a length of the recycling region 13, and a relationship with respect to the bias voltage are shown in Table I. At this time, the condition is as follows. In addition, since the original background portion has few floating toner at the OPC photosensor layer side and the recycling electric field is also larger at the image portion, the bias voltage is set in such a manner that the recycling electric field of the image portion is maintained at a constant.

Condition:

a photosensor drum with a diameter of 60 mm and a plate-shaped transporting substrate;

the recycling region 13 begins directly under the center of the photosensor drum;

the recycling and transporting pattern is +100V, 0V , 0V (plus bias 50V);

the potential of the electrostatic latent image is 0V at the image portion and −170V at the background portion; and the charging polarity of the toner is negative (−20 μC/g).

TABLE I

| division | range mm | average gap mm | bias voltage volts | Average electric field (V/μm) Image portion | Background portion |
|---|---|---|---|---|---|
| 1 | 0.0~1.0 | 0.202 | 50.8 | 0.416 | 1.243 |
| 2 | ~2.0 | 0.211 | 54.6 | 0.417 | 1.208 |
| 3 | ~3.0 | 0.228 | 61.7 | 0.417 | 1.149 |
| 4 | ~4.0 | 0.253 | 72.1 | 0.417 | 1.077 |
| 5 | ~5.0 | 0.286 | 85.8 | 0.416 | 1 |

Figure 53:
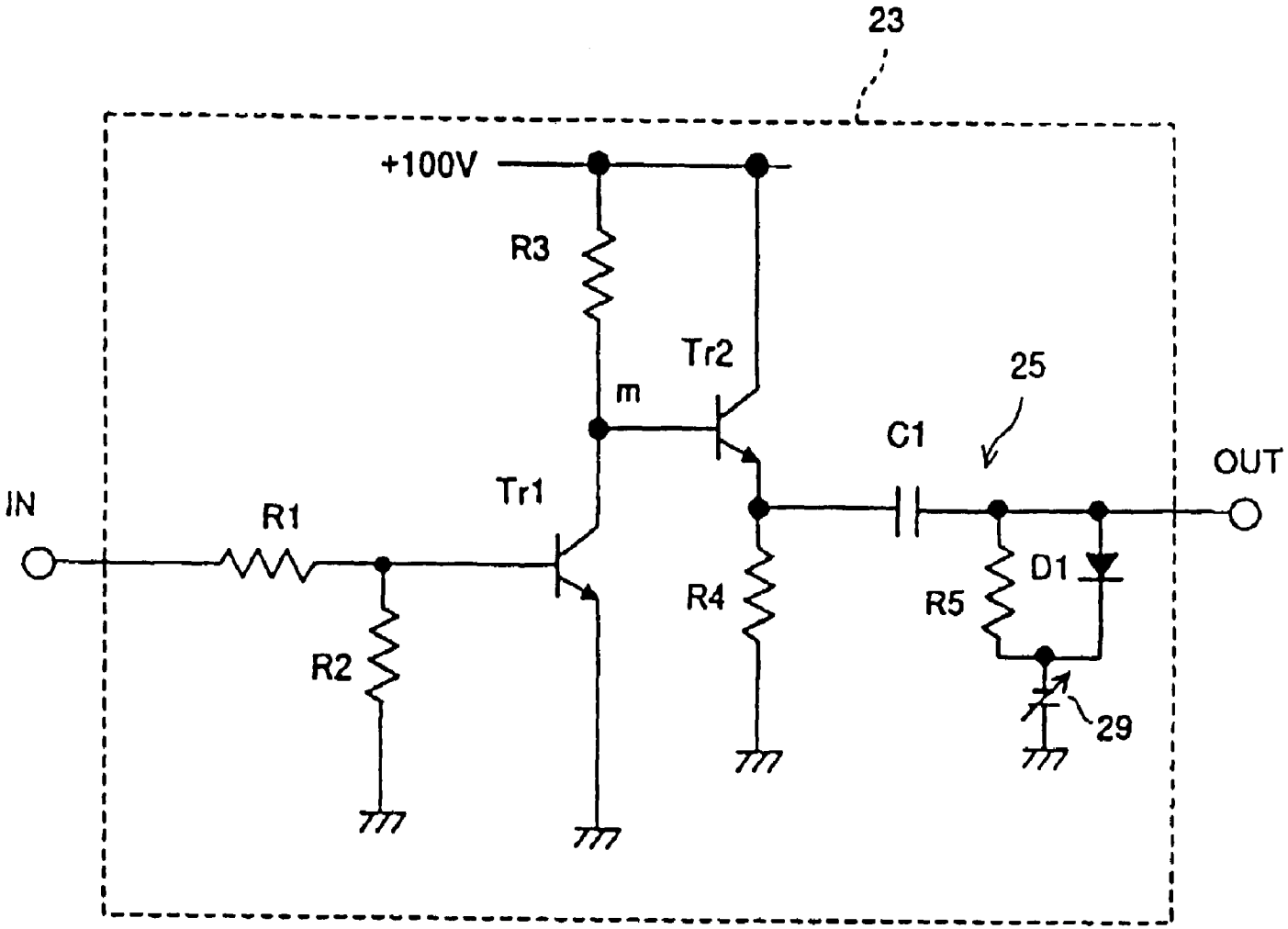
FIG. 53 shows an example of a waveform amplifier for generating the driving waveforms of the hopping voltage pattern according to the seventh embodiment of the present invention.

Next, the seventh embodiment of the present invention is described by referring to FIG. 53. In this embodiment, the bias voltage, which is added to the driving waveforms applied to the electrodes 102 on the transporting substrate 1 or 41, can be varied. FIG. 53 shows an example of the waveform amplifier 23 for outputting driving waveforms of the hopping voltage pattern in this case. The bias voltage circuit 28 for outputting a constant voltage in the circuit shown in FIG. 48 is replaced by a bias voltage circuit 29 capable of varying its output voltage. In addition, in the waveform amplifier 22, 24 for respectively outputting the driving waveforms of the transporting voltage pattern and the recycling and transporting voltage pattern, their corresponding bias voltages can be also varied. Moreover, the output voltage of the bias voltage circuit 29 can be adjusted by a main control unit (not shown).

The charge amount of the toner, the surface potential of the OPC photosensor will change according to the temperature and the humidity of the use environment or the use time of the printer. In addition, for a copying machine, there is a situation that a document with a low concentration is copied to get a high concentration, or to skip the background portion. In this embodiment, because the bias value can be changed, a very good image without the toner scattering can be formed no mater what the environment is changed, the mechanics is changed or the concentration of the document is low or high.

In addition, even though the bias voltage is not a feedback control, the mechanical property deviation after assembling all mechanical parts can be also adjusted to obtain an optimum image by adjusting the bias voltage.

Figure 54:
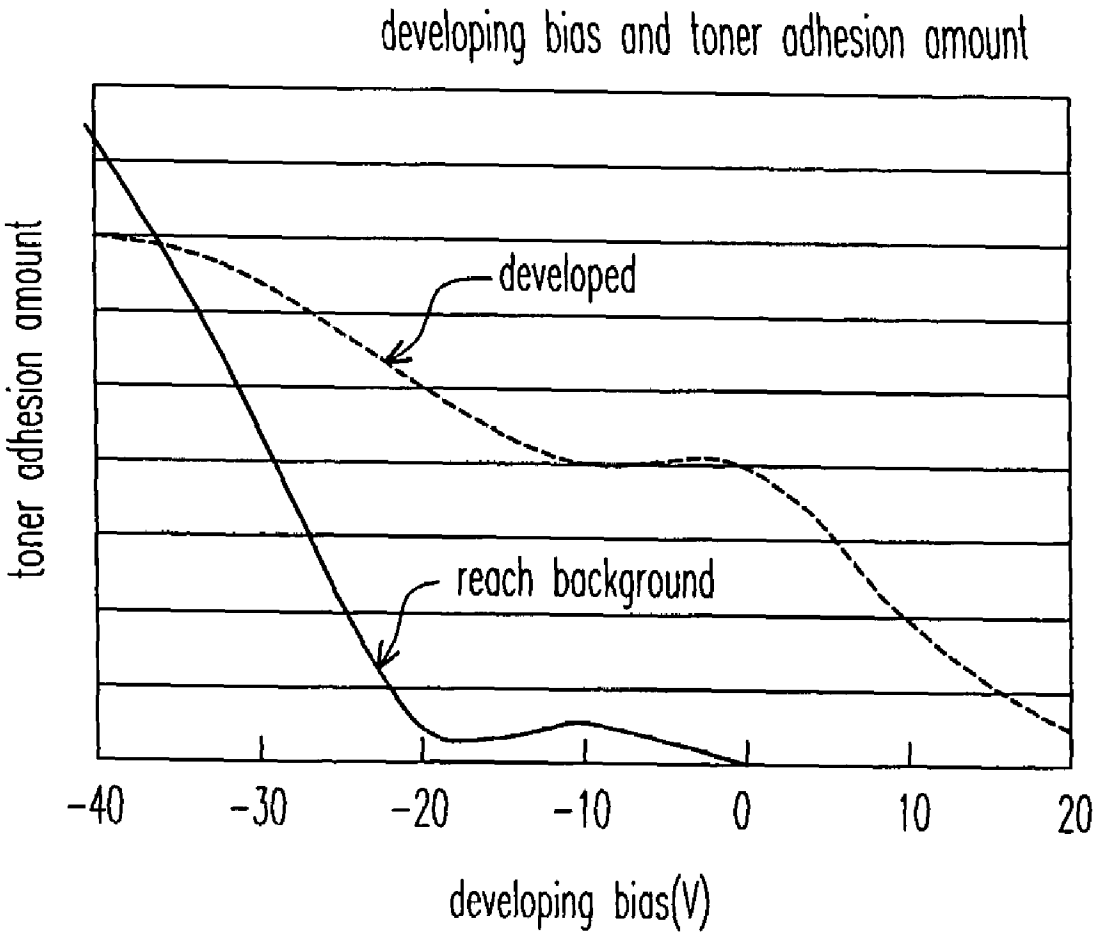
FIG. 54 shows a exemplary relationship between the developing bias voltage and the toner adhesion amount.

FIG. 54 is used to describe a developing bias when a DC bias voltage (the developing bias) is overlapped with the pulse driving waveforms and the toner adhesion amount to the background portion. First, the condition for the latent image supporter, the electrodes on the transporting substrate and other space parameters are as follows. The average diameter of the toner is 8 μm, the average Q/M ratio is −20 μC/g, the gap between the transporting substrate and the latent image supporter is 200 μm, the width of the line pattern of the latent image is 30 μm, the gap of the line pattern (the background portion) is 450 μm, the potential of the line pattern of the latent image (the image portion) is 30V, the potential of the background portion is 110V , the transporting electrode (the electrode 102) has a width of 30 μm and a gap of 30 μm. The basic driving pulse to the electrode 102 is 0V to 10V (three-phase driving) and its frequency is 3 kHz and has a duty cycle of 66%. With respect to the basic driving pulse, the DC bias voltage can be varied within +20V to −40V to perform the development. At this time, a relationship between the developing bias and the toner adhesion amount to the background portion is also shown in FIG. 54. In addition, at this time, the relationship between the potential of the electrode and the surface potential of the photosensor, etc. is shown in Table II.

TABLE II

| developing bias Potential (V) | potential of the transporting electrode: high Potential (V) | low Potential (V) | average Potential (V) | potential of the photosensor: background Potential (V) | Line image Potential (V) | Solid image Potential (V) | Toner number when reaching the background Number | Developed toner number Number |
|---|---|---|---|---|---|---|---|---|
| 20 | 20 | −80 | −13.3 | −110.4 | −28.8 | −0.3 | 0 | 1 |
| 10 | 10 | −90 | −23.3 | −110.7 | −29.0 | −0.6 | 0 | 4 |
| 0 | 0 | −100 | −33.3 | −110.9 | −29.3 | −0.8 | 0 | 8 |
| −10 | −10 | −110 | −43.3 | −111.1 | −29.5 | −1.0 | 1 | 8 |
| −20 | −20 | −120 | −53.3 | −111.4 | −29.7 | −1.3 | 1 | 10 |
| −30 | −30 | −130 | −63.3 | −111.6 | −30.0 | −1.5 | 9 | 13 |
| −40 | −40 | −140 | −73.3 | −111.8 | −30.2 | −1.7 | 17 | 14 |

In addition, the above condition for the latent image pattern is rigorous pattern that the toner adhesion is to develop an ultra fine line. If this pattern can be developed, the development in a wider aspect can be performed without any problem.

In FIG. 54, as the DC bias voltage increases from −40V to 10V , the toner number (number per unit length, represented by the solid line) reaching the background portion also decreases. But, the toner number (number per unit length, represented by the dash line) for developing the line latent image also decreases. In addition, this result is a measured value of an amount that the toner reaching the background is adhered with respect to the developing bias voltage within a developing time where the latent image supporter passes through a nip region.

The development has to be able to develop the minimum dot without contaminating the background portion. Therefore, it is better that toner does not reach the background and the toner can reach the latent image of the minimum dot width. From this point of view, according to the result of FIG. 54, in order to be able to develop the minimum dot width without background contamination, the developing bias is set −30V to +10V , and preferably is −20V to +V (when the developing bias is 0V , it is only an ordinary pulse driving waveforms). At this time, the average value of the driving pulse voltage is −63.3V to −23.3V, and preferably is −53.3V to −33.3V.

According to the result of evaluating the toner adhesion with the developing gap and the condition of the driving pulse as parameters, the frequency of the driving pulse (the driving waveform) is relatively high. In this condition, a normal image can be obtained by setting the average potential of the pulse voltage between the potential of the image portion and the potential of the non-image portion.

Furthermore, in a condition that the frequency of the driving pulse (the driving waveform) is relatively low, the potential of the initial departure of the hopped toner is not the average value, and is dominated by the low potential of the hopping voltage pattern (equivalent to the low potential (V) in Table II).

For example, when the average speed of the toner that is accelerated to fly is 0.3 m/sec, a time for moving to a distance of 30 μm high where the strength of the electric field is reduced down to one-fifth is 100 μsec. Therefore, in this case, if the time constant of the applied voltage of the driving waveform is not less than 100 μsec, the initial speed is obtained and the hopping operation can be performed. In this way, when the driving pulse whose potential applying time is larger than 100 μsec has a frequency equal to or less than 5 kHz for a duty cycle of 50%, and a frequency equal to or less than 3.3 kHz for a duty cycle of 66%, a suitable image can be obtained.

Figure 55:
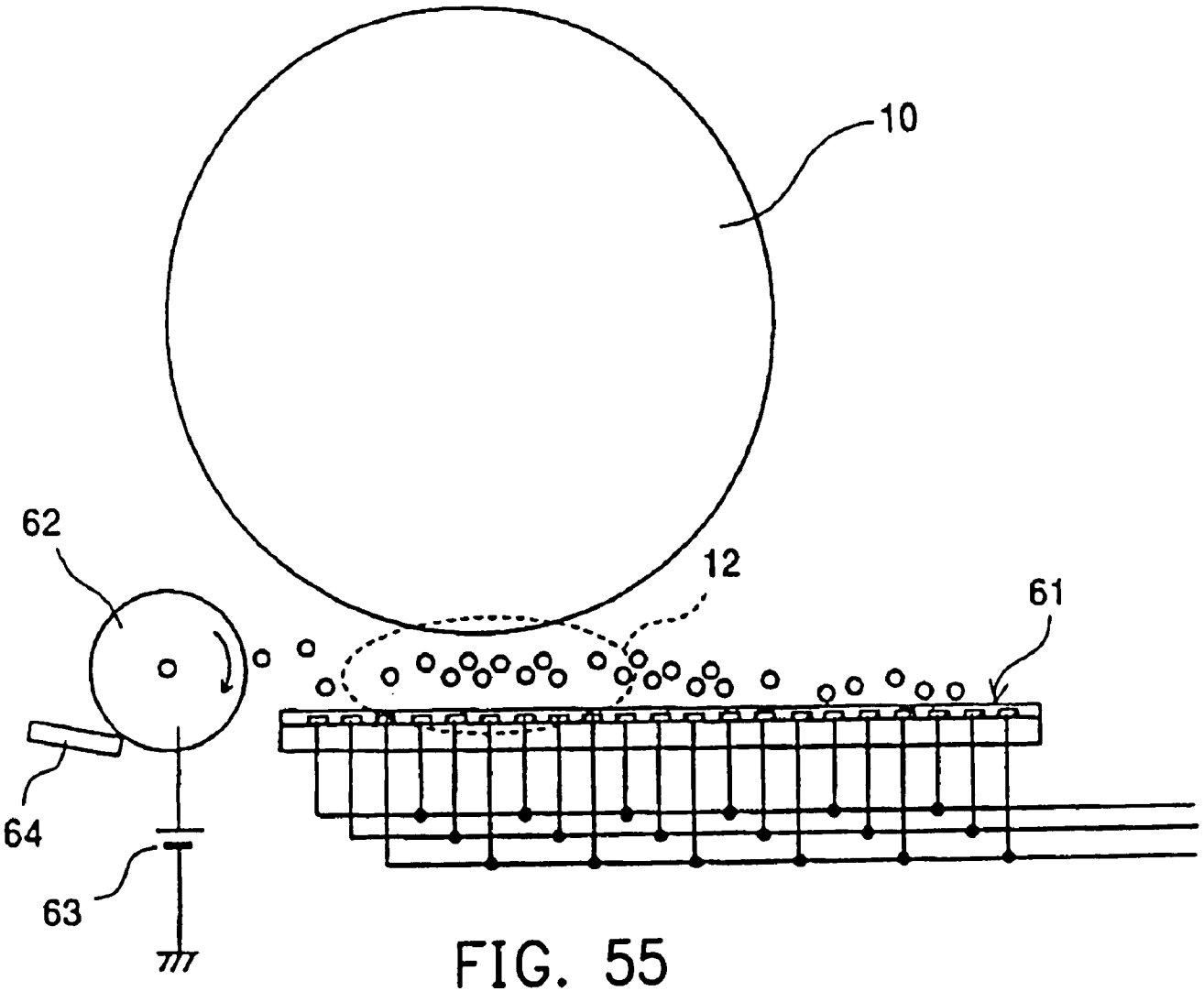
FIG. 55 shows a main portion for describing the developing device according to the eighth embodiment.

Next, the eighth embodiment of the present invention is described by referring to FIG. 55. In this embodiment, the transporting substrate, which is used to recycle the toner at the recycling region 13 in the above embodiments, is replaced. Instead, a transporting substrate 61 without the recycling region 13 is used to perform the development and a recycling roller 62 is disposed in the vicinity of an exit of the developing region 12, in which the recycling roller 62 is used as a means for generating an electric field that toner is directed opposite to the photosensor drum 10 (the latent image supporter). A bias voltage for generating an electric field is applied from the bias source 63 to the recycling roller 62. In addition, a recycling blade 64 is disposed for separating the recycled toner from the surface of the recycling roller 62.

In this embodiment, for example, the recycling roller 62 made of a metal roller with a diameter of 20 mm is arranged at the exit of the developing region 12 with a 5 mm gap from the OPC photosensor drum 10. When a bias voltage, e.g., +500V, is applied to the recycling roller 62, most of the floating toner is electrostatically adhered onto the recycling roller 62 (the metal roller), so that the toner scattering can be reduced.

Furthermore, the recycling roller 62 (the metal roller) is rotated in the same direction as the OPC photosensor drum 10, and therefore, at the gap therebetween, the two rollers 10, 62 move in a reverse direction. In this way, the air stream created by the rotation of the photosensor drum 10 can be ceased, so that all of the toner can be recycled and no toner scattering occurs.

As described above, means for generating an electric field that toner is directed opposite to the photosensor drum 10 (the latent image supporter) is not limited to the transporting substrate. A roller member or a plate-shaped member can be also used.

Figure 56:
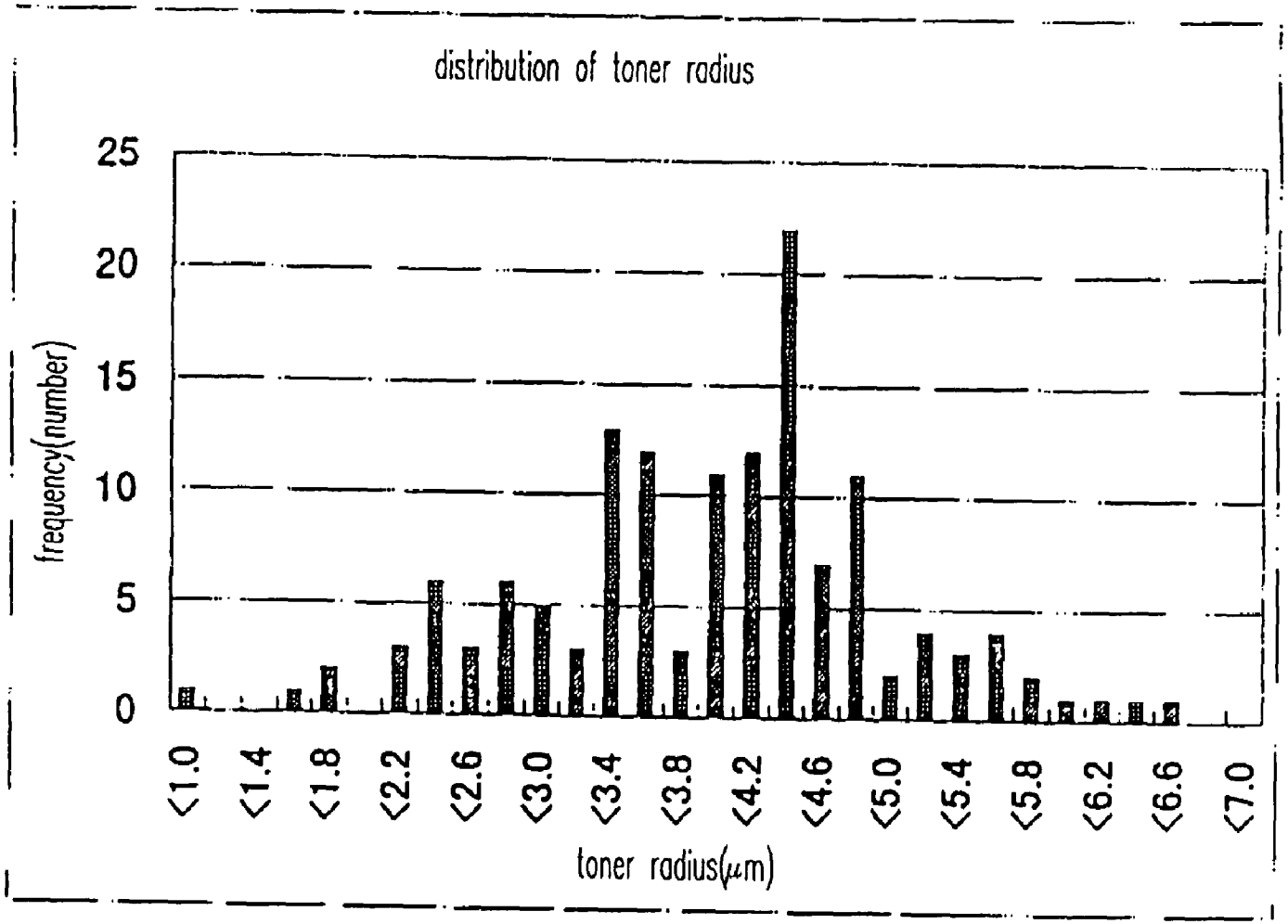
FIG. 56 shows a diameter distribution of toner used in the simulation.
Figure 57:
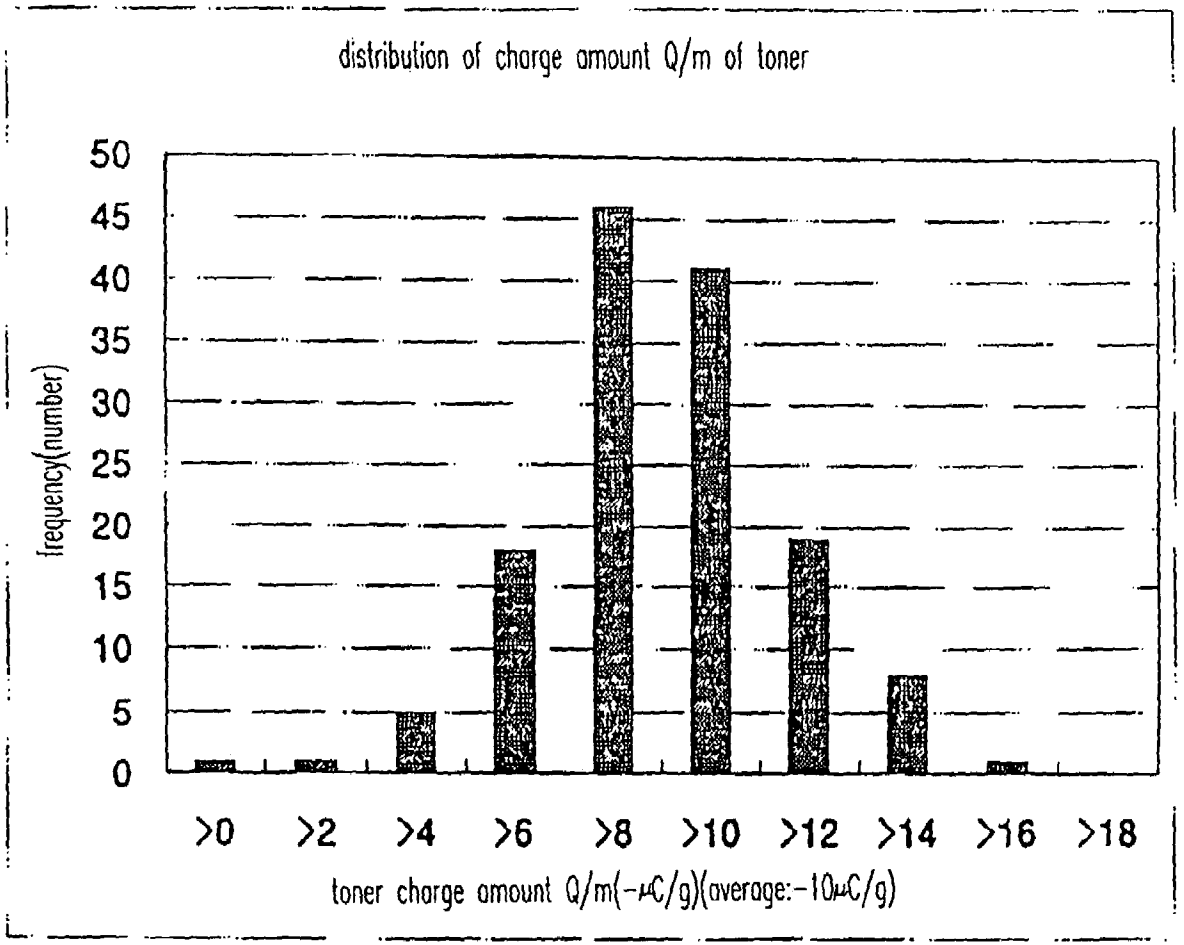
FIG. 57 shows a charge amount distribution (Q/m) of toner used in the simulation.

FIG. 56 shows a distribution of the toner diameter used in the simulation that is described in the aforementioned embodiment, and FIG. 57 shows a distribution of the charge amount Q/m. These distributions are examples based on actually measured values of conventional toner.

Figure 58:
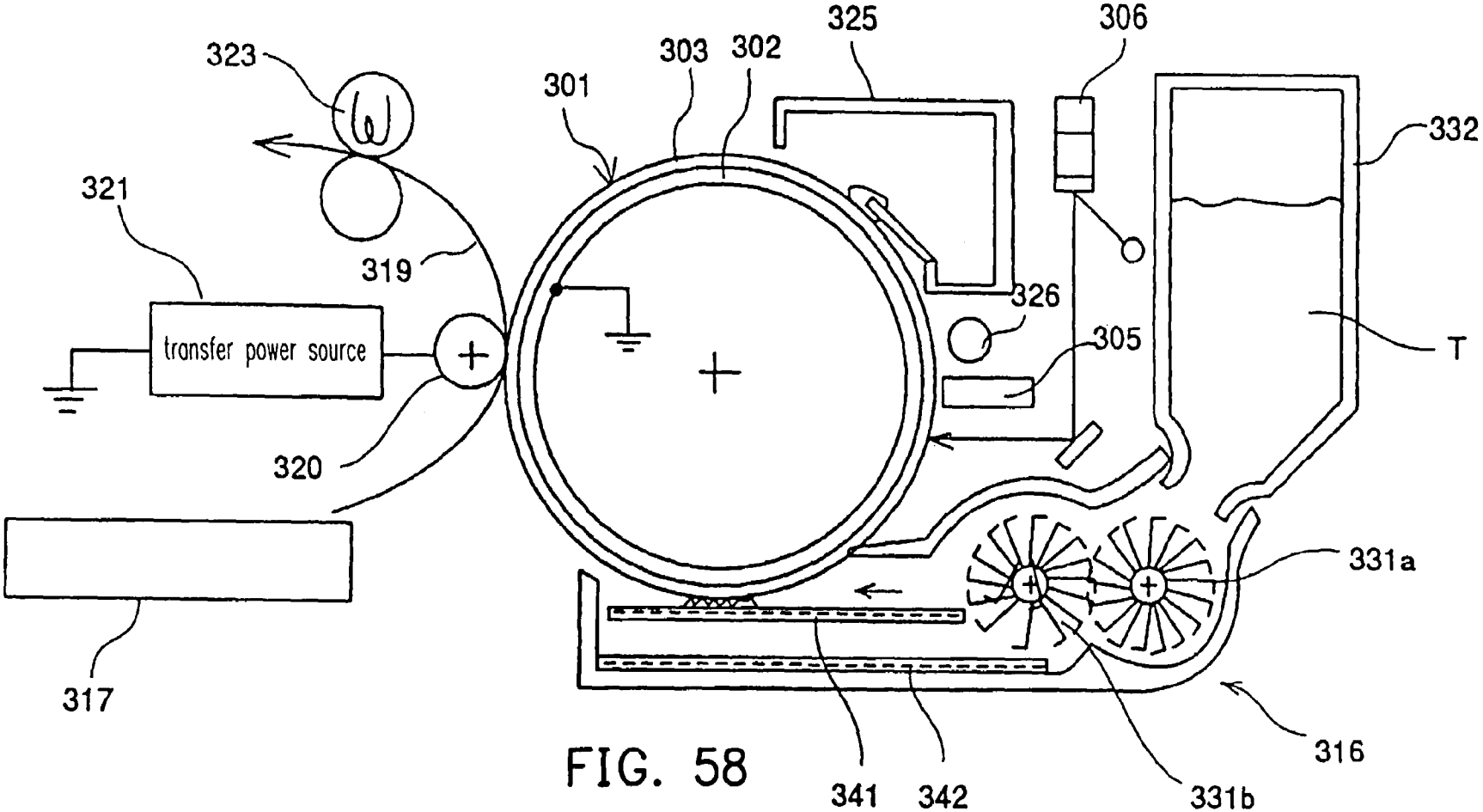
FIG. 58 shows the first example of an image forming device of the present invention.

Next, a first example of an image forming device comprising the developing device of the present invention is described by referring to FIG. 58. The entire structure and the operation of the image forming device are described in brief. A photosensor drum 301 (a latent image supporter) is constructed by forming a photosensor layer 303 on a substrate 302, and is driven to rotate in the arrow direction. The photosensor drum 301 is uniformly charged (electrified) by a charging device 305. An electrostatic latent image is formed on the surface of the photosensor drum 301 by an optical writing of a laser beam corresponding to an image that is read from an exposure unit 306.

The toner is adhered on the electrostatic latent image formed on the surface of the photosensor 301 by the developing device 316 (that is configured according to the previous embodiments of the present invention) to visualize the electrostatic latent image. The visualized image is then transferred onto a transfer paper (recording medium) 319 by a transfer roller 320, wherein the transfer paper 319 is fed from a paper feeding cassette 317 and a voltage is applied to the transfer roller 320 from a transfer power source 321. The transfer paper 319 where the visualized image is transferred thereon is separated from the surface of the photosensor drum 301 and passes through the rollers of a fixing unit 323 to fix the visualized image. Then, the transfer paper 319 is ejected to a paper ejecting tray that is arranged outside the image forming device.

On the other hand, after the transfer is finished, toner that is residual on the surface of the photosensor drum 301 are removed by a cleaning device 325. Charges that are residual on the surface of the photosensor drum 301 removed by a discharging lamp 326.

The developing device 316 is described. As an example of a member to charge toner (powder) in the developing device 316, two brushes of charging brushes 331*a*, 331*b* are arranged to be in contact with each other and driven to rotate. Toner T sent from a toner tank 332 is fictionized by the brushes 331*a*, 331*b* to charge the toner T.

The charged toner is sent to a transporting substrate 341 and then transported and hopped on the transporting substrate 341 to send the toner to a developing region facing the latent image supporter 301. After a desired development is performed, the toner provided for the development falls to the end of the transporting substrate 341 and the fallen toner is reversely sent to the charging member (the charging brush 331*b*) by a reverse transporting substrate 342.

In addition, the structures of the transporting substrate 341 and the reverse transporting substrate 342 are the same structure as the transporting substrate 1 as described above. Structures of driving circuits for providing driving waveforms to the electrodes on the transporting substrate 341 and the reverse transporting substrate 342 are not shown in the drawing, but they have the same structure as those of the developing devices described in the aforementioned embodiments.

According to this structure, the toner scattering is reduced. The development is performed with a high developing quality and therefore, a high quality image can be formed.

Figure 59:
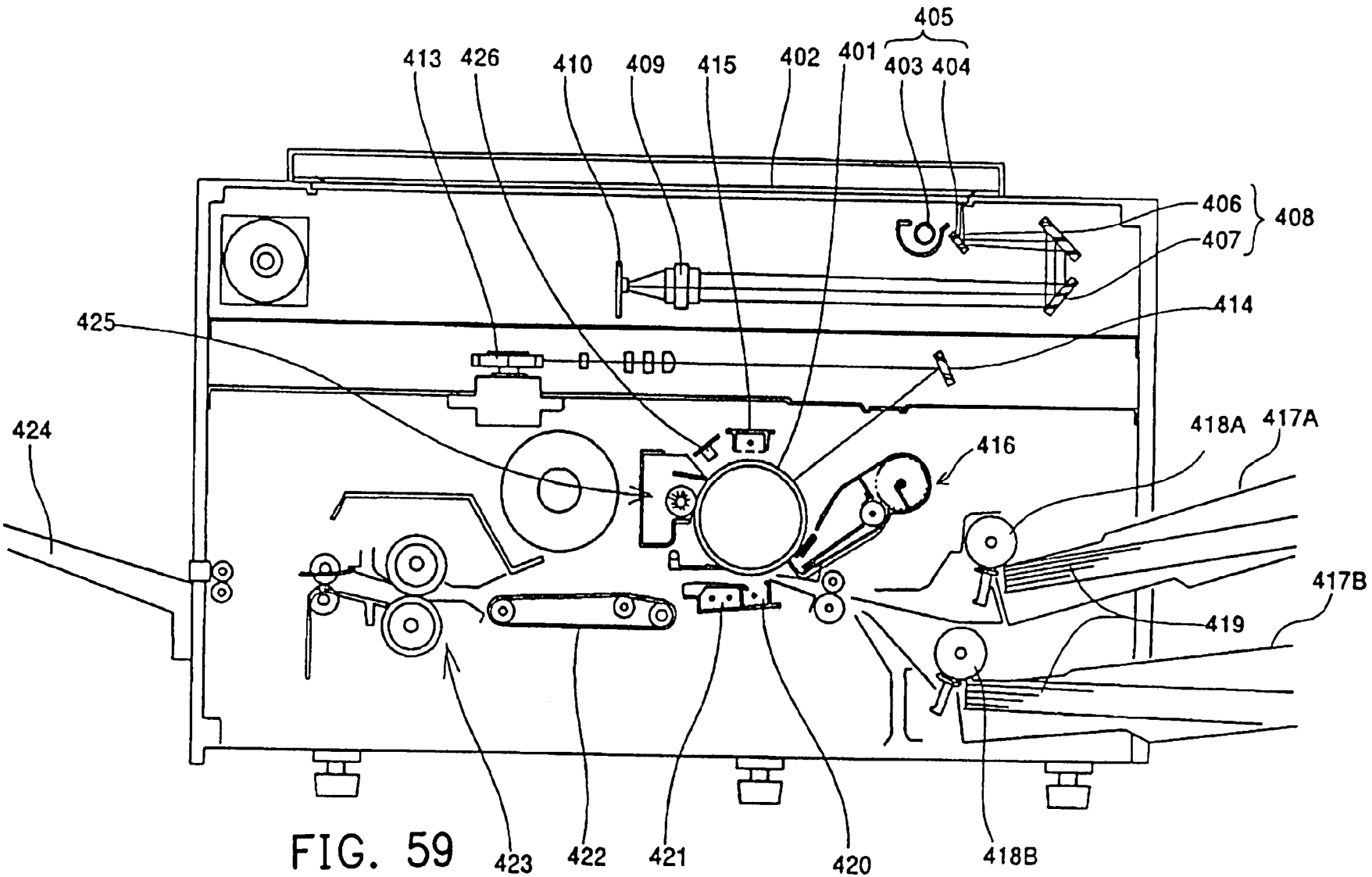
FIG. 59 shows second example of an image forming device of the present invention.

Next, another example of the image forming device is described by referring to FIG. 59. FIG. 59 shows a schematic structure of the entire image forming device. The entire structure and the operation of the image forming device are described in brief. A photosensor drum 401 (a latent image supporter, for example, an organic photosensor: OPC) is driven to rotate in the clockwise direction with respect to the drawing. A document is placed on a contact glass 402. As a print start switch (not shown) is pressed, a scanning optical system 405 comprising a document illuminating source 403 and a mirror 404, and a scanning optical system 408 comprising mirrors 406, 407 start to move to read an image document.

A scanned image is read as an image signal by an image reading element 410 that is arranged behind a lens 409. The read image signal is digitalized for an image process. Then, a laser diode (LD) is driven by signals on which the image process has performed. After a laser beam from the laser diode is reflected by a polygon mirror 413, the reflected laser beam is irradiated onto the photosensor drum 401 through a mirror 414. The photosensor drum 401 is uniformly charged by a charging device 415, and then an electrostatic latent image is formed on the surface of the photosensor drum 401 by an optical writing with the laser beam.

Toner is adhered on the electrostatic latent image on the surface of the photosensor drum 401 by an developing device 416 of the present invention, and then the electrostatic latent image is visualized. The visualized image (a toner image) is transferred onto a transfer paper (a recording paper) 419 (by using a corona discharge of a transfer charger 420, wherein the transfer paper 419 is fed by a paper feeding roller 418A or 418B from a paper feeding unit 417A, or 417B). The transfer paper 419 where the visualized image has transferred thereon is separated from the surface of the photosensor drum 401 by a separating charger 421, and then transported by a transporting belt 422. Then, the transfer paper 419 passes through a press contact portion of a fixing roller pair 423 to fix the visualized image, and the fixed transfer paper is ejected to a paper ejecting tray 424 that is arranged outside the image forming device.

On the other hand, after the transfer is finished, toner that is residual on the surface of the photosensor drum 401 are removed by a cleaning device 425. Charges that are residual on the surface of the photosensor drum 301 removed by a discharging lamp 426.

Figure 60:
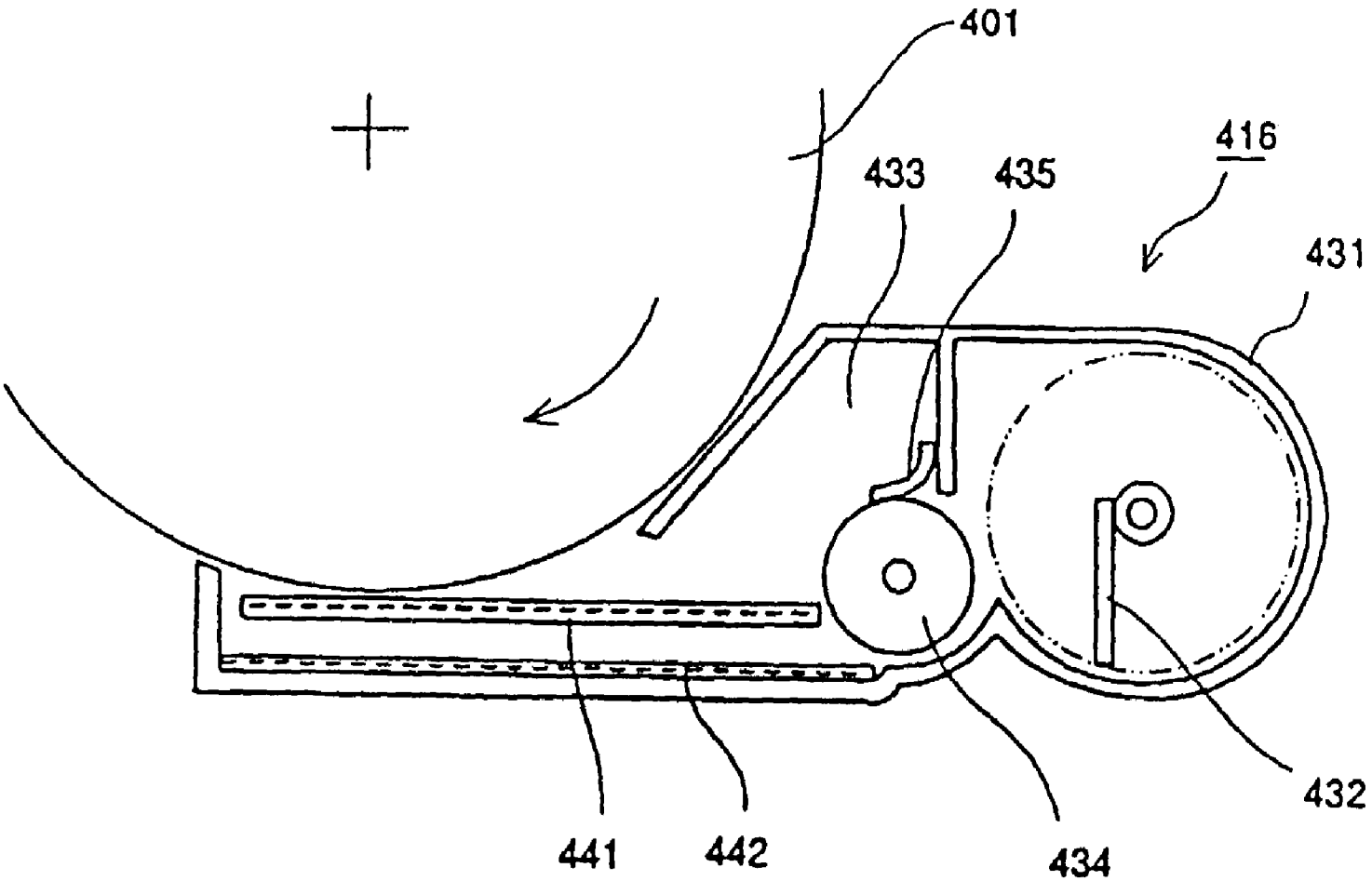
FIG. 60 is an enlarged diagram showing the developing device in the image forming device.

As shown in FIG. 60, the developing device 416 comprises a toner pot 431 for containing toner, a agitator 432 for stirring the toner in the toner pot 431, a charging roller 434 for charging the toner in the toner pot 431 to provide the charged toner to a toner box 433, and a doctor blade 435 that is arranged to be in contact with the peripheral surface of the charging roller 434.

In addition, the developing device 416 further comprises a transporting substrate 441 and a reverse transporting substrate 442. The transporting substrate 441 is used to transport and hop the toner provided within the toner box 433 for developing the latent image. The reverse transporting substrate 442 is used to transport toner, which are not provided to develop and fallen from the end of the transporting substrate 441, back to the charging member (the charging roller 434).

As the previous example of the image forming device, the structures of the transporting substrate 441 and the reverse transporting substrate 442 are the same structure as the transporting substrate 1 as described above. Structures of driving circuits for providing driving waveforms to the electrodes on the transporting substrate 441 and the reverse transporting substrate 442 are not shown in the drawing, but they have the same structure as those of the developing devices described in the aforementioned embodiments.

According to this structure, the toner scattering is reduced. The development is performed with a high developing quality and therefore, a high quality image can be formed.

Figure 61:
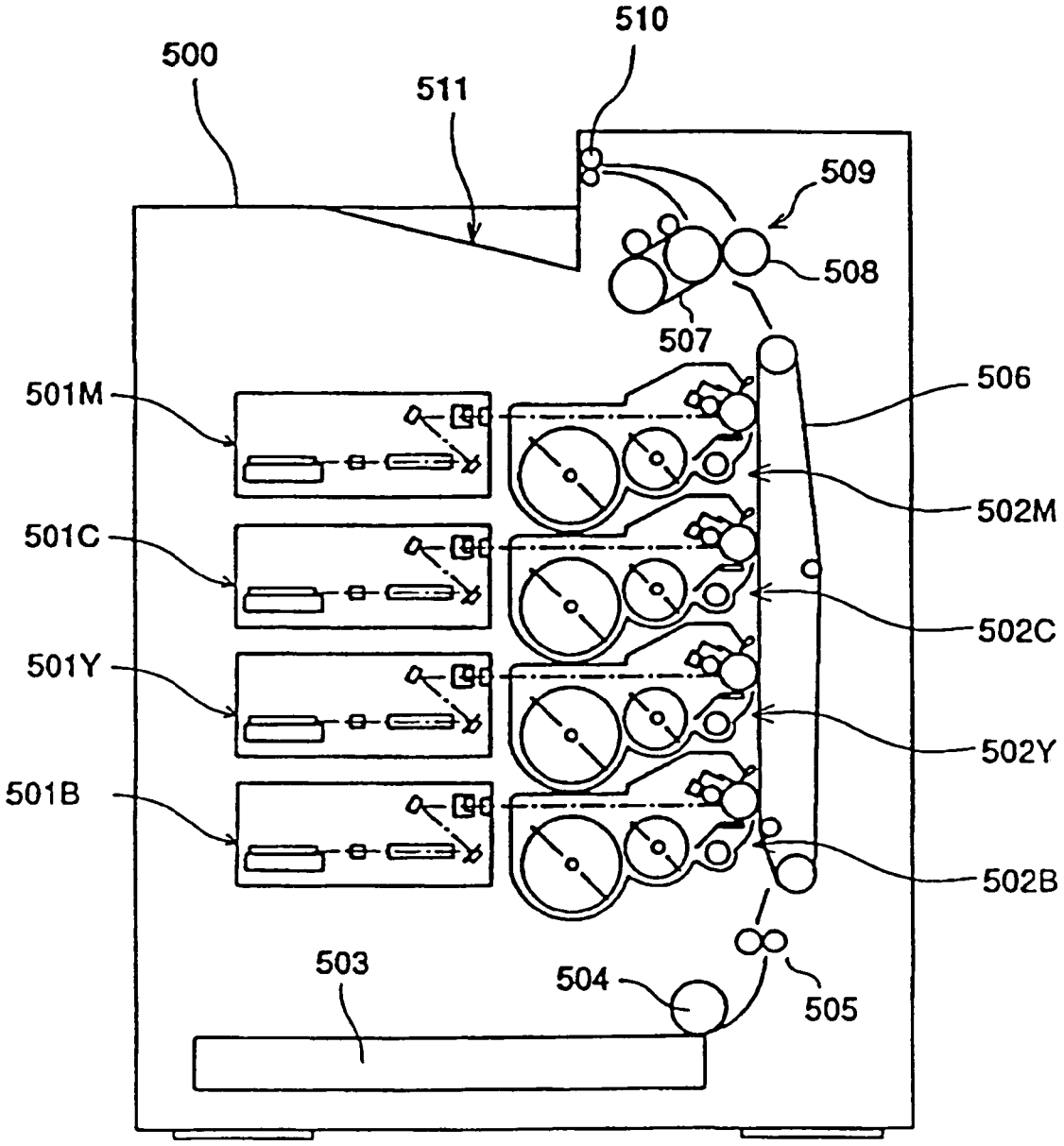
FIG. 61 shows the third example of an image forming device of the present invention.
Figure 62:
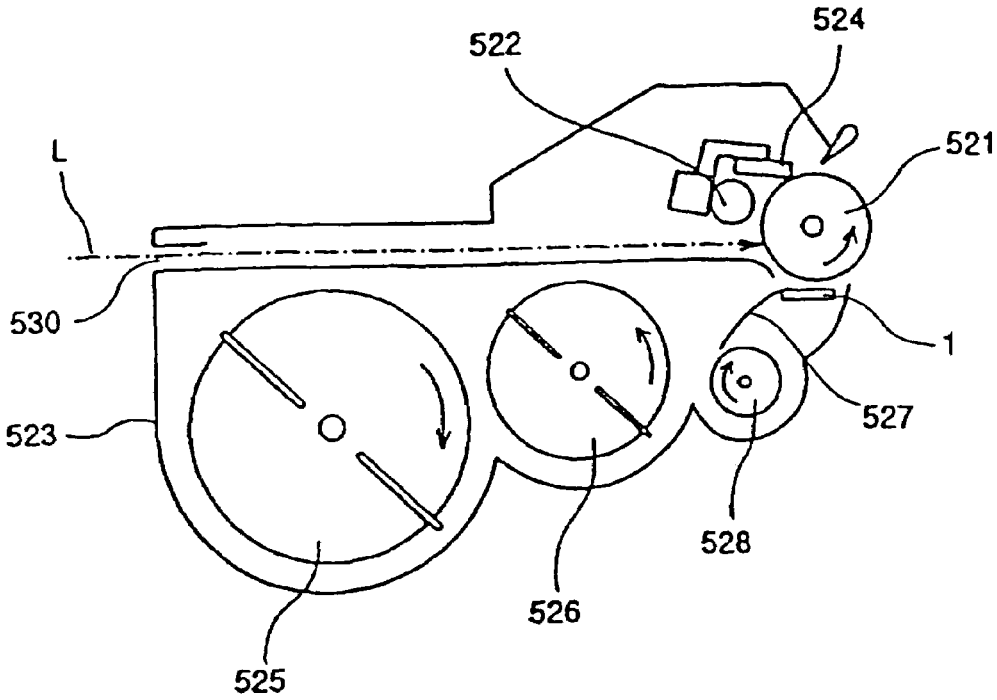
FIG. 62 shows a schematic diagram of a process cartridge in the image forming device of FIG. 61.

Next, a third example of an image forming device with a process cartridge of the present invention is described in brief by referring to FIGS. 61 and 62. FIG. 61 shows a schematic structure of the entire image forming device, and FIG. 62 shows a schematic structure of the process cartridge forming the image forming device.

The image forming device 500 is an example of a laser printer that is able to form a full color image with four colors of magenta (M), cyan (C), yellow (Y) and black (Bk). The image forming device 500 comprises four optical writing devices 501M, 501C, 501Y, 501Bk (hereinafter, referring to 501), four process cartridges 502M, 502C, 502Y, 502Bk, a paper feeding cassette 503, a paper feeding roller 504, resist rollers 505, a transfer belt 506, a fixing device 509, and paper ejecting rollers 510. The optical writing devices 501M, 501C, 501Y, 501Bk are used to irradiate laser beams corresponding to image signals of colors M, C, Y, Bk. The four process cartridges 502M, 502C, 502Y, 502Bk are used to form images. The paper feeding cassette 503 is used to store recording papers on which the full color image is transferred thereon. The paper feeding roller 504 is used to feed the recording paper from the paper feeding cassette 503. The resist rollers 505 are used to transport the recording paper with a predetermined timing. The transfer belt 506 transports the recording paper to a transferring position of each process cartridge. The fixing device 509 comprises a fixing belt 507 and a pressure roller 508 and is used to fix the image that has been transferred on the recording paper. The paper ejecting rollers 510 ejects the recording paper to an paper ejecting tray 511 after the recording paper has been fixed.

The four process cartridges 502M, 502C, 502Y, 502Bk have the same structure (referring to the process cartridge 502, hereinafter). As shown in FIG. 62, each process cartridge 502 comprises a photosensor drum 521 (a latent image supporter), a charging roller 522, a developing device 523 of the present invention, and a cleaning blade 524, etc., all of which are integrally arranged within a case of the process cartridge 502. The process cartridge 502 is detachable from the main body of the image forming device. Because the developing device 523 is disposed within the detachable process cartridge 502, the maintenance can be improve and can be easily replaced together with the other devices.

In addition, a toner supply roller 525, a charging roller 526, a transporting substrate 1, a substrate 527 for sending the toner to the transporting substrate 1, a toner returning roller 528 for returning the recycled toner is arranged within the developing device 523. The toner with respective color is contained within each the developing device 523. In addition, a slit 530 is formed on the back side of the process cartridge 502, wherein the slit 530 is used as a window to which the laser beam from the optical writing device 501 is incident.

Each of the optical writing device 501M, 501C, 501Y, 501Bk comprises a semiconductor laser, a collimator lens, an optical deflector (such as a polygon mirror), and an optical system for scanning and imaging, etc. The laser beam is irradiated to scan the photosensors 521 of the process cartridges 502M, 502C, 502Y, 502Bk, so as to write an image on each of the photosensors 521. The laser beam is modulated according to image data of each color that is input from an external device's host of a personal computer, etc., for example an image processing device.

As the image forming process begins, the photosensor 521 of each of the process cartridges 502M, 502C, 502Y, 502Bk is uniformly charged by the charging roller 522. The laser beams corresponding to image data from the optical writing device 501M, 501C, 501Y, 501Bk are respectively irradiated onto the photosensor to form each color's electrostatic latent image.

By using the ETH phenomenon of the transporting substrate 1 of the developing device 523, the electrostatic latent image formed on the photosensor 521 is developed with each color's toner to visualize the electrostatic latent image. In addition, toner that is not provided to the development is transported by the transporting substrate 1, and then the toner is returned back to an entrance side of the toner substrate 527 by using the toner returning roller 528. In this way, by using the developing device of the present invention to perform the development, a high quality image as described above can be obtained.

On the other hand, synchronizing with the image formation for each color of each of the process cartridges 502Bk, 502Y, 502C, 502M, the recording paper in paper feeding cassette 503 is fed to the paper feeding roller 504. Then, the recording paper is transported to the transfer belt 521 by the resist rollers 505 with the predetermined timing. Thereafter, the recording paper is carried on the transfer belt 506 and sequentially transported towards the photosensors 521 of the process cartridges 502Bk, 502Y, 502C, 502M. The toner images of the Bk, Y, C and M colors on the photosensors 521 are sequentially overlapped and transferred. The recording paper where the toner images of the four colors is transported to the fixing device 509. The full color image comprising the toner images of the four colors are fixed and then ejected to the paper ejecting tray 511.

Figure 63:
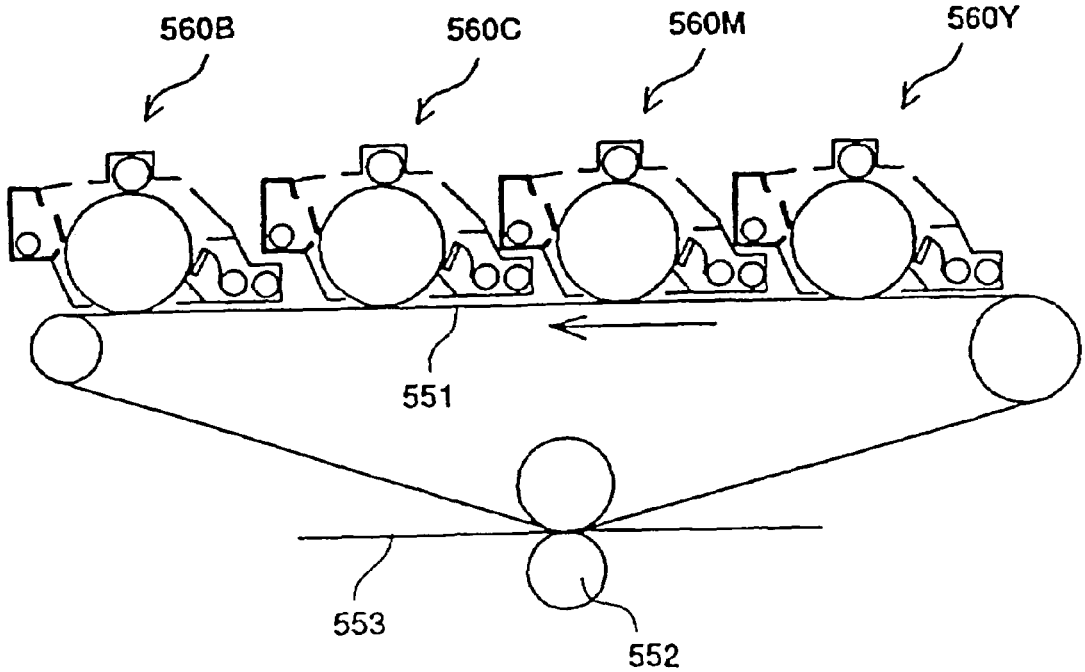
FIG. 63 shows the fourth example of an image forming device of the present invention.
Figure 64:
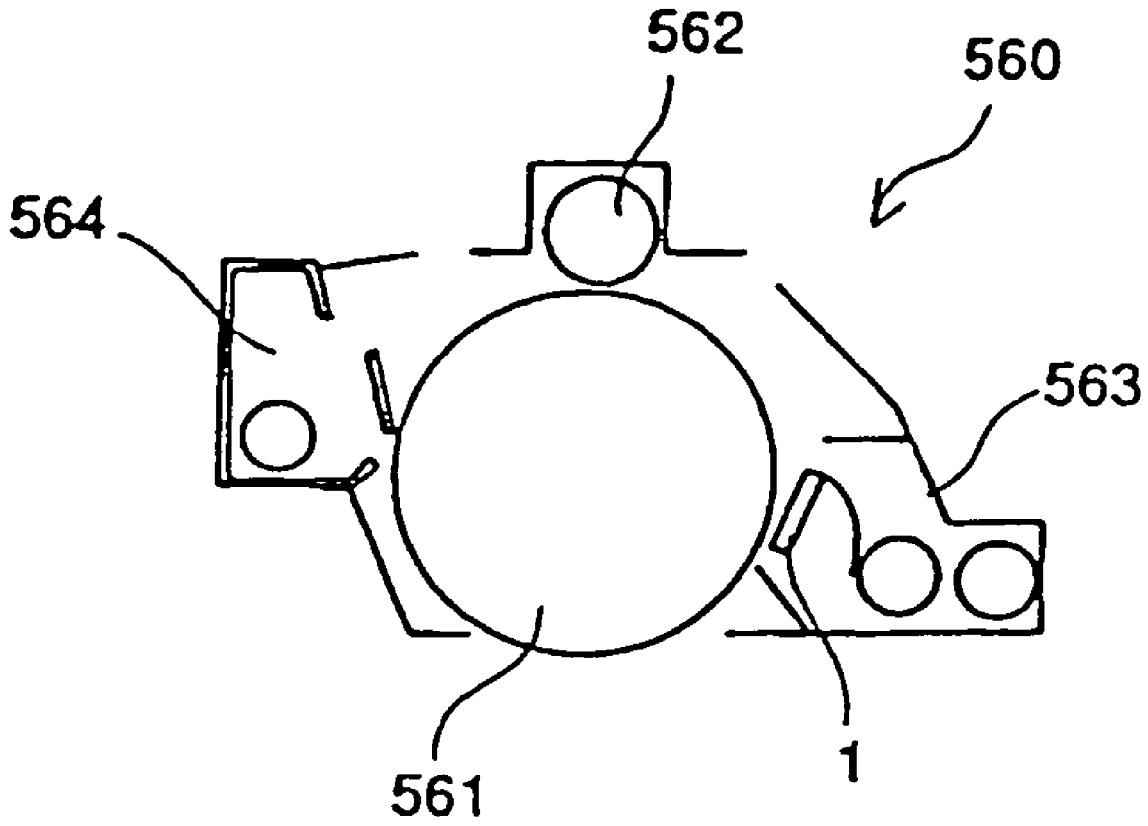
FIG. 64 shows a schematic diagram of a process cartridge in the image forming device of FIG. 63.

Next, a fourth example of an image forming device with a process cartridge of the present invention is described in brief by referring to FIGS. 63 and 64. FIG. 63 shows a schematic structure of the entire image forming device, and FIG. 64 shows a schematic structure of the process cartridge forming the image forming device.

The image forming device is a tandem type color image forming device, wherein process cartridges 560Y, 560M, 560C, 560Bk (referring to a process cartridge 560) are apposition with one another along a transfer belt (an image supporter) 551 that extends in the horizontal direction. In addition, the process cartridges 560 are described with an order of the yellow, the magenta, the cyan and the black colors, but this order is not limited, and sequential order can be used.

Each of the process cartridges 560 comprises an image supporter 561, a charging means 562, a developing means 563 comprising a transporting substrate 1 (an electrostatic transporting device) of the present invention, a cleaning device 564, all of which are integrally set within the process cartridge 560. The process cartridges 560 are detachable from a main body of the image forming device, such as a copy machine or a printer.

In general, the color image forming device is large since the color image forming device comprise a plurality of image forming units. Furthermore, in the developing device, when each unit, such as the cleaning unit or the charging unit, etc., is individually malfunctioned or required to be replaced because of its lifetime, the device is very complex and to exchange the individual unit is very difficult.

At least, the image supporter and the constituting elements of the developing device are integrated as the process cartridge 560. In this way, a small and highly durable color image forming device can be provided, wherein the user can exchange each unit easily.

The developed toner images on the image supporters 562, which are respectively developed by the process cartridges 560Y, 560M, 560C, 560Bk, are sequentially transferred onto the transfer belt 551, wherein the transfer belt 551 extends in the horizontal direction and a transfer voltage is applied thereon.

The image formations of the yellow, the magenta, the cyan, the black colors are performed, and then the multiple formed images are transferred on the transfer belt 551, and then arranged to be transferred onto the transfer material 553 by using a transfer means 552. Then, the multiple toner image on the transfer material 553 is fixed by a fixing device (not shown).

In the image forming device as describe above, because any one of the image forming device comprises the developing device with the electrostatic transporting device of the present invention, the device can be smaller and the device cost can be reduced. Furthermore, no toner scattering occurs and the image quality can be improved.

Additionally, in the above embodiment, toner is used as an example to describe powder, but for a device used to transport powder other than toner, the present invention can be also suitable. In addition, three-phase signals are used as an example to describe the driving signals applied to the electrodes, however, four-phase signals or six-phase signals can be also suitable.

In summary, as described above, according to the developing device of the present invention, potentials are applied to electrodes on the transporting member for generating an electric field so that the powder moves towards the latent image supporter side at the image portion of the latent image and the powder moves in a direction opposite to the latent image supporter side at the non-image portion. Therefore, the developing device can be driven with a low voltage and a high quality development can be performed with a high developing efficiency.

Additionally, according to the present invention, an electric field is formed in such a manner that the powder moves towards the latent image supporter side at the developing region and the powder moves in a direction opposite to the latent image supporter side at the region after the developing region. Therefore, the developing device can be driven with a low voltage and a high quality development can be performed with a high developing efficiency. Furthermore, the powder scattering can be further suppressed.

According to the developing method of the invention, an electric field is formed in a direction where the powder moves in a direction opposite to the latent image supporter at the region after the developing region and the powder is drawn back at the region after the developing region. Therefore, the scattered powder can be reduced and the developing quality can be improved.

According to the process cartridge of the present invention, because the process cartridge comprises the transporting member of the developing device of the present invention, the process cartridge can be driven with a low voltage. Therefore, a process cartridge capable of performing a high quality development with a high developing efficiency and capable of forming a high quality image can be obtained.

According to the image forming device of the present invention, because the image forming device comprises the developing device or the process cartridge of the present invention, a high quality image can be formed.

According to the image forming method, the developing method of the present invention is used to develop the latent image and then to form the image. Therefore, no scattered powder occurs and a high quality image can be formed.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A developing device, comprising:

a transporting member arranged opposite to a latent image supporter and configured to develop a latent image on the latent image supporter with a powder while moving the powder;

said transporting member comprising a plurality of electrodes configured to generate a traveling-wave electric field to move the powder, wherein an average potential of n-phase voltages applied to the plurality of electrodes of the transporting member is set to a potential between a potential of an image portion of the latent image and a potential of a non-image portion of the latent image.

2. The developing device of claim 1, wherein the n-phase voltages applied to the electrodes of the transporting member have a waveform such that a pulse voltage and a DC bias voltage are overlapped.

3. The developing device of claim 2, further comprising:

means for outputting the DC bias voltage, wherein the means is able to vary the DC bias voltage.

4. The developing device of claim 1, wherein the n-phase voltages applied to the plurality of electrodes of the transporting member are pulse-shaped waveforms.

5. The developing device of claim 1, wherein the n-phase voltages applied to the plurality of electrodes of the transporting member have a pulse-shaped waveform, and wherein a potential of the pulse-shaped waveform that causes the powder to repulsively fly is a potential between a potential of the image portion of the latent image and a potential of the non-image portion of the latent image.

6. A process cartridge, which is detachable from a main body of an image forming device, comprising:

a housing; and the developing device according to claim 1.

7. An image forming device for forming a color image, comprising:

at least one latent image supporter configured to bear a latent image thereon; and a plurality of process cartridges each configured to develop the latent image with a powder to form a visual image on the image supporter, wherein each of the plurality of process cartridges is the process cartridge according to claim 6.

8. An image forming device, comprising:

a latent image supporter configured to bear a latent image thereon; and a developing device configured to develop the latent image with a powder to form a visual image on the latent image supporter, wherein the developing device is the developing device according to claim 1.

* * * * *